US007659669B2

(12) United States Patent
Nishida et al.

(10) Patent No.: US 7,659,669 B2
(45) Date of Patent: Feb. 9, 2010

(54) PLASMA DISPLAY PANEL AND FIELD EMISSION DISPLAY

(75) Inventors: Jiro Nishida, Kanagawa (JP); Yuji Egi, Kanagawa (JP); Takeshi Nishi, Kanagawa (JP); Shunpei Yamazaki, Tokyo (JP)

(73) Assignee: Semiconductor Energy Laboratory Co., Ltd., Atsugi-shi, Kanagawa-Ken (JP)

( * ) Notice: Subject to any disclaimer, the term of this patent is extended or adjusted under 35 U.S.C. 154(b) by 12 days.

(21) Appl. No.: 11/950,645

(22) Filed: Dec. 5, 2007

(65) Prior Publication Data

US 2008/0144180 A1 Jun. 19, 2008

(51) Int. Cl.
*H01J 17/49* (2006.01)

(52) U.S. Cl. ..... 313/582; 313/495

(58) Field of Classification Search ..... 313/582–587, 313/495–497

See application file for complete search history.

(56) References Cited

U.S. PATENT DOCUMENTS

| | | | | |
|---|---|---|---|---|
| 6,811,274 | B2 | 11/2004 | Olczak | |
| 6,825,896 | B2 | 11/2004 | Goto et al. | |
| 6,951,400 | B2 | 10/2005 | Chisholm et al. | |
| 7,094,452 | B2 | 8/2006 | Yamashita et al. | |
| 7,297,386 | B2 | 11/2007 | Suzuki et al. | |
| 2002/0044356 | A1 | 4/2002 | Arakawa et al. | |
| 2003/0102286 | A1 | 6/2003 | Takahara et al. | |
| 2003/0169386 | A1 * | 9/2003 | Goto et al. | 349/65 |
| 2003/0180476 | A1 | 9/2003 | Yamashita et al. | |
| 2004/0227446 | A1 | 11/2004 | Fujimoto et al. | |
| 2005/0074579 | A1 | 4/2005 | Suzuki et al. | |
| 2005/0190321 | A1 | 9/2005 | Ohsawa | |
| 2006/0050387 | A1 | 3/2006 | Arakawa et al. | |
| 2006/0172119 | A1 | 8/2006 | Hayashi et al. | |
| 2006/0250064 | A1 | 11/2006 | Park et al. | |
| 2008/0129183 | A1 | 6/2008 | Egi et al. | |
| 2008/0129184 | A1 | 6/2008 | Nishida et al. | |

(Continued)

FOREIGN PATENT DOCUMENTS

JP 08-297202 11/1996

(Continued)

OTHER PUBLICATIONS

English Translation of JP 2003-240904 A.*

(Continued)

*Primary Examiner*—Toan Ton
*Assistant Examiner*—Hana A Sanei
(74) *Attorney, Agent, or Firm*—Nixon Peabody, LLP; Jeffrey L. Costellia

(57) ABSTRACT

To provide a PDP and an FED with high visibility, having an anti-reflection function capable of reducing reflection of incident light from external. An anti-reflection layer including a plurality of pyramid-shaped projections, apexes of which are provided at equal intervals and in which each side of a base which forms a pyramid shape of one of the plurality of pyramid-shaped projections is in contact with a side of a base which forms a pyramid shape of an adjacent pyramid-shaped projection, is included. In other words, one pyramid-shaped projection is surrounded by other pyramid-shaped projections, and the base of the pyramid-shaped projection shares a side of a base with the base of the adjacent pyramid-shaped projection.

13 Claims, 28 Drawing Sheets

U.S. PATENT DOCUMENTS

| | | | |
|---|---|---|---|
| 2008/0129188 | A1 | 6/2008 | Egi et al. |
| 2008/0129933 | A1 | 6/2008 | Nishida et al. |
| 2008/0130122 | A1 | 6/2008 | Egi et al. |
| 2008/0158682 | A1 | 7/2008 | Egi et al. |
| 2008/0165315 | A1 | 7/2008 | Nishida et al. |

FOREIGN PATENT DOCUMENTS

| | | | |
|---|---|---|---|
| JP | 2001-264520 | | 9/2001 |
| JP | 2003-177207 | | 6/2003 |
| JP | 2003-240904 | | 8/2003 |
| JP | 2003-248102 | | 9/2003 |
| JP | 2003-279705 | | 10/2003 |
| JP | 2003-295778 | | 10/2003 |
| JP | 2004-085831 | | 3/2004 |
| JP | 2004-177781 | | 6/2004 |
| JP | 2004-291500 | | 10/2004 |
| JP | 2005064324 | A * | 3/2005 |
| JP | 2005-173457 | | 6/2005 |
| JP | 2005-181740 | | 7/2005 |
| JP | 2005-264099 | | 9/2005 |
| JP | 2006-010831 | | 1/2006 |
| JP | 2006-509240 | | 3/2006 |
| JP | 2006-133617 | | 5/2006 |
| JP | 2006-171229 | | 6/2006 |
| JP | 2006-189784 | | 7/2006 |
| JP | 2006-313360 | | 11/2006 |
| WO | WO 2004/051325 | A1 | 6/2004 |
| WO | WO 2005/010572 | A1 | 2/2005 |
| WO | WO 2005/088355 | A1 | 9/2005 |

OTHER PUBLICATIONS

English Translation of JP 2006-189784 A.*
International Search Report (Application No. PCT/JP2007/073125; PCT 10174) Dated: Jan. 15, 2008.
Written Opinion (Application No. PCT/JP2007/073125; PCT10174) Dated: Jan. 15, 2008.

* cited by examiner

PLASMA DISPLAY PANEL AND FIELD EMISSION DISPLAY

TECHNICAL FIELD

The present invention relates to a plasma display panel and a field emission display each having an anti-reflection function.

BACKGROUND ART

In various displays (a plasma display panel (hereinafter referred to as a PDP), a field emission display (hereinafter referred to as an FED), and the like), there may be a case where it becomes hard to see images of a display screen due to reflection of its surroundings by surface reflection of incident light from external or the like, so that visibility is decreased. This is a considerable problem particularly when the size of the display device is increased or the display device is used outdoors.

In order to prevent such reflection of incident light from external, a method for providing an anti-reflection film for display screens of a PDP and an FED has been employed. For example, there is a method for providing an anti-reflection film that has a multilayer structure of stacked layers having different refractive indexes so as to be effective for a wide wavelength range of visible light (for example, Reference 1: Japanese Published Patent Application No. 2003-248102). With the multilayer structure, incident lights from external reflected at interfaces between the stacked layers interfere and cancel each other, which provides an anti-reflection effect.

Alternatively, as an anti-reflection structure, minute cone-shaped or pyramid-shaped projections are arranged over a substrate, so that reflectance on a surface of the substrate is decreased (for example, Reference 2: Japanese Published Patent Application No. 2004-85831).

DISCLOSURE OF INVENTION

However, with the above-described multilayer structure, light, which cannot be cancelled, of the incident lights from external reflected at the layer interfaces is emitted to a viewer side as reflected light. Further, in order to achieve mutual cancellation of incident lights from external, it is necessary to precisely control optical characteristics of materials, thicknesses, and the like of stacked films, and it has been difficult to perform anti-reflection treatment to all lights from external which are incident from various angles. In addition, the cone-shaped or pyramid-shaped anti-reflection structure does not have a sufficient anti-reflection function.

In view of the foregoing, a conventional anti-reflection film has a functional limitation, and a PDP and an FED each having a higher anti-reflection function have been demanded.

It is an object of the present invention to provide a highly-visible PDP and a highly-visible FED each having an anti-refection function capable of further reducing reflection of incident light from external.

The present invention provides a PDP and an FED each including an anti-reflection layer having a structure, in which a plurality of pyramid-shaped projections are arranged densely without a space therebetween, thereby changing a refractive index due to a physical shape that is the pyramid-shaped projections protruding toward the outside (air side) from a substrate surface to serve as a display screen. In the present invention, apexes of the plurality of pyramid-shaped projections are arranged at equal intervals, and each side of a base which forms a pyramid shape of a pyramid-shaped projection is arranged to be in contact with a side of a base which forms a pyramid shape of an adjacent pyramid-shaped projection. In other words, one pyramid-shaped projection is surrounded by other pyramid-shaped projections, and the base of the pyramid-shaped projection shares a side of a base with the base of the adjacent pyramid-shaped projection.

Thus, since the pyramid-shaped projections are arranged densely without a space, at equal intervals between the apexes thereof, a PDP and an FED of the present invention each have an excellent anti-reflection layer with which incident light from external can be efficiently scattered in many directions.

As for the anti-reflection layer according to the present invention, it is preferable that each of the intervals between the apexes of the plurality of pyramid-shaped projections be 350 nm or less and the height of each of the plurality of pyramid-shaped projections be 800 nm or more. Further, the fill rate (filling (occupying) percentage on the substrate surface to serve as a display screen) of bases of the plurality of pyramid-shaped projections per unit area on the substrate surface to serve as a display screen is preferably 80% or more, and more preferably 90% or more. The fill rate is a percentage of a formation region of a pyramid-shaped projection over the substrate surface to serve as a display screen. When the fill rate is 80% or more, the percentage of a plane portion where a pyramid-shaped projection is not formed on the substrate surface to serve as a display screen is 20% or less. In addition, it is preferable that the ratio of the height to the width of a base of a pyramid-shaped projection be 5 or more.

The present invention can provide a PDP and an FED each having an anti-reflection layer including a plurality of adjacent pyramid-shaped projections; accordingly, a high anti-reflection function can be provided.

As the PDP, a main body of a display panel having a discharge cell, and a display panel to which a flexible printed circuit (FPC) or a printed wiring board (PWB) having one or more of an IC, a resistor, a capacitor, an inductor, a transistor, and the like is attached, can be given. In addition, an optical filter having an electromagnetic field shielding function or a near-infrared ray shielding function may be included.

As the FED, a main body of a display panel having a light emitting cell, and a display panel to which a flexible printed circuit (FPC) or a printed wiring board (PWB) having one or more of an IC, a resistor, a capacitor, an inductor, a transistor, and the like is attached, can be given. In addition, an optical filter having an electromagnetic field shielding function or a near-infrared ray shielding function may be included.

The PDP and the FED of the present invention are each provided with an anti-reflection layer having a plurality of pyramid-shaped projections which are arranged without a space on a surface. Since a side of a pyramid-shaped projection is not planar (a surface parallel to a display screen), incident light from external is reflected to not a viewer side but another adjacent pyramid-shaped projection, or travels between the pyramid-shaped projections. In addition, the pyramid-shaped projection is a shape which enables dense arrangement without a space and is an optimum shape having the largest number of sides among such shapes and having a high anti-reflection function capable of scattering light in multi-directions efficiently. Part of incident light enters a pyramid-shaped projection, and then the other part of the light is incident on an adjacent pyramid-shaped projection as reflected light. In this manner, incident light from external reflected at an interface of a pyramid-shaped projection repeats incidence on adjacent pyramid-shaped projections.

In other words, the number of entries of light from external which is incident on the pyramid-shaped projections of the anti-reflection layer is increased; therefore, the amount of incident light from external entering the pyramid-shaped projections of the anti-reflection layer is increased. Thus, the amount of incident light from external reflected to a viewer side can be reduced, and the cause of a reduction in visibility such as reflection can be prevented.

Accordingly, a PUP and an FED each having higher image quality and higher performance can be manufactured.

BEST MODE FOR CARRYING OUT THE INVENTION

Figure 1A:
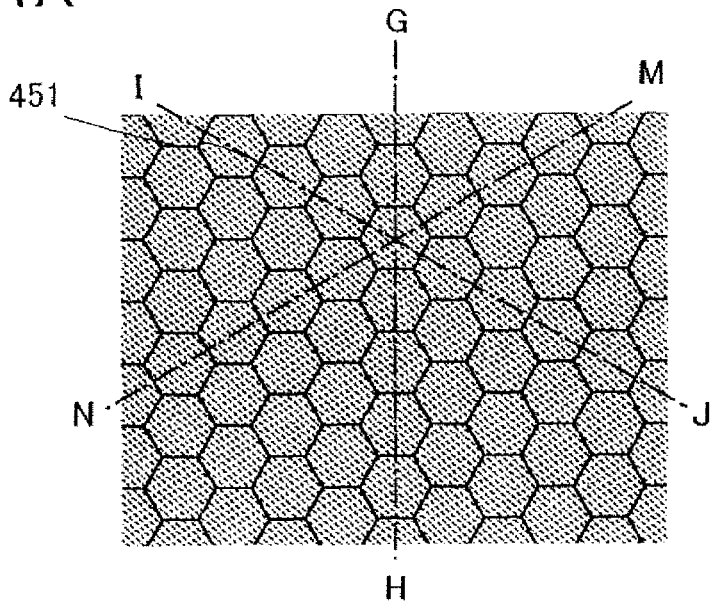
FIGS. 1A to 1D are conceptual diagrams according to the present invention.

Embodiment modes of the present invention will be hereinafter described with reference to the drawings. It is easily understood by those skilled in the art that various changes may be made in forms and details without departing from the spirit and the scope of the invention. Therefore, the present invention should not be interpreted as being limited to the descriptions of the embodiment modes below. In addition, the same reference numerals are commonly given to the same components or components having a similar function throughout all the drawings for explaining the embodiment modes, and repetitive explanation thereof is omitted.

Embodiment Mode 1

In Embodiment Mode 1, an anti-reflection layer provided for a PDP and an FED of the present invention will be described. Specifically, an example of an anti-reflection layer having an anti-reflection function capable of further reducing reflection of incident light from external on a surface of each of a PDP and an FED, and aimed at providing high visibility for the PDP and the FED will be described.

Figure 1B:
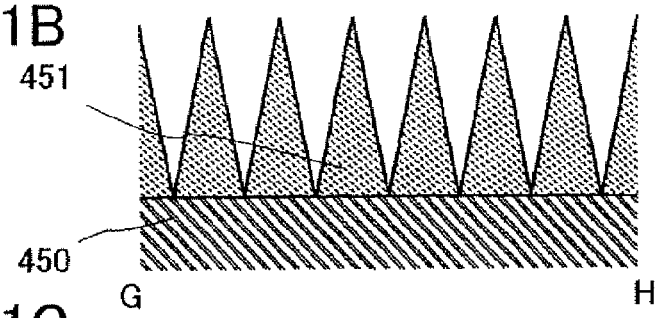
Figure 1C:
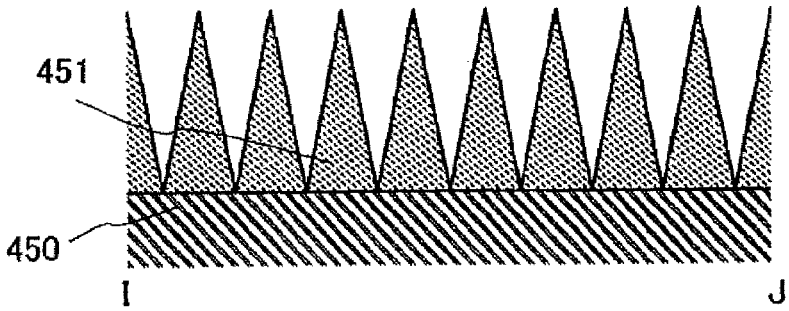
Figure 1D:
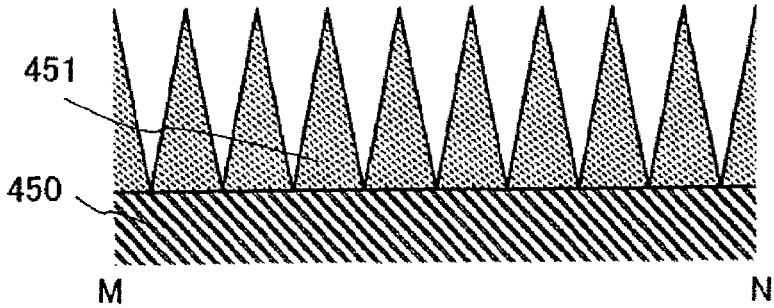

FIGS. 1A to 1D show a top view and cross-sectional views of an anti-reflection layer according to the present invention. In FIGS. 1A to 1D, a plurality of pyramid-shaped projections 451 are provided over a substrate 450 to serve as a display screen of a PDP or an FED. The anti-reflection layer according to the present invention includes the plurality of pyramid-shaped projections 451. FIG. 1A is a top view of a PDP or an FED of this embodiment mode. FIG. 1B is a cross-sectional view taken along line G-H in FIG. 1A, FIG. 1C is a cross-sectional view taken along line I-J in FIG. 1A, and FIG. 1D is a cross-sectional view taken along line M-N in FIG. 1A. As shown in FIGS. 1A to 1D, the pyramid-shaped projections 451 are provided adjacently so as to be arranged densely over a substrate surface to serve as a display screen. Here, the display screen means a surface on a viewer side of a substrate which is provided most closely to the viewer side, of a plurality of substrates which forms a display device.

When an anti-reflection layer has a plane portion (surface parallel to the display screen) to incident light from external, the incident light is reflected to the viewer side. Therefore, when the plane portion is small, an anti-reflection function is high. In addition, in order to scatter incident light from external further, a surface of the anti-reflection layer preferably includes surfaces with a plurality of angles.

The anti-reflection layer according to the present invention has a structure in which a plurality of pyramid-shaped projections are geometrically and densely arranged without a space; thus, the refractive index varies due to a physical shape that is a pyramid-shaped projection protruding toward the outside (toward a side of air) from a side of a display screen surface, so that reflection of light is prevented. In this embodiment mode, apexes of the plurality of pyramid-shaped projections are arranged at equal intervals and each side of a base which forms a pyramid shape of a pyramid-shaped projection is arranged to be in contact with a side of a base which forms a pyramid shape of an adjacent pyramid-shaped projection. That is, one pyramid-shaped projection is surrounded by other pyramid-shaped projections, and the base of the pyramid-shaped projection shares a side of a base with the base of the adjacent pyramid-shaped projection.

Thus, since the pyramid-shaped projections are arranged densely without a space, at equal intervals between the apexes thereof, a PDP and an FED of the present invention has an excellent anti-reflection function with which incident light from external can be efficiently scattered in many directions.

Since the plurality of pyramid-shaped projections 451 of this embodiment mode are arranged at equal intervals between the adjacent apexes thereof, the cross sections of FIGS. 1B to 1D have the same shape. The plurality of pyramid-shaped projections are arranged so as to be continuous and in contact, and all sides of the base of the pyramid-shaped projection are in contact with adjacent pyramid-shaped projections. Therefore, in this embodiment mode, the plurality of pyramid-shaped projections are arranged without a space therebetween and cover a substrate surface to serve as a display screen as shown in FIG. 1A. As shown in FIGS. 1B to 1D, a plane portion which is parallel to the display screen does not exist since the display screen is covered with the plurality of pyramid-shaped projections. Since light from external is incident on slope surfaces of the plurality of pyramid-shaped projections, reflection of incident light from external on the plane portion can be reduced. When a fill rate of bases of the plurality of pyramid-shaped projections per unit area on the substrate surface to serve as a display screen is equal to or more than 80%, preferably equal to or more than 90%, the percentage of incidence of light from external which is incident on the plane portion is reduced and thus reflection to a viewer side can be prevented.

Further, the plurality of pyramid-shaped projections preferably have as many sides with different angles to the bases thereof as possible because incident light are scattered in more directions. In this embodiment mode, a pyramid-shaped projection has six sides which are in contact with a base of the pyramid-shaped projection at six different angles. In addition, since a base of a pyramid-shaped projection shares a vertex with bases of other pyramid-shaped projections and the pyramid-shaped projection is surrounded by a plurality of sides, which are provided at a plurality of angles, of the pyramid-shaped projections, incident light is more easily reflected in many directions. Therefore, the more vertices the base of a pyramid-shaped projection has, the more easily an anti-reflection function thereof can be exerted, and thus the base of the pyramid-shaped projection in this embodiment mode has six vertices. The pyramid-shaped projection having a hexagonal base of this embodiment mode is a shape by which pyramid-shaped projections can be arranged densely without a space therebetween, and is an optimal shape having the largest number of sides among such shapes and having an excellent anti-reflection function with which incident light can be scattered efficiently in many directions.

Since the plurality of pyramid-shaped projections 451 of this embodiment mode are arranged so that apexes of the adjacent pyramid-shaped projections are spaced at equal intervals, cross sections of FIGS. 1B to 1D have the same shape.

Figure 3A:
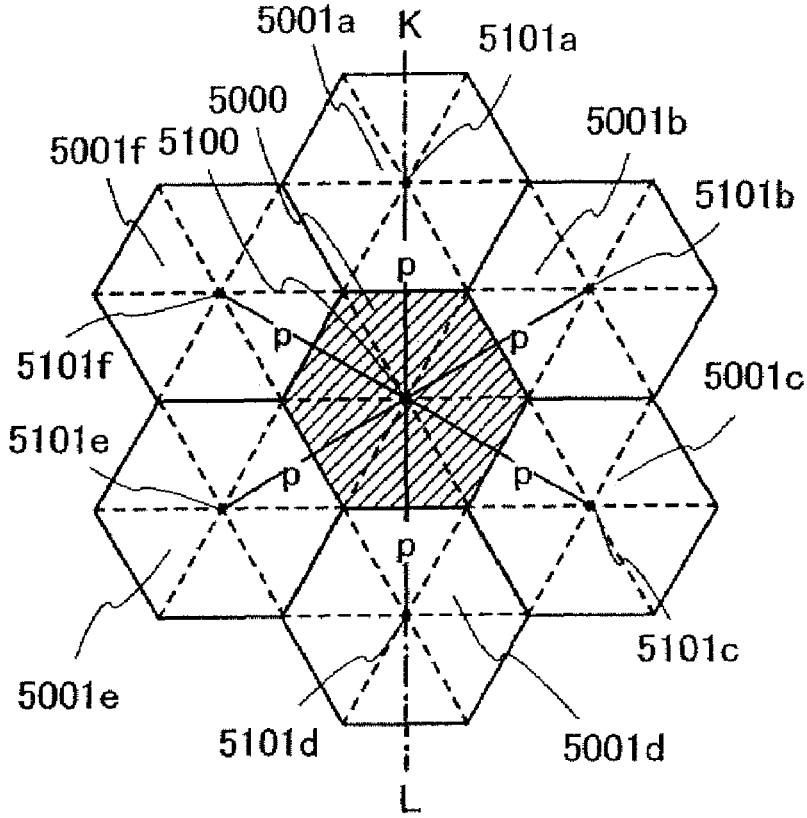
FIGS. 3A and 3B are conceptual diagrams according to the present invention.
Figure 3B:
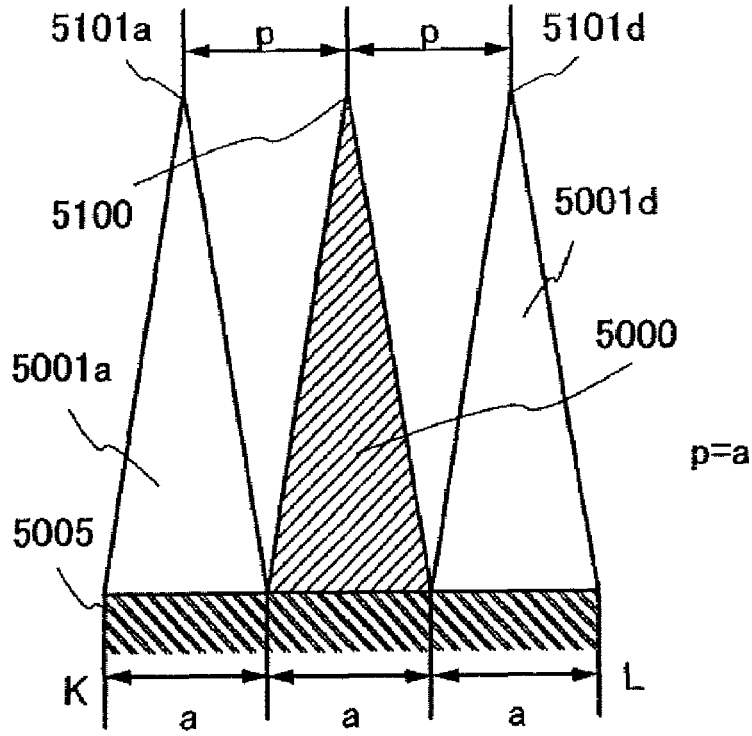

FIG. 3A shows a top view of an example of the pyramid-shaped projections of the present invention, which are adjacently and densely arranged, and FIG. 3B shows a cross section taken along line K-L in FIG. 3A. A pyramid-shaped projection 5000 is in contact with peripheral pyramid-shaped projections 5001*a* to 5001*f* by sides of the base (sides of the base for a pyramid shape) of the pyramid-shaped projection 5000. Further, the pyramid-shaped projection 5000 and the pyramid-shaped projections 5001*a* to 5001*f* arranged densely so as to surround the pyramid-shaped projection 5000 have regular hexagonal bases and apexes 5100 and 5101*a* to 5101*f*, respectively over the center of the regular hexagonal bases. Therefore, the apex 5100 of the pyramid-shaped projection 5000 is arranged at equal intervals p from the apexes 5101*a* to 5101*f* of the adjacent pyramid-shaped projections 5001*a* to 5001*f*. In this case, the interval p between the apexes of the pyramid-shaped projections is equal to a width a of one pyramid-shaped projection as shown in FIG. 3B.

Figure 5A:
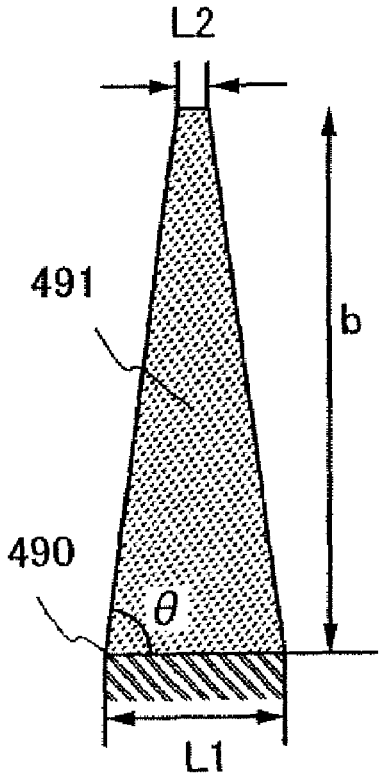
FIGS. 5A to 5C are cross-sectional views of pyramid-shaped projections applicable to the present invention.
Figure 8A:
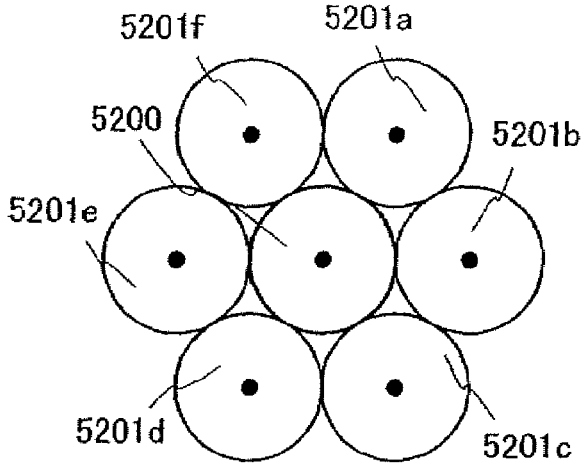
FIGS. 8A to 8C show experimental models of comparative examples.
Figure 8B:
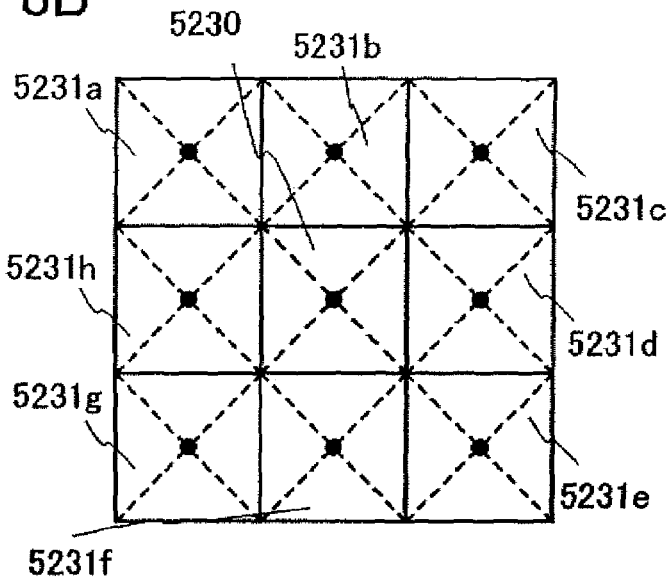
Figure 8C:
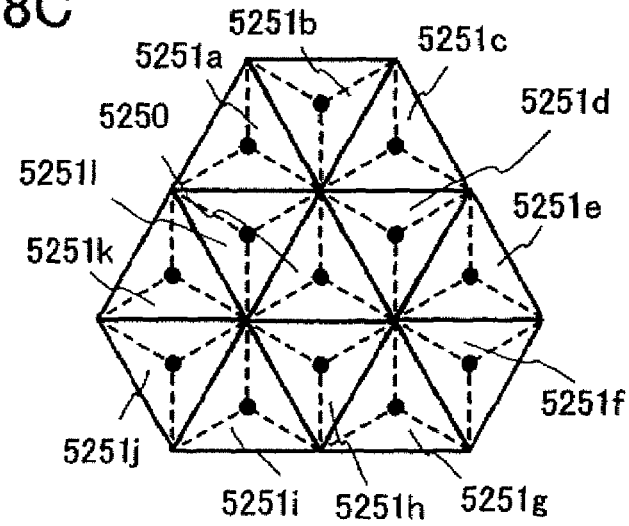

FIGS. 8A to 8C show comparative examples in the case where the present invention is not applied. FIG. 8A shows a structure where cone-shaped projections each having a circular base are arranged densely (referred to as Comparative Example 1), FIG. 8B shows a structure where pyramid-shaped projections each having a square base and four sides are arranged densely (referred to as Comparative Example 2), and FIG. 8C shows a structure where pyramid-shaped projections each having a regular triangle base and three sides (referred to as Comparative Example 3) are arranged densely. FIGS. 5A to 8C are top views of the projections seen from above. As shown in FIG. 5A, cone-shaped projections 5201*a* to 5201*f* are densely arranged around a center cone-shaped projection 5200. However, since bases of the cone-shaped projection 5200 and the cone-shaped projections 5201*a* to 5201*f* are circular, spaces are generated between the cone-shaped projection 5200 and the cone-shaped projections 5201*a* to 5201*f* even when the cone-shaped projections are densely arranged; accordingly, a plane portion of a substrate surface to serve as a display screen is exposed. Since incident light from external is reflected on the plane to a viewer side, with the anti-reflection layer including the adjacent cone-shaped projections of Comparative Example 1, an anti-reflection function is reduced.

In FIG. 8B, pyramid-shaped projections 5231*a* to 5231*h* each having a square base and four sides are densely arranged in contact with a square base of a central pyramid-shaped projection 5230 having the square base and four sides. Similarly, in FIG. 8C, pyramid-shaped projections 5251*a* to 5251*l* each having a regular triangle base and three sides are densely arranged in contact with a regular triangle base of a central pyramid-shaped projection 5250 having the regular triangle base and three sides. Although the pyramid-shaped projections each having a hexagonal base and six sides of this embodiment mode can be arranged at equal intervals between the adjacent apexes of adjacent pyramid-shaped projections, pyramid-shaped projections in Comparative Examples 2 and 3 cannot be arranged densely so that apexes thereof shown by dots in FIGS. 8B and 8C are provided at equal intervals. Since the pyramid-shaped projections in Comparative Examples 2 and 3 have a smaller number of sides than the pyramid-shaped projection of this embodiment mode, it is harder that incident light is scattered in many directions by Comparative Examples 2 and 3.

Figure 25:
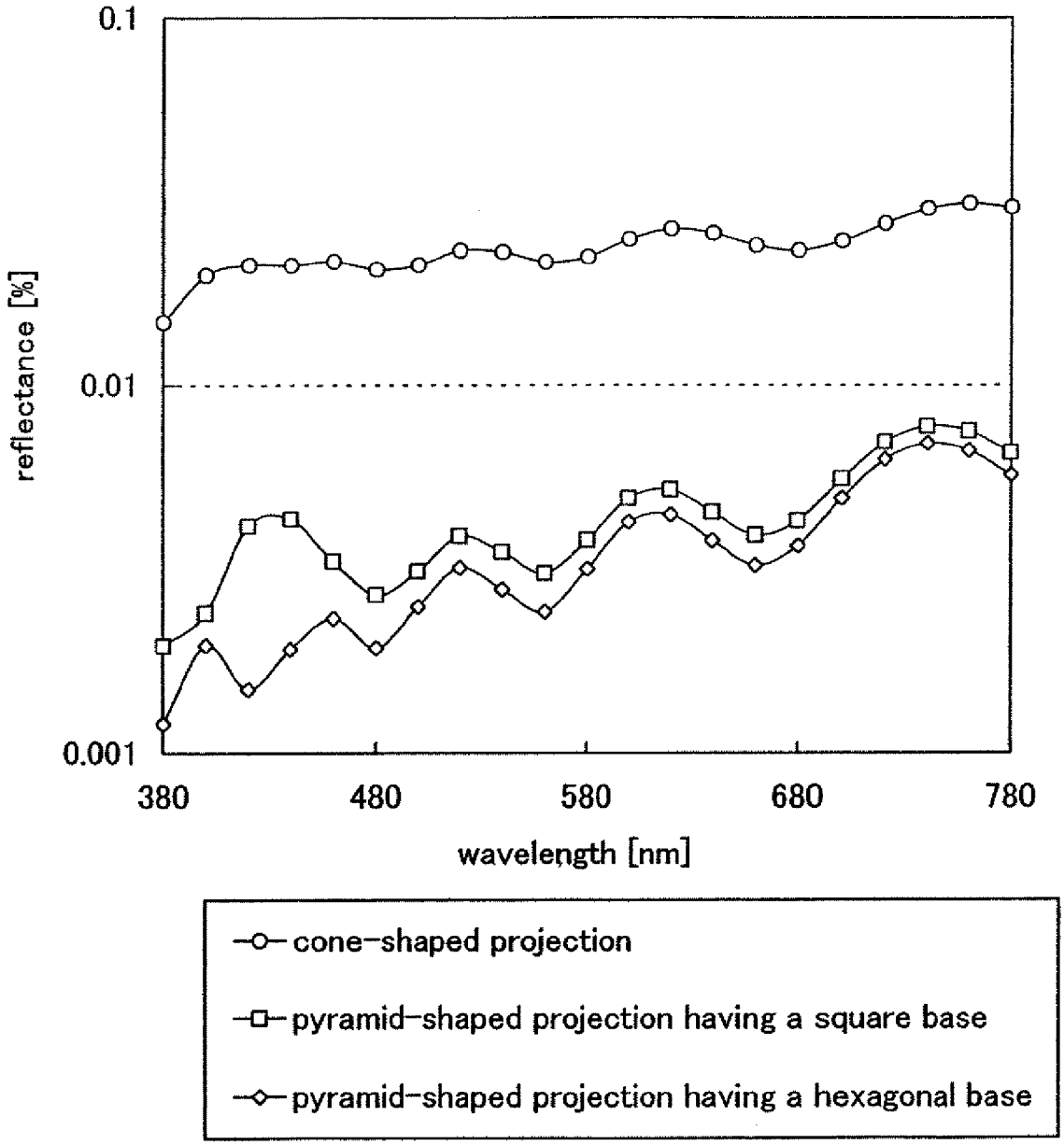
FIG. 25 is a graph showing experimental data according to Embodiment Mode 1.

Optical calculation results of Comparative Example 1, Comparative Example 2, and the pyramid-shaped projection having a hexagonal base and six sides (also referred to as Structure A) of this embodiment mode are shown below. An optical calculation simulator for an optical device, Diffract MOD (manufactured by Rsoft Design Group Inc.) is used in the calculation of this embodiment mode. Each reflectance is calculated by 3D optical calculation. FIG. 25 shows a relation between the wavelength of light and the reflectance in each of Comparative Example 1, Comparative Example 2, and Structure A. Regarding the calculation conditions, Harmonics, which are parameters of the above-described calculation simulator, are set at 3 in both X and Y directions. In the cases of the cone-shaped projection and the pyramid-shaped projection having a hexagonal base, assuming that the interval between apexes of the cone-shaped or pyramid-shaped projections is p and the height of the cone-shaped or pyramid-shaped projection is b, Index Res., which are parameters of the above-described calculation simulator, are set at values which are calculated by $\sqrt{3}\times p/128$ in X direction, p/128 in Y direction, and b/80 in Z direction. In the case of the pyramid-shaped projection having a square base as shown in FIG. 8B, assuming that the interval between apexes of the pyramid-shaped projections is q, Index Res., which are parameters of the above-described calculation simulator, are set at values which are calculated by q/64 in X direction and Y direction, and b/80 in Z direction.

In FIG. 25, Comparative Example 1 has circular data markers, Comparative Example 2 has quadrangular data markers, and Structure A has rhombic data markers, and FIG. 25 shows the relation between the wavelength and the reflectance in each example. From the optical calculation results as well, it can be confirmed that the model in which the pyramid-shaped projections (Structure A), to which the present invention is applied, are arranged densely has lower reflectance than the model in which Comparative Example 1 are densely arranged and the model in which Comparative Example 2 are densely arranged, in the measurement wavelength range of 380 nm to 780 nm and can reduce the reflectance most largely. The refractive indexes, the heights, and the widths of Comparative Example 1, Comparative Example 2, and Structure A are all 1.492, 1500 nm, and 300 nm, respectively.

When the fill rate of bases of a plurality of pyramid-shaped projections per unit area on a surface of a display screen (that is, a substrate surface to serve as a display screen) is 80% or more, and preferably 90% or more, the percentage of light from external which is incident on a plane portion is reduced. Accordingly, incident light from external can be prevented from being reflected to a viewer side, which is preferable. The fill rate is a percentage of a formation region of the pyramid-shaped projection over the substrate surface to serve as a display screen. When the fill rate is 80% or more, the percentage of the plane portion where the pyramid-shaped projection is not formed on the substrate surface to serve as a display screen is 20% or less.

Figure 26:
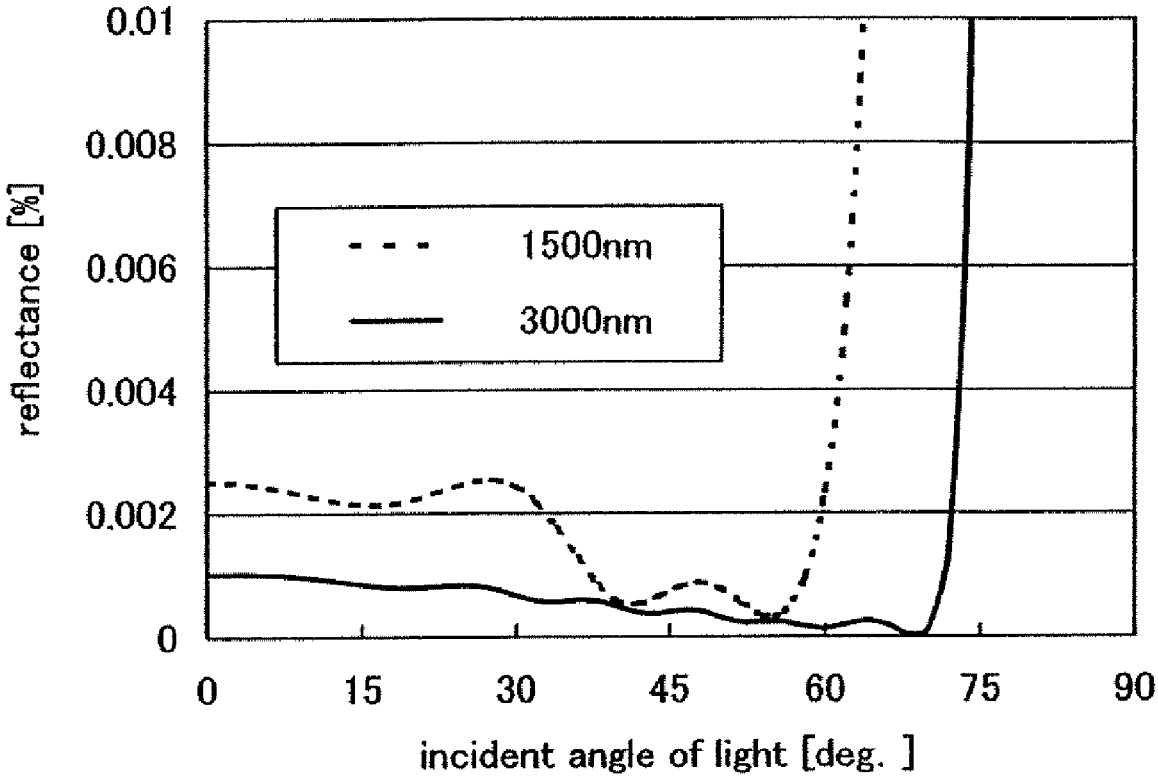
FIG. 26 is a graph showing experimental data according to Embodiment Mode 1.

Further, FIG. 26 shows optical calculation results of a relation between the incident angle of light and the reflectance of the models in which the pyramid-shaped projections each having a hexagonal base and six sides according to this embodiment mode are arranged densely. A dotted line shows the relation between the incident angle and the reflectance of a model including pyramid-shaped projections each having a width of 300 nm and a height of 1500 nm, and a solid line shows that of a model including pyramid-shaped projections each having a width of 300 nm and a height of 3000 nm. When the incident angle is 60 degrees or less, the reflectances of the models are suppressed to be as low as 0.003% or less. Even when the incident angle is approximately 75 degrees, the reflectances of the models are about 0.01%. This confirms that the models according to the present invention in which the pyramid-shaped projections are densely arranged can have reduced reflectances in a wide range of incident angle.

Figure 27A:
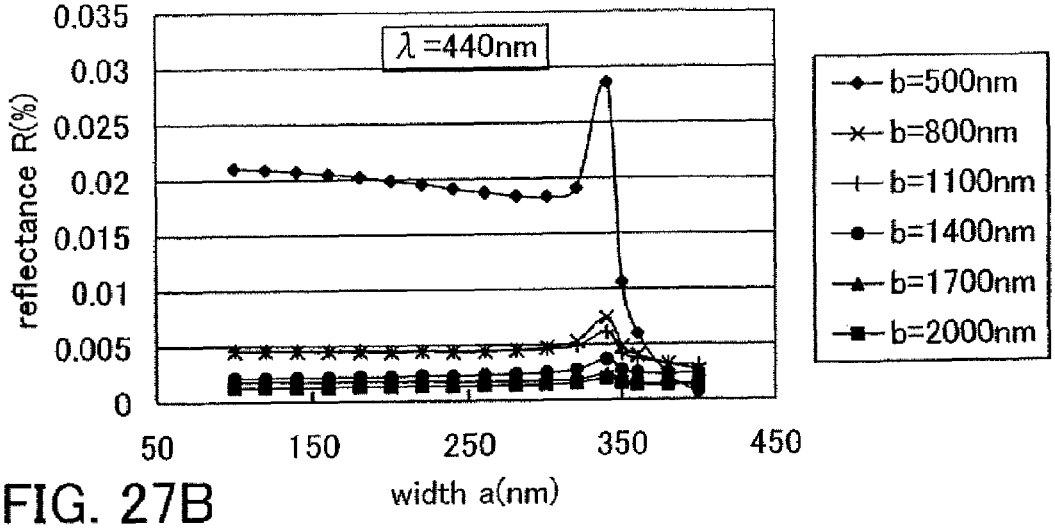
FIGS. 27A to 27C are graphs showing experimental data according to Embodiment Mode 1.
Figure 27B:
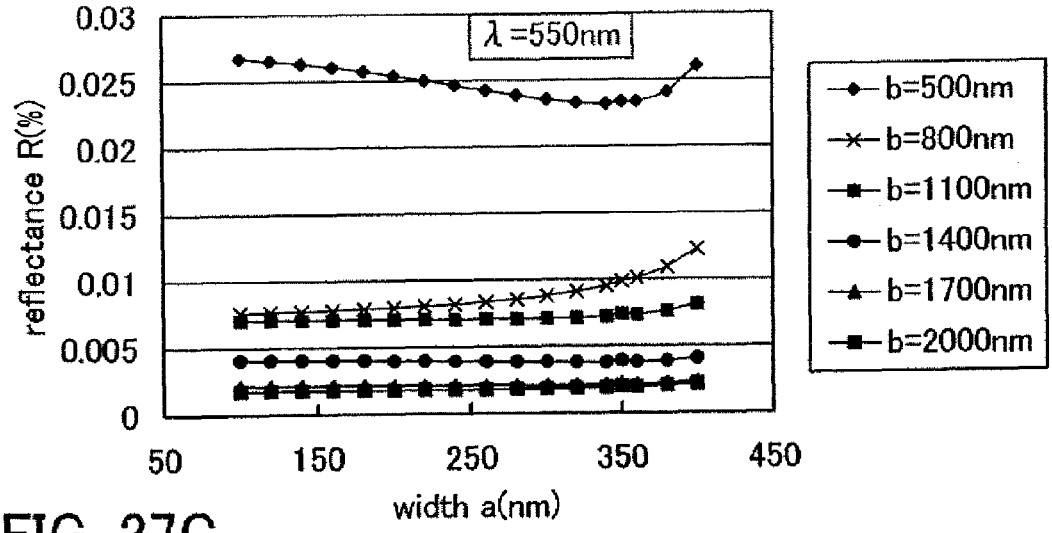
Figure 27C:
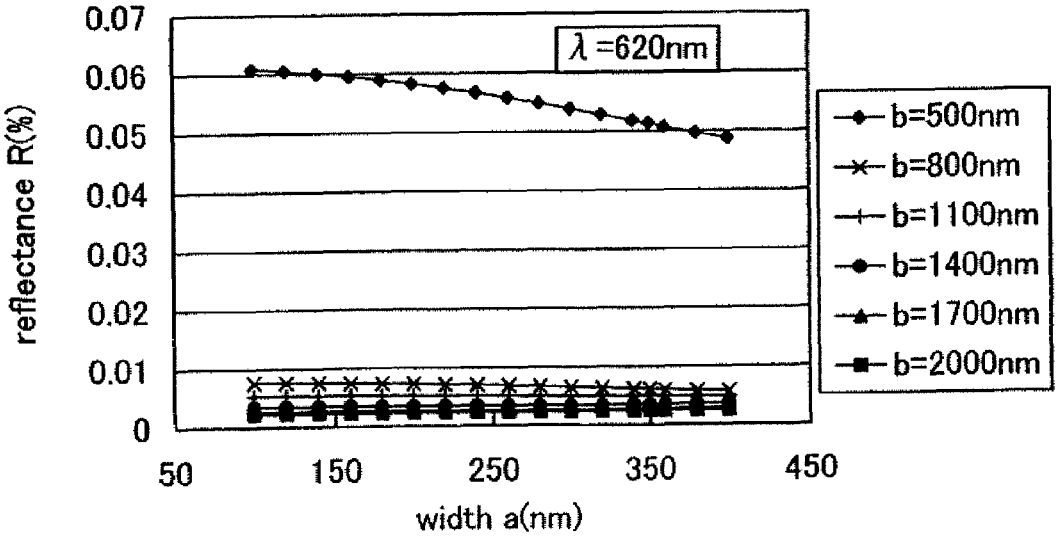

Similarly, the change of the reflectances of the models, in which the pyramid-shaped projections each having a hexagonal base and six sides according to this embodiment mode are arranged densely, in each wavelength is calculated in which the width a and the height b of the pyramid-shaped projection is changed. FIGS. 27A to 27C show the change of the reflectance R with respect to the width a when the height b is changed to 500 nm (rhombic data markers), 800 nm (x data markers), 1100 nm (cross data markers), 1400 nm (circular data markers), 1700 nm (triangular data markers), and 2000 nm (quadrangular data markers).

Figure 29A:
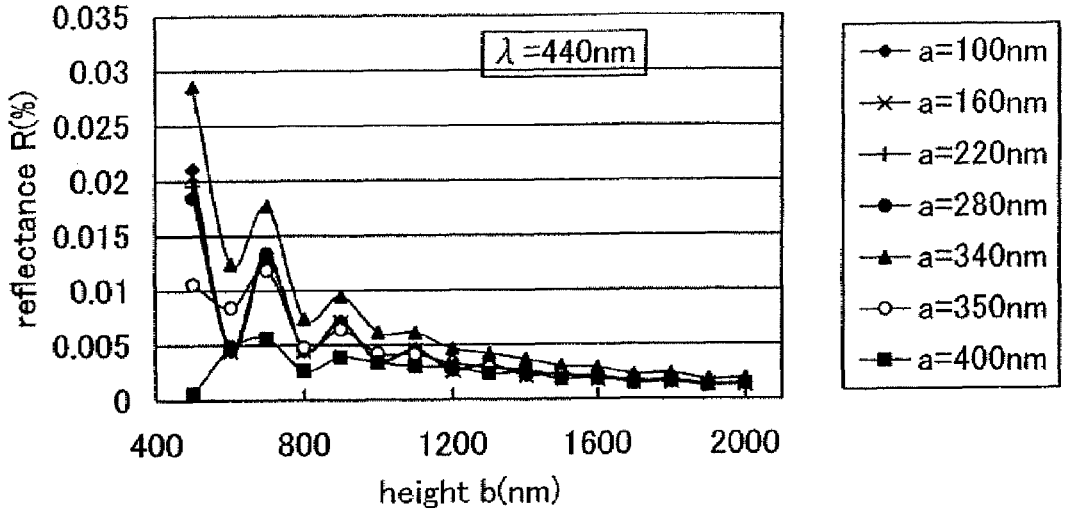
FIGS. 29A to 29C are graphs showing experimental data according to Embodiment Mode 1.
Figure 29B:
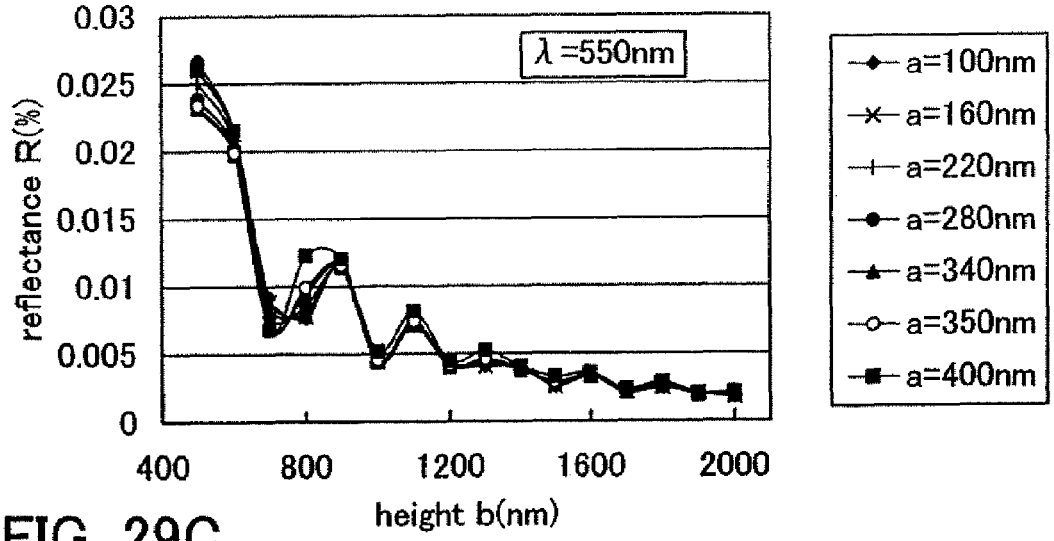
Figure 29C:
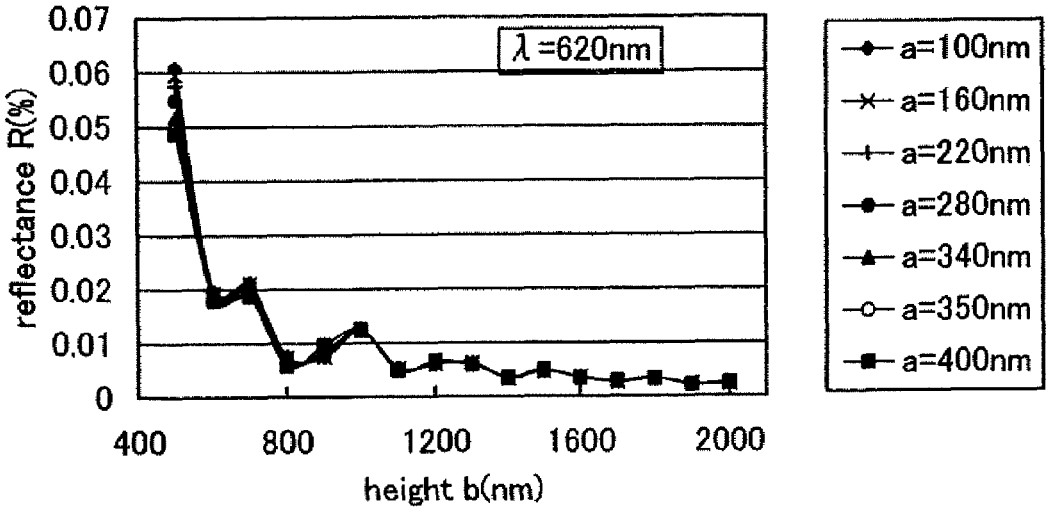

Further, FIGS. 29A to 29C show the change of the reflectance R with respect to the height b when the width a is changed to 100 nm (rhombic data markers), 160 nm (x data markers), 220 nm (cross data markers), 280 nm (black circular data markers), 340 nm (triangular data markers), 350 nm (white circular data markers), and 400 nm (quadrangular data markers). The calculations are performed in each of the cases where the wavelength of light are in a visible light range and are 440 nm exhibiting blue color (FIGS. 27A and 29A), 550 nm exhibiting green color (FIGS. 27B and 29B), and 620 nm exhibiting red color (FIGS. 27C and 29C), and the results are shown.

As shown in FIGS. 27A to 27C, when the height b is 800 nm or more and the width a is 350 nm or less (more preferably, a width a of 300 nm or less as shown in FIG. 27A), the reflectance is 0.01% or less in every wavelength. As shown in FIGS. 29A to 29C, when the height b is 800 nm or more, the reflectance is suppressed to be as low as 0.015% or less. In addition, when the height b is 1600 nm or more, the reflectance is suppressed to be as low as 0.005% or less at every width a in the measurement range.

Figure 28A:
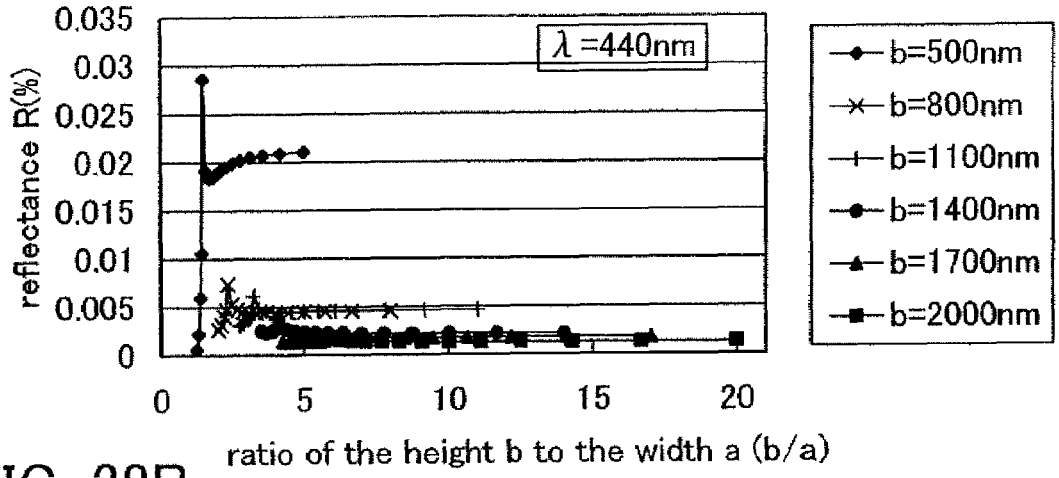
FIGS. 28A to 28C are graphs showing experimental data according to Embodiment Mode 1.
Figure 28B:
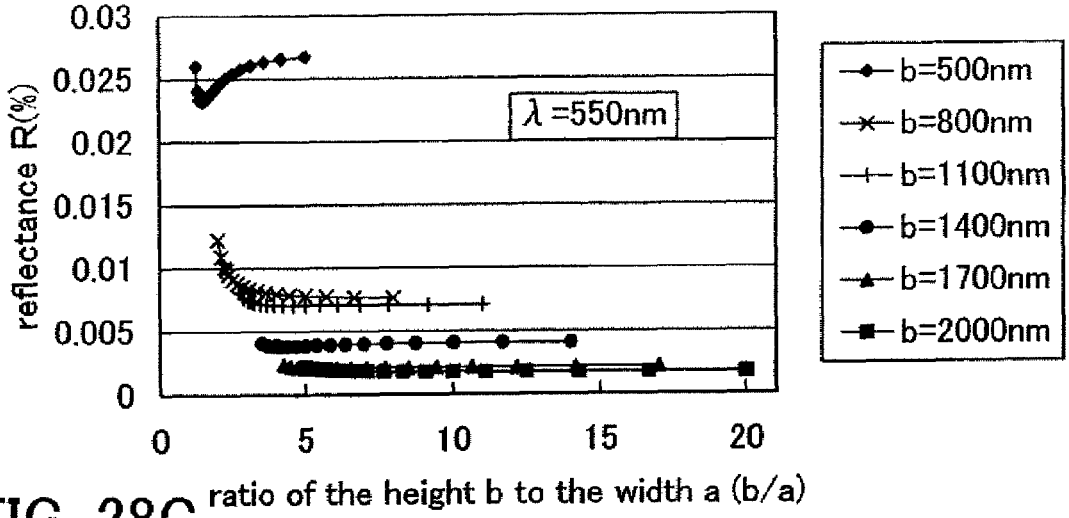
Figure 28C:
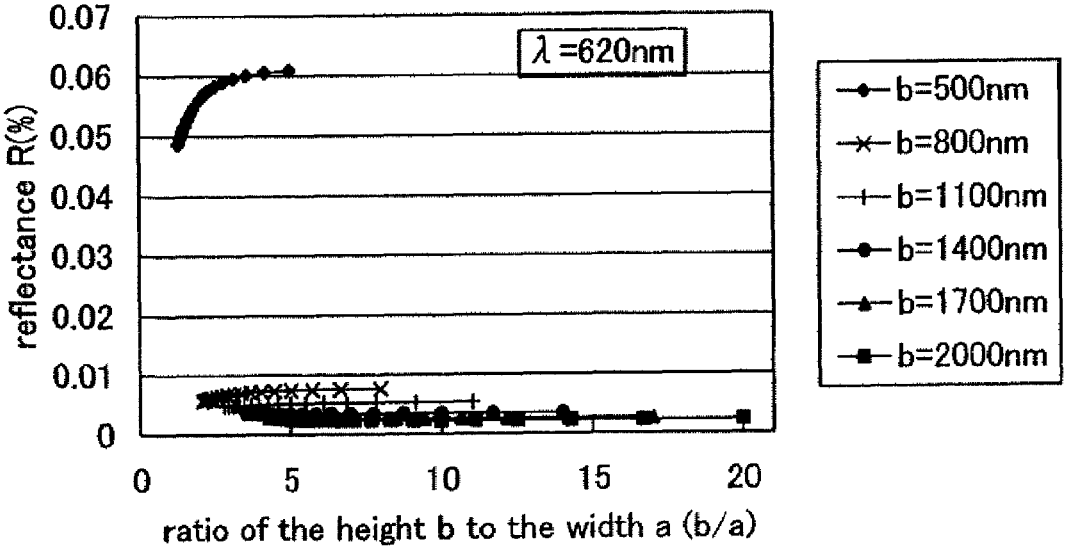
Figure 30A:
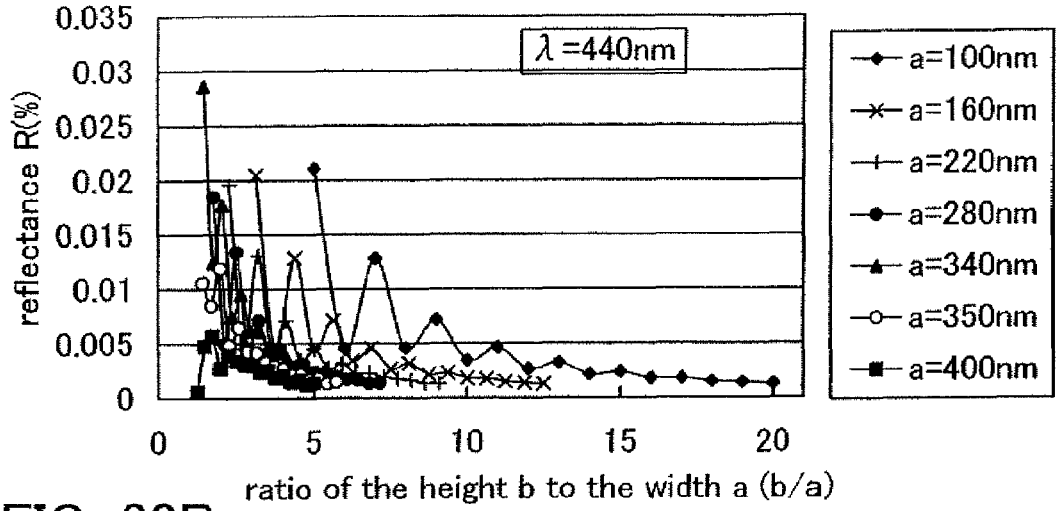
FIGS. 30A to 30C are graphs showing experimental data according to Embodiment Mode 1.
Figure 30B:
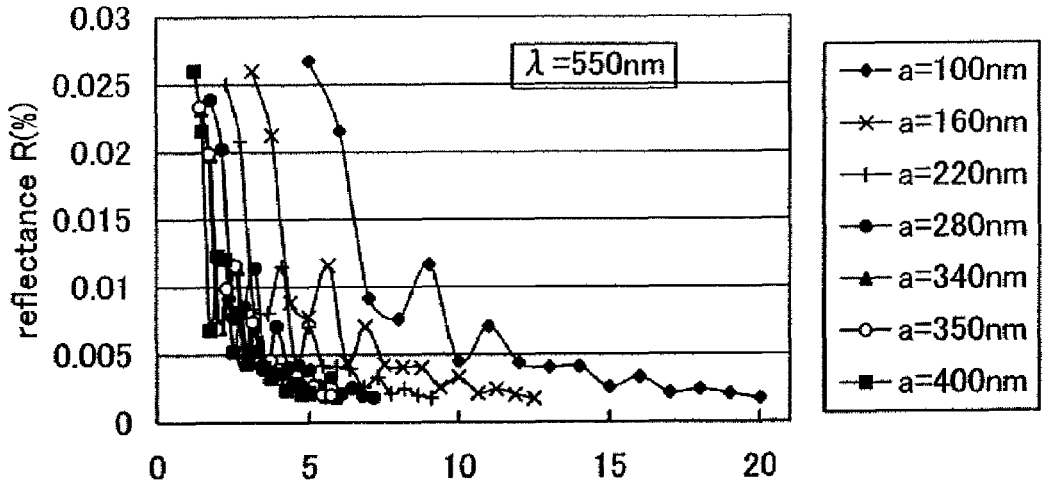
Figure 30C:
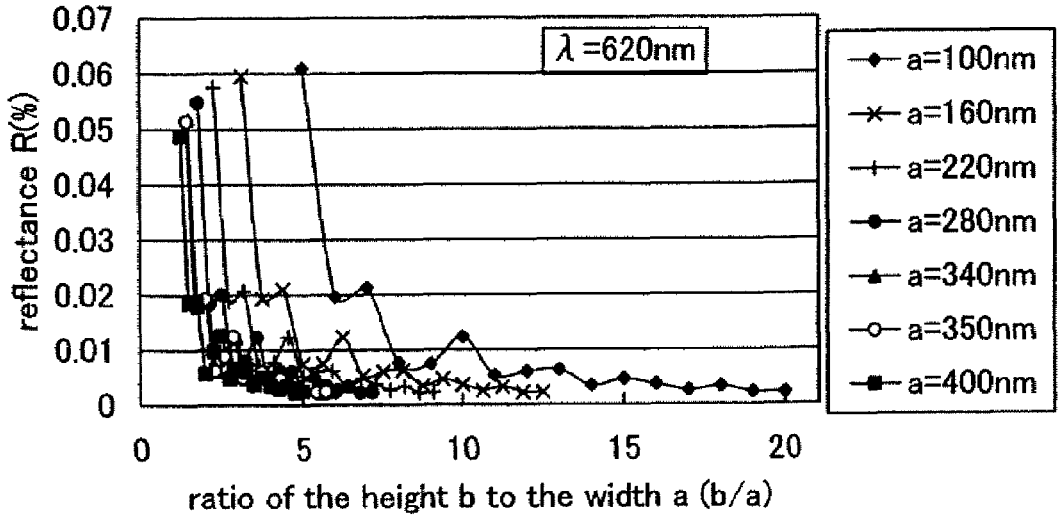

FIGS. 28A to 28C show the change of the reflectance R with respect to the ratio of the height b to the width a (b/a) when the height b is changed to 500 nm (rhombic data markers), 800 nm (x data markers), 1100 nm (cross data markers), 1400 nm (circular data markers), 1700 nm (triangular data markers), and 2000 nm (quadrangular data markers). FIGS. 30A to 30C show the change of the reflectance R with respect to the ratio of the height b to the width a (b/a) when the width a is changed to 100 nm (rhombic data markers), 160 nm (x data markers), 220 nm (cross data markers), 280 nm (black circular data markers), 340 nm (triangular data markers), 350 nm (white circular data markers), and 400 nm (quadrangular data markers). The calculations are performed in each of the cases where the wavelengths of light are 440 nm exhibiting blue color (FIGS. 28A and 30A), 550 nm exhibiting green color (FIGS. 28B and 30B), and 620 nm exhibiting red color (FIGS. 28C and 30C) in the visible light range, and the results are shown.

Figure 6:
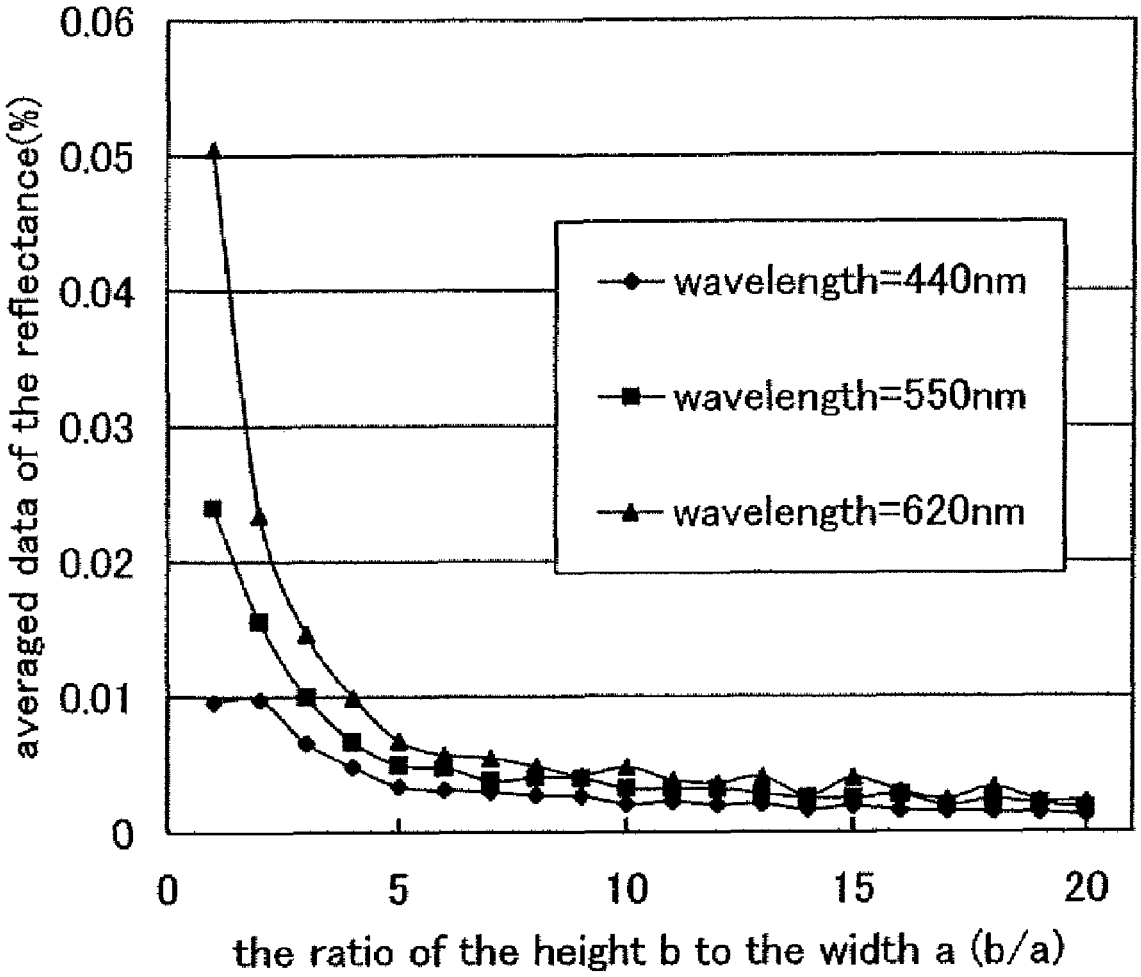
FIG. 6 is a graph showing experimental data according to Embodiment Mode 1.
Figure 7A:
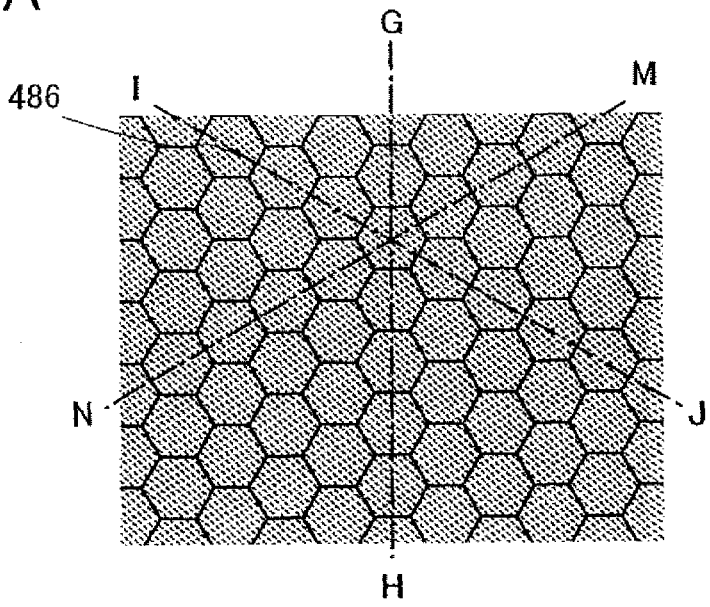
FIGS. 7A to 7D are conceptual diagrams according to the present invention.
Figure 7B:
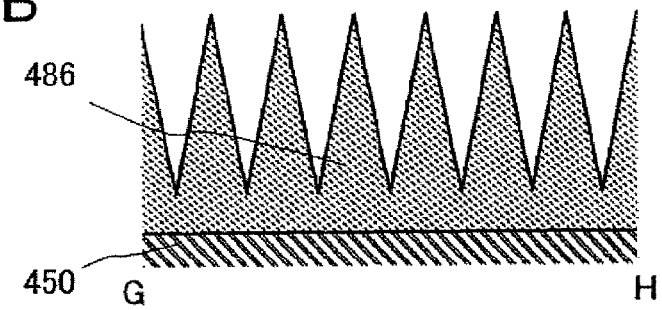
Figure 7C:
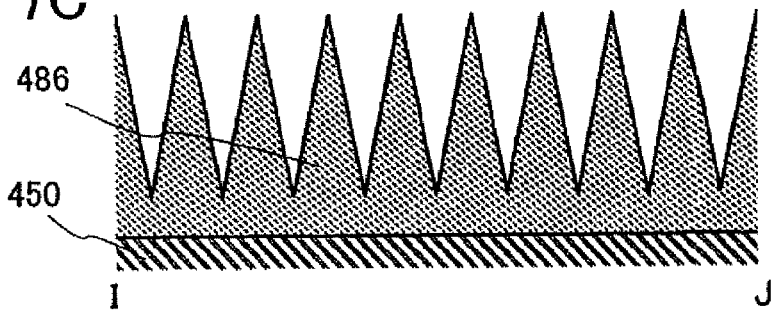
Figure 7D:
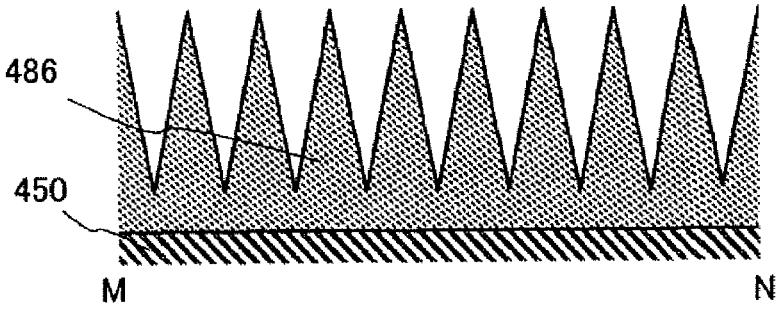

FIG. 6 shows averaged data of the reflectance R, including data shown in FIGS. 30A to 30C, with respect to the ratio of the height b to the width a (b/a) when the width a is changed from 100 nm to 400 nm. FIG. 6 shows a relation between the ratio of the height b to the width a (b/a) and the averaged reflectance in the cases where the wavelengths are 440 nm (rhombic data markers), 550 nm (quadrangular data markers), and 620 nm (triangular data markers). As shown in FIGS. 30A to 30C, with a height b of 800 nm or more (that is, b/a of 2 or more), as the ratio of the height b to the width a (b/a) is increased, the reflectance is decreased. As shown in FIG. 6, when the ratio of the height b to the width a (b/a) is 5 or more, the averaged reflectance is 0.01% or less at every measured wavelength, and this confirms that the pyramid-shaped projection according to this embodiment mode has an effect of suppressing reflection of light.

Since the interval between apexes of the plurality of pyramid-shaped projections is the same as the width of each of the plurality of pyramid-shaped projections, in consideration of the above, it is preferable that each interval between apexes of the plurality of pyramid-shaped projections be 350 nm or less (more preferably, equal to or more than 100 nm and equal to or less than 300 nm) and the heights of the plurality of pyramid-shaped projections be 800 nm or more (more preferably equal to or more than 1000 nm, and still more preferably equal to or more than 1600 nm and equal to or less than 2000 nm). In addition, in the pyramid-shaped projection, the ratio of the height to the width of the base is preferably 5 or more.

Figure 2A:
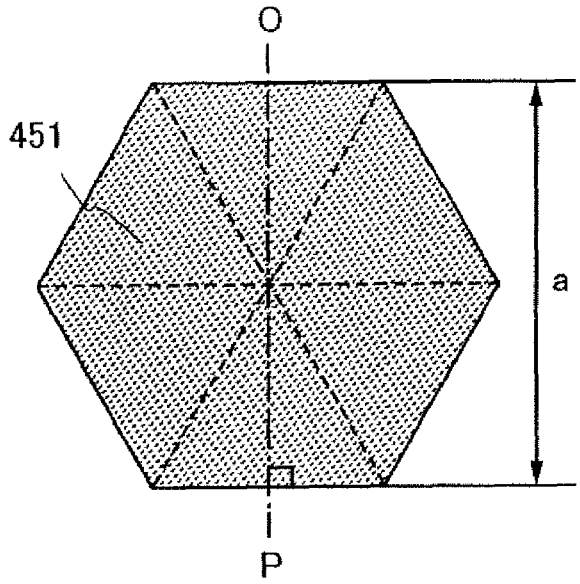
FIGS. 2A and 2B are conceptual diagrams according to the present invention.
Figure 2B:
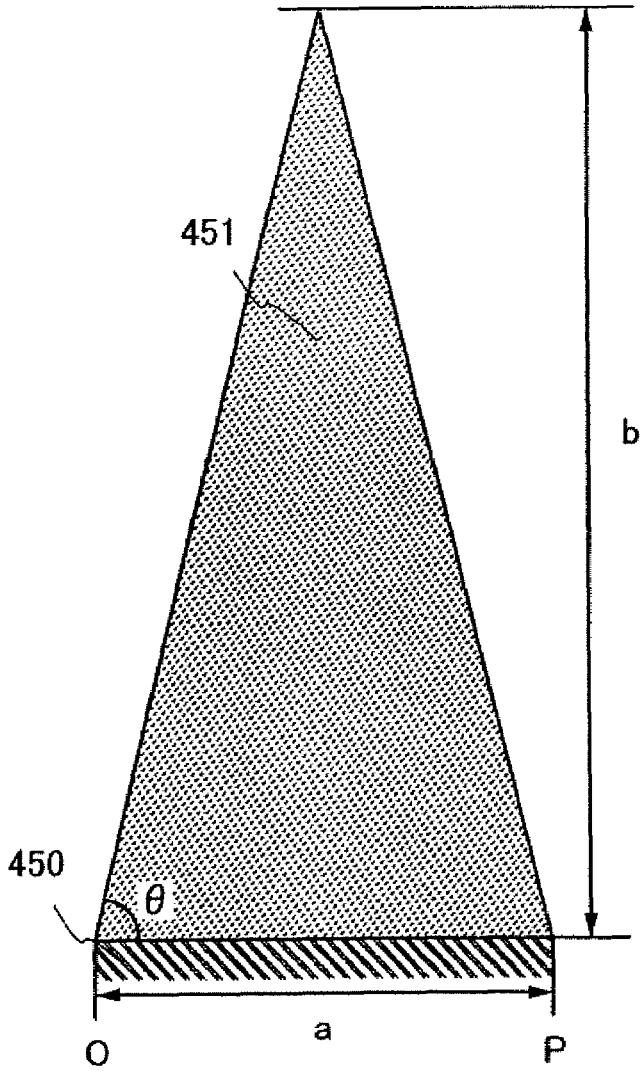

FIGS. 2A and 2B are enlarged views of the pyramid-shaped projection having an anti-reflection function shown in FIGS. 1A to 1D. FIG. 2A is a top view of the pyramid-shaped projection and FIG. 2B is a cross-sectional view taken along line O-P of FIG. 2A. The line O-P passes through the center of a base of the pyramid-shaped projection and is perpendicular to a side of the base. In the cross section of the pyramid-shaped projection as shown in FIG. 2B, a side and the base of the pyramid-shaped projection form an angle θ. In this specification, a length of the line which passes through the center of the base of the pyramid-shaped projection and is perpendicular to the side of the base is referred to as a width a of the base of the pyramid-shaped projection. In addition, a length from the base of the pyramid-shaped projection to an apex thereof is referred to as a height b of the pyramid-shaped projection.

Figure 5B:
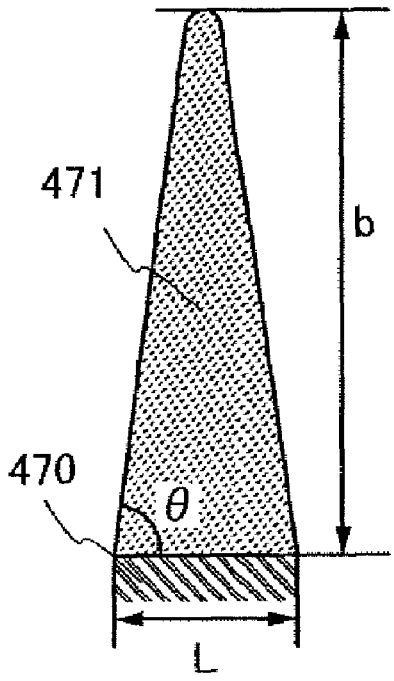
Figure 5C:
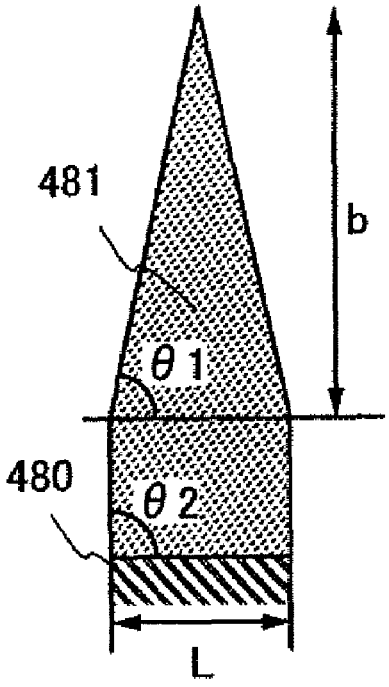

FIGS. 5A to 5C show examples of shapes of pyramid-shaped projections. FIG. 5A shows a shape whose end is not sharp unlike the shape of the pyramid-shaped projection, and which has a top surface and a base. Accordingly, a cross-sectional view of a face which is perpendicular to the base is trapezoidal. In a pyramid-shaped projection 491 provided on a substrate 490 to serve as a display screen as shown in FIG. 5A, a distance between a lower base and an upper base is referred to as a height b in the present invention.

FIG. 5B shows an example in which a pyramid-shaped projection 471 whose end is rounded is provided on a substrate 470 to serve as a display screen. In this manner, the pyramid-shaped projection may have such a shape with a rounded end and a curvature. In this case, the height b of the pyramid-shaped projection corresponds to a distance between a base and the highest point of an apical portion.

FIG. 5C shows an example where a pyramid-shaped projection 481 which has a side forming a plurality of angles $\theta_1$ and $\theta_2$ with the base of the pyramid-shaped projection in the cross section is provided on a substrate 480 to serve as a display screen. In this manner, the pyramid-shaped projection may have a shape of a stack of a hexagonal cylinder shape (the side having the angle $\theta_2$) and a pyramid-shaped projection shape (the side having the angle $\theta_1$). In this case, angles $\theta_1$ and $\theta_2$ made by the side and the base are different from each other, and the relation, $0° < \theta_1 < \theta_2$, is made. In the case of the pyramid-shaped projection 481 as shown in FIG. 5C, the height b corresponds to the height of the pyramid shape with an oblique side of the pyramid-shaped projection.

Although FIGS. 1A to 1D show the structure in which the plurality of pyramid-shaped projections are in contact with the substrate by the bases and densely arranged, a structure may also be employed in which a plurality of pyramid-shaped projections are provided in a surface part of an upper portion of a film (substrate). FIGS. 7A to 7D show an example in which, in FIGS. 1A to 1D, sides of pyramid-shaped projections do not reach a display screen and a shape of a film 486 whose surface has a plurality of pyramid-shaped projections (in other words, single continuous film) is formed. The anti-reflection layer of the present invention is acceptable as long as it has a structure having pyramid-shaped projections which are adjacently and densely arranged. A structure may also be employed in which pyramid-shaped projections having a single continuous structure are formed directly in a surface part of a film (substrate). For example, a surface of a film (substrate) may be processed to form pyramid-shaped projections, or a shape with pyramid-shaped projections may be selectively formed by a printing method such as nanoimprinting. Alternatively, pyramid-shaped projections may be formed on a film (substrate) in another process. Further alternatively, a pyramid-shaped projection having a hexagonal base may be attached to the surface of a film (substrate) using an adhesive. In this manner, the anti-reflection layer according to the present invention can be formed by applying various shapes having a plurality of pyramid-shaped projections each having a hexagonal base.

A glass substrate, a quartz substrate, or the like can be used as a substrate on which the pyramid-shaped projections are provided (that is, a substrate to serve as a display screen). Alternatively, a flexible substrate may be used. The flexible substrate refers to a substrate which can be bent or curved. For example, in addition to a plastic substrate made of polyethylene terephthalate, polyether sulphone, polystyrene, polyethylene naphthalate, polycarbonate, polyimide, polyarylate, or the like, elastomer which is a high molecular material having a property of being plasticized at a high temperature so that it can be shaped similarly to plastic and having a property of being elastic like a rubber at a room temperature, can be given. Alternatively, a film (made of polypropylene polyester, vinyl, polyvinyl fluoride, vinyl chloride, or polyamide; a film with an inorganic thin layer formed by evaporation; or the like) can be used.

In addition, the pyramid-shaped projection can be formed of not a material with a uniform refractive index but a material whose refractive index changes from an apical portion of the pyramid-shaped projection to a side of a substrate to serve as a display screen. For example, in each of the plurality of pyramid-shaped projections, a portion closer to the apical portion of the pyramid-shaped projection can be formed of a material having a refractive index equivalent to that of the air, so that reflection of light from external which is incident on the pyramid-shaped projection from the air, at the surface of the pyramid-shaped projection can be further reduced. On the other hand, in each of the plurality of pyramid-shaped projections, a portion closer to the substrate to serve as a display screen can be formed of a material having a refractive index more equivalent to that of the substrate, so that reflection, at an interface between the pyramid-shaped projection and the substrate, of light which travels through the pyramid-shaped projection and is incident on the substrate can be further reduced. When a glass substrate is used as the substrate, since the refractive index of the air is lower than that of a glass substrate, the pyramid-shaped projection may have such a structure in which a portion closer to an apical portion of the pyramid-shaped projection is formed of a material having a lower refractive index, and a portion closer to a base of the pyramid-shaped projection is formed of a material having a higher refractive index. In other words, the pyramid-shaped projection may have such a structure in which the refractive index increases from the apical portion to the base of the pyramid-shaped projection.

A material used for forming the pyramid-shaped projection may be appropriately selected in accordance with a material of the substrate forming a display screen surface, such as silicon, nitrogen, fluorine, oxide, nitride, or fluoride. As the oxide, the following can be used: silicon oxide, boric acid, sodium oxide, magnesium oxide, aluminum oxide (alumina), potassium oxide, calcium oxide, diarsenic trioxide (arsenious oxide), strontium oxide, antimony oxide, barium oxide, indium tin oxide (ITO), zinc oxide, indium zinc oxide (IZO) in which indium oxide is mixed with zinc oxide, a conductive material in which indium oxide is mixed with silicon oxide, organic indium, organic tin, indium oxide containing tungsten oxide, indium zinc oxide containing tungsten oxide, indium oxide containing titanium oxide, indium tin oxide containing titanium oxide, or the like. As the nitride, aluminum nitride, silicon nitride, or the like can be used. As the fluoride, lithium fluoride, sodium fluoride, magnesium fluoride, calcium fluoride, lanthanum fluoride, or the like can be used. One or more kinds of the above-described silicon, nitrogen, fluorine, oxide, nitride, and fluoride may be included. A mixing ratio thereof may be appropriately set in accordance with a ratio of components (a composition ratio) of the substrate.

The pyramid-shaped projection can be formed in such a manner that a thin film is formed by a sputtering method, a vacuum evaporation method, a PVD (physical vapor deposition) method, or a CVD (chemical vapor deposition) method such as a low-pressure CVD (LPCVD) method or a plasma CVD method, and then etched into a desired shape. Alternatively, a droplet discharge method by which a pattern can be selectively formed, a printing method by which a pattern can be transferred or drawn (a method for forming a pattern such as screen printing or offset printing), a coating method such as a spin coating method, a dipping method, a dispenser method, a brush coating method, a spraying method, a flow coating method, or the like can be employed. Still alternatively, an imprint technique or a nanoimprint technique with which a nanoscale three-dimensional structure can be formed by a transfer technology can be employed. Imprinting and nanoimprinting are techniques with which a minute three-dimensional structure can be formed without using a photolithography process.

Figure 4:
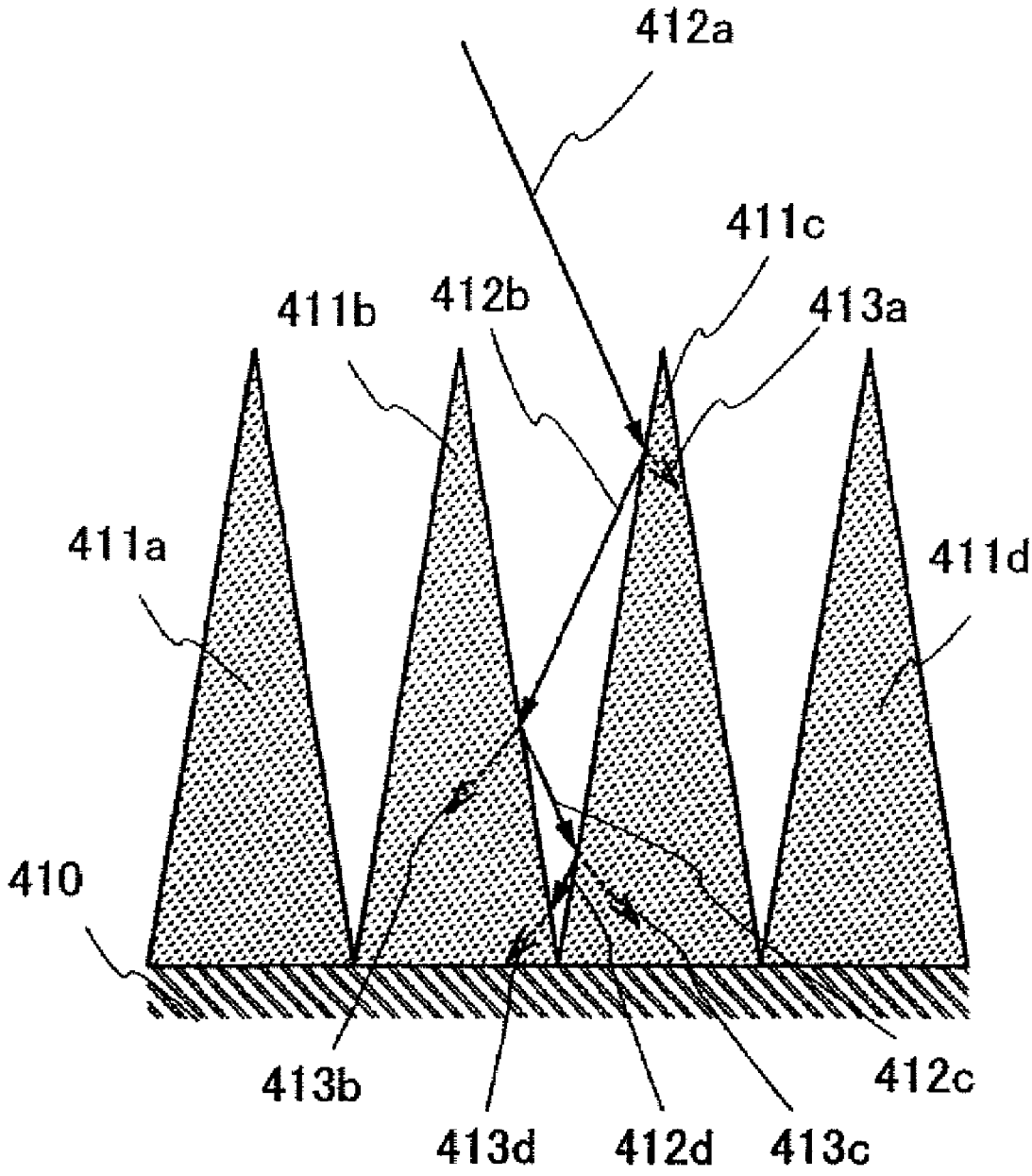
FIG. 4 is a conceptual diagram according to the present invention.

The anti-reflection function of the anti-reflection layer having the plurality of pyramid-shaped projections according to the present invention will be described with reference to FIG. 4. In FIG. 4, adjacent pyramid-shaped projections 411*a*, 411*b*, 411*c*, and 411*d* are densely arranged on a substrate 410 to serve as a display screen. An incident light ray 412*a* from external is incident on the pyramid-shaped projection 411*c*, part of the incident light ray enters the pyramid-shaped projection 411*c* as a transmitted light ray 413*a*, and the other part of the incident light ray 412*a* is reflected at an interface of the pyramid-shaped projection 411*c* as a reflected light ray 412*b*. The reflected light ray 412*b* is again incident on the pyramid-shaped projection 411*b* which is adjacent to the pyramid-shaped projection 411*c*, part of the reflected light ray 412*b* enters the pyramid-shaped projection 411*b* as a transmitted light ray 413*b*, and the other part of the reflected light ray 412*b* is reflected at an interface of the pyramid-shaped projection 411*b* as a reflected light ray 412*c*. The reflected light ray 412*c* is again incident on the pyramid-shaped projection 411*c* which is adjacent to the pyramid-shaped projection 411*b*, part of the reflected light ray 412*c* enters the pyramid-shaped projection 411*c* as a transmitted light ray 413*c*, and the other part of the reflected light ray 412*c* is reflected at the interface of the pyramid-shaped projection 411*c* as a reflected light ray 412*d*. The reflected light ray 412*d* is again incident on the pyramid-shaped projection 411*b* which is adjacent to the pyramid-shaped projection 411*c*, and part of the reflected light ray 412*d* enters the pyramid-shaped projection 411*b* as a transmitted light ray 413*d*.

In this manner, the anti-reflection layer according to this embodiment mode includes a plurality of pyramid-shaped projections, and incident light from external is reflected to not a viewer side but another adjacent pyramid-shaped projection because a side of the pyramid-shaped projection is not parallel to a display screen. Alternatively, reflected light travels between adjacent pyramid-shaped projections. Part of incident light enters an adjacent pyramid-shaped projection, and the other part of the incident light is then incident on the other adjacent pyramid-shaped projection as reflected light. In this manner, incident light from external reflected at an interface of a pyramid-shaped projection repeats incidence on adjacent pyramid-shaped projections.

In other words, the number of entries of light from external which is incident on the pyramid-shaped projections of the anti-reflection layer is increased; therefore, the amount of incident light from external entering the anti-reflection layer is increased. Thus, the amount of incident light from external reflected to a viewer side is reduced, and the cause of a reduction in visibility such as reflection can be prevented.

The present invention can provide a PDP and an FED with high visibility, each of which has an anti-reflection layer having a plurality of adjacent pyramid-shaped projections on a surface and thus has a high anti-reflection function capable of reducing reflection of incident light from external. Accordingly, a PDP and an FED with higher image quality and higher performance can be manufactured.

Embodiment Mode 2

In Embodiment Mode 2, a PDP having an anti-reflection function capable of further reducing reflection of incident light from external and having excellent visibility will be described. That is, a structure of a PDP which includes a pair of substrates, at least a pair of electrodes provided between the pair of substrates, a phosphor layer provided between the pair of electrodes, and an anti-reflection layer provided on an outer side of one substrate of the pair of substrates will be described in detail.

Figure 9A:
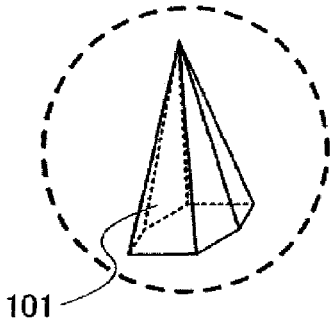
FIGS. 9A and 9B are perspective views of a PDP according to the present invention.
Figure 9B:
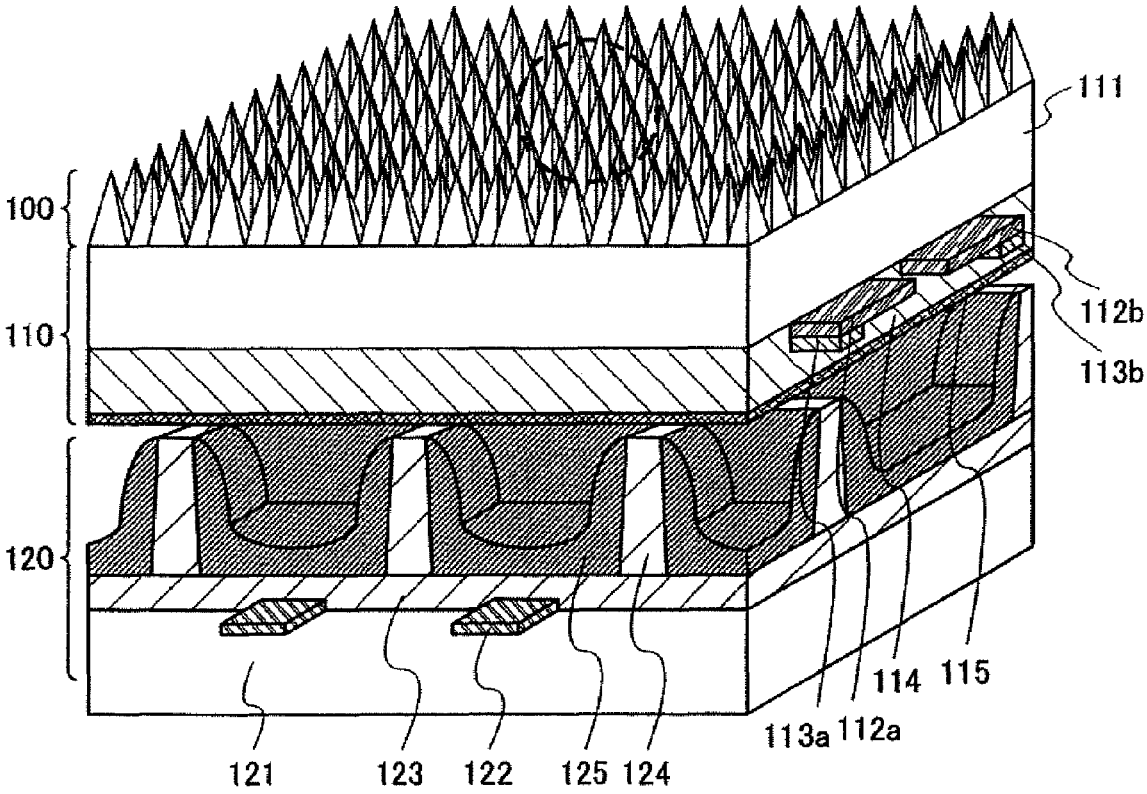

In this embodiment mode, a surface discharge PDP of alternating current discharge type (AC type) is shown. FIG. 9A shows an enlarged diagram of a pyramid-shaped projection 101. As shown in FIG. 9B, in a PDP, a front substrate 110 and a back substrate 120 face each other, and the periphery of the front substrate 110 and the back substrate 120 is sealed with a sealant (not shown). In addition, a region enclosed by the sealant, the front substrate 110, and the back substrate 120 is filled with a discharge gas.

Discharge cells of a display portion are arranged in matrix, and each discharge cell is provided at an intersection of a display electrode included in the front substrate 110 and a data electrode 122 included in the back substrate 120.

In the front substrate 110, a display electrode extended in a first direction is formed over one surface of a first light-transmitting substrate 111. The display electrode includes light-transmitting conductive layers 112*a* and 112*b*, a scan electrode 113*a*, and a sustain electrode 113*b*. In addition, a light-transmitting insulating layer 114 which covers the first light-transmitting substrate 111, the light-transmitting conductive layers 112*a* and 112*b*, the scan electrode 113*a*, and the sustain electrode 113*b* is formed. Further, a protective layer 115 is formed over the light-transmitting insulating layer 114.

An anti-reflection layer 100 is formed over the other surface of the first light-transmitting substrate 111. The anti-reflection layer 100 includes a pyramid-shaped projection 101. As the pyramid-shaped projection 101, the pyramid-shaped projection described in Embodiment Mode 1 can be used.

In the back substrate 120, a data electrode 122 extended in a second direction intersecting with the first direction is formed over one surface of a second light-transmitting substrate 121. A dielectric layer 123 which covers the second light-transmitting substrate 121 and the data electrode 122 is formed. Over the dielectric layer 123, partitions (ribs) 124 for separating discharge cells are formed. A phosphor layer 125 is formed in a region surrounded by the partitions (ribs) 124 and the dielectric layer 123.

A space surrounded by the phosphor layer 125 and the protective layer 115 is filled with a discharge gas.

A high strain point glass substrate, a soda lime glass substrate, or the like which can withstand a baking process with a temperature of more than 500° C. can be used for the first light-transmitting substrate 111 and the second light-transmitting substrate 121.

The light-transmitting conductive layers 112*a* and 112*b* formed over the first light-transmitting substrate 111 preferably have light-transmitting properties to transmit light emitted from a phosphor and are formed using ITO or tin oxide. In addition, the light-transmitting conductive layers 112*a* and 112*b* may be rectangular or T-shaped. The light-transmitting conductive layers 112*a* and 112*b* can be formed in such a way that a conductive layer is formed over the first light-transmitting substrate 111 by a sputtering method, a coating method, or the like and then selectively etched. Alternatively, the light-transmitting conductive layers 112*a* and 112*b* can be formed in such a way that a composition is selectively applied by a droplet discharge method, a printing method, or the like and baked. Further alternatively, the light-transmitting conductive layers 112*a* and 112*b* can be formed by a lift-off method.

The scan electrode 113*a* and the sustain electrode 113*b* are preferably formed using a conductive layer with a low resistance value and can be formed using chromium, copper, silver, aluminum, gold, or the like. In addition, a stack of copper, chromium, and copper or a stack of chromium, aluminum, and chromium can be used. As a method for forming the scan electrode 113*a* and the sustain electrode 113*b*, a similar method to the method for forming the light-transmitting conductive layers 112*a* and 112*b* can be used as appropriate.

The light-transmitting insulating layer 114 can be formed using low melting glass containing lead or zinc. As a method for forming the light-transmitting insulating layer 114, a printing method, a coating method, a green sheet laminating method, or the like can be used.

The protective layer 115 is provided to protect the dielectric layer from discharged plasma and promote secondary electron release. Therefore, a material having a low ion sputtering rate, a high secondary electron emission coefficient, a low voltage to generate discharged plasma, and a high surface insulating property is preferably used. A typical example of such a material is magnesium oxide. As a method for forming the protective layer 115, an electron beam evaporation method, a sputtering method, an ion plating method, an evaporation method, or the like can be used.

Note that a color filter and a black matrix may be provided at an interface between the first light-transmitting substrate 111 and the light-transmitting conductive layers 112*a* and 112*b*, at an interface between the light-transmitting conductive layers 112*a* and 112*b* and the light-transmitting insulating layer 114, in the light-transmitting insulating layer 114, at an interface between the light-transmitting insulating layer 114 and the protective layer 115, or the like. By providing a color filter and a black matrix, contrast between light and dark can be improved and a color purity of emission color of a phosphor can be improved. As a color filter, a colored layer corresponding to an emission spectrum of a light-emission cell is provided.

As a material of the color filter, there are a material in which an inorganic pigment is dispersed in light-transmitting glass having a low melting point, colored glass in which a metal or metal oxide is included as a colored component, and the like. As the inorganic pigment, an iron oxide based material (red), a chromium based material (green), a chromium-vanadium based material (green), a cobalt aluminate based material (blue), or a zirconium-vanadium based material (blue) can be used. As the inorganic pigment of the black matrix, a cobalt-chromium-iron based material can be used. Other than the inorganic pigment, pigments can be mixed as appropriate to be used for a desired color tone of RGB or a desired color tone of the black matrix.

The data electrode 122 can be formed in a similar manner to the scan electrode 113*a* and the sustain electrode 113*b*.

The dielectric layer 123 is preferably white with a high reflectance in order to efficiently take out light emitted by a phosphor to the front substrate side. The dielectric layer 123 can be formed using low melting glass containing lead, alumina, titania, or the like. As a method for forming the dielectric layer 123, a similar method to the method for forming the light-transmitting insulating layer 114 can be used as appropriate.

The partitions (ribs) 124 are formed using low melting glass containing lead and ceramic. The partitions (ribs) can prevent color mixture of emitted light between adjacent discharge cells and improve color purity when the partitions (ribs) each have a well curb shape. As a method for forming the partitions (ribs) 124, a screen printing method, a sandblast method, an additive method, a photosensitive paste method, a pressure casting method, or the like can be used. Although the partitions (ribs) 124 each have a well curb shape in FIG. 9B, the partitions (ribs) 124 may be polygonal or circular.

The phosphor layer 125 can be formed using various phosphor materials which can emit light by ultraviolet irradiation. For example, there are $BaMgAl_{14}O_{23}$:Eu as a phosphor material for blue, $(Y.Ga)BO_3$:Eu as a phosphor material for red, and $Zn_2SiO_4$:Mn as a phosphor material for green; however, other phosphor materials can be used as appropriate. The phosphor layer 125 can be formed by a printing method, a dispenser method, an adhesive method using light, a phosphor dry film method in which a dry film resist including dispersed phosphor powder is laminated, or the like.

As the discharge gas, a mixed gas of neon and argon; a mixed gas of helium, neon, and xenon; a mixed gas of helium, xenon, and krypton; or the like can be used.

Next, a method for manufacturing a PDP is described hereinafter

At the periphery of the back substrate 120, glass for sealing is printed by a printing method and then pre-baked. Next, the front substrate 110 and the back substrate 120 are aligned, provisionally fixed, and then heated. Accordingly, the glass for sealing is melted and cooled, so that the front substrate 110 and the back substrate 120 are attached together to be made as a panel. Next, an inside of the panel is exhausted to a vacuum while the panel is heated. Then, after a discharge gas is introduced to the inside of the panel from a vent pipe provided for the back substrate 120, an open end portion of the vent pipe is closed and the inside of the panel is hermetically sealed by heating the vent pipe provided for the back substrate 120. Then, a cell of the panel discharges electricity, and aging in which discharging is continued until light-emission properties and discharge characteristics become stable is performed, so that the panel can be completed.

Figure 10A:
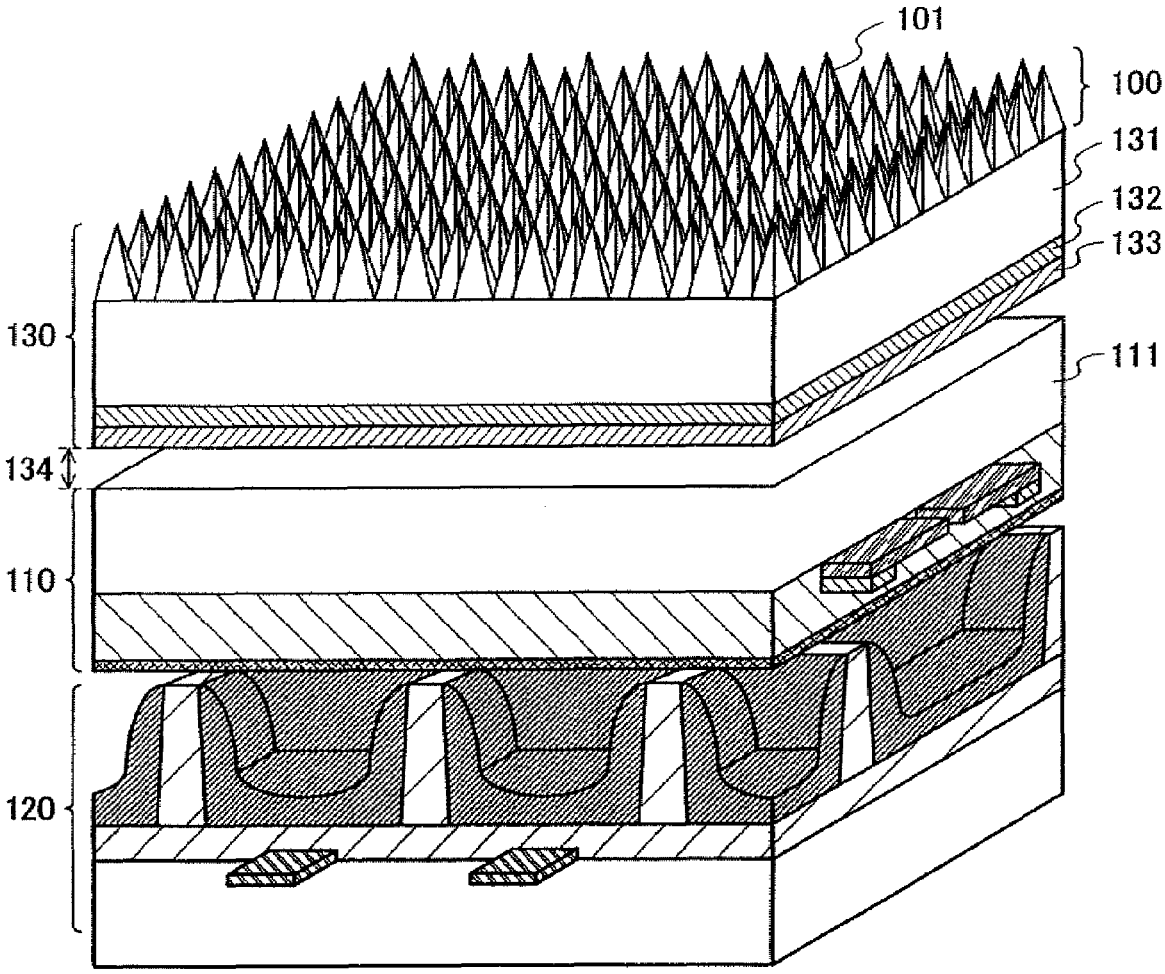
FIGS. 10A and 10B are perspective views of a PDP according to the present invention.

As shown in FIG. 10A, a PDP of this embodiment mode may include the front substrate 110 and the back substrate 120 which are sealed, and an optical filter 130, in which an electromagnetic wave shield layer 133 and a near-infrared ray shielding layer 132 are formed on one surface of a light-transmitting substrate 131 and the anti-reflection layer 100 as described in Embodiment Mode 1 is formed on the other surface of the light-transmitting substrate 131. Note that in FIG. 10A, the mode is shown in which the anti-reflection layer 100 is not formed on the surface of the first light-transmitting substrate 111 of the front substrate 110; however, an anti-reflection layer as described in Embodiment Mode 1 may also be provided on the surface of the first light-transmitting substrate 111 of the front substrate 110. By using such a structure, reflectance of incident light from external can be further reduced.

When plasma is generated inside the PDP, electromagnetic waves, infrared rays, and the like are released to the outside of the PDP. The electromagnetic waves are harmful to human bodies. In addition, the infrared rays cause malfunction of a remote controller. Therefore, the optical filter 130 is preferably used for shielding electromagnetic waves and infrared rays.

The anti-reflection layer 100 may be formed over the light-transmitting substrate 131 by the manufacturing method described in Embodiment Mode 1. Alternatively, the anti-reflection layer 100 may exist in a surface part of the light-transmitting substrate 131. Further alternatively, the anti-reflection layer 100 may be attached to the light-transmitting substrate 131 with a UV hardening adhesive or the like.

As a typical example of the electromagnetic wave shield layer 133, there are metal mesh, metal fiber mesh, mesh in which an organic resin fiber is coated with a metal layer, and the like. The metal mesh and the metal fiber mesh are formed of gold, silver, platinum, palladium, copper, titanium, chromium, molybdenum, nickel, zirconium, or the like. The metal mesh can be formed by a plating method, an electroless plating method, or the like after a resist mask is formed over the light-transmitting substrate 131. Alternatively, the metal mesh can be formed in such a way that a conductive layer is formed over the light-transmitting substrate 131, and the conductive layer is selectively etched using a resist mask formed by a photolithography process. In addition, the metal mesh can be formed by appropriately using a printing method, a droplet discharge method, or the like. Note that each surface of the metal mesh, the metal fiber mesh, and the metal layer formed on a surface of a resin fiber is preferably processed to be black in order to reduce visible-light reflectance.

An organic resin fiber of which surface is covered with a metal layer can be formed of polyester, nylon, vinylidene chloride, aramid, vinylon, cellulose, or the like. In addition, the metal layer over the surface of the organic resin fiber can be formed using any of the materials for the metal mesh.

As the electromagnetic wave shield layer 133, a light-transmitting conductive layer having a surface resistance of 10Ω/□ or less, preferably 4Ω/□ or less, more preferably 2.5Ω/□ or less can be used. As the light-transmitting conductive layer, a light-transmitting conductive layer formed of ITO, tin oxide, zinc oxide, or the like can be used. The thickness of the light-transmitting conductive layer is preferably 100 nm or more and 5 μm or less in terms of surface resistance and light-transmitting properties.

In addition, as the electromagnetic wave shield layer 133, a light-transmitting conductive film can be used. As the light-transmitting conductive film, a plastic film in which conductive particles are dispersed can be used. As the conductive particles, there are particles or the like of carbon, gold, silver, platinum, palladium, copper, titanium, chromium, molybdenum, nickel, zirconium, and the like.

Figure 10B:
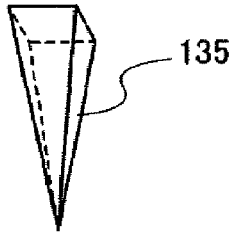

Further, as the electromagnetic wave shield layer 133, a plurality of electromagnetic wave absorbers 135 each having a pyramid shape as shown in FIG. 10B may be provided. For the electromagnetic wave absorber, a polygonal pyramid such as a triangular pyramid, a quadrangular pyramid, a pentagonal pyramid, or a hexagonal pyramid; a circular cone; or the like can be used. In addition, the electromagnetic wave absorber can be formed using a material similar to that of the light-transmitting conductive film. Further, the electromagnetic wave absorber may be formed in such a way that a light-transmitting conductive layer of ITO or the like is processed into a pyramid shape or a circular cone shape. Furthermore, the electromagnetic wave absorber may be formed in such a way that a pyramid or a cone is formed using a material similar to that of the light-transmitting conductive film and then a light-transmitting conductive layer is formed on the surface of the pyramid or the cone. Note that an apical angle of the electromagnetic wave absorber is provided on the first light-transmitting substrate 111 side, so that absorption of electromagnet waves can be increased.

Note that the electromagnetic wave shield layer 133 may be attached to the near-infrared ray shielding layer 132 with an adhesive or the like such as an acrylic-based adhesive, a silicone-based adhesive, or a urethane-based adhesive.

Note that an end portion of the electromagnetic wave shield layer 133 is grounded to an earth terminal.

The near-infrared ray shielding layer 132 is a layer in which one or more kinds of dyes having the maximum absorption wavelength at a wavelength of 800 nm to 1000 nm is dissolved in an organic resin. As the dyes, there are a cyanine-based compound, a phthalocyanine-based compound, a naphthalocyanine-based compound, a naphthoquinone-based compound, an anthraquinone-based compound, a dithiol-based complex, and the like.

As the organic resin which can be used for the near-infrared ray shielding layer 132, a polyester resin, a polyurethane resin, an acrylic resin, or the like can be used as appropriate. In addition, a solvent can be used as appropriate to dissolve the dye.

As the near-infrared ray shielding layer 132, a light-transmitting conductive layer of a copper based material, a phthalocyanine based compound, zinc oxide, silver, ITO, or the like; or a nickel complex layer may be formed over the surface of the light-transmitting substrate 131. Note that in the case where the near-infrared ray shielding layer 132 is formed of the material, the near-infrared ray shielding layer 132 has light-transmitting properties and a thickness which blocks near-infrared rays.

As a method for forming the near-infrared ray shielding layer 132, a composition can be applied by a printing method, a coating method, or the like and hardened by heat or light irradiation.

As the light-transmitting substrate 131, a glass substrate, a quartz substrate, a flexible substrate, or the like can be used. The flexible substrate is a substrate capable of being bent, and for example, a plastic substrate formed of polyethylene terephthalate, polyethersulfone, polystyrene, polyethylene naphthalate, polycarbonate, polyimide, polyarylate, or the like; and the like are given. In addition, a film (formed of polypropylene, polyester, vinyl, polyvinyl fluoride, vinyl chloride, or polyamide; a film with an inorganic thin layer formed by evaporation; or the like) can be used.

Figure 11:
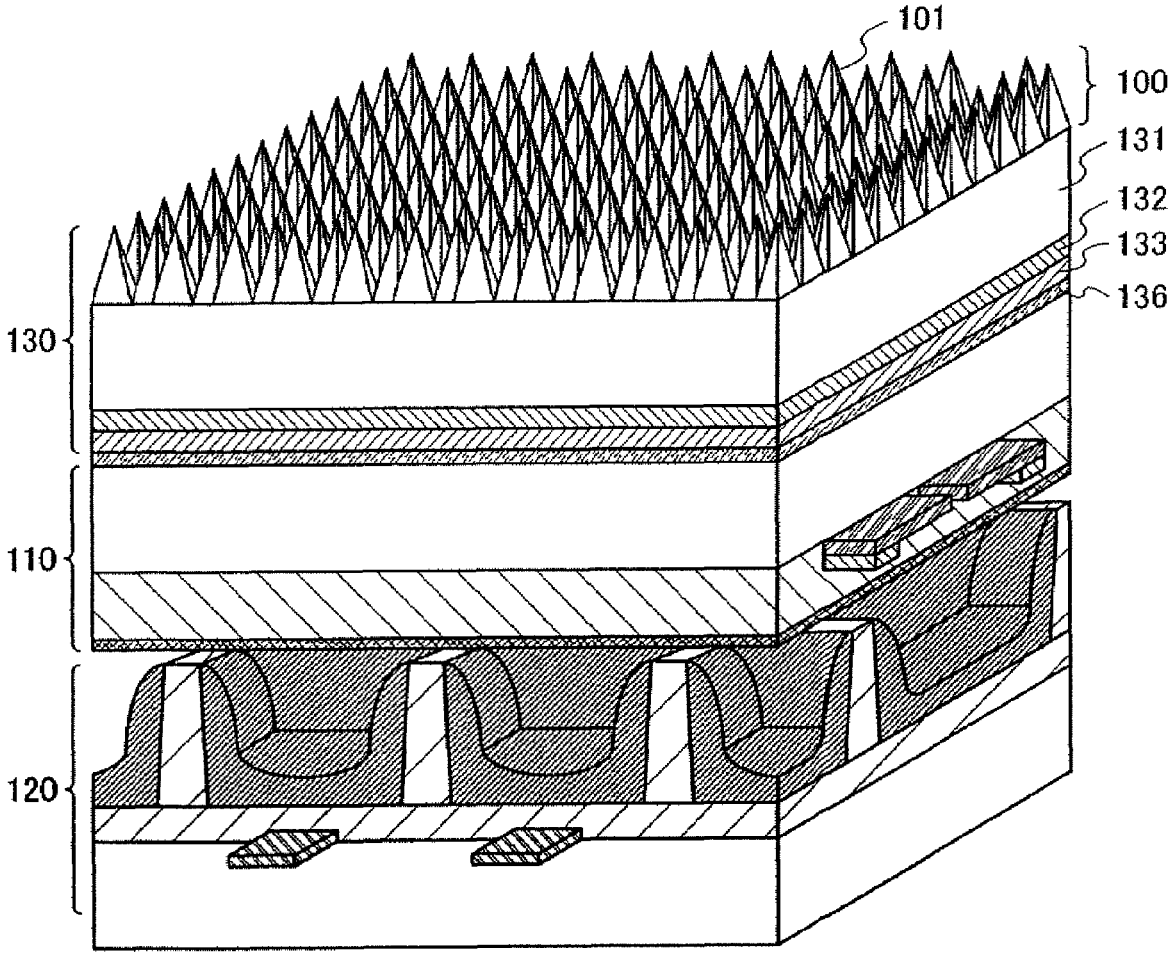
FIG. 11 is a perspective view of a PDP according to the present invention.

Note that in FIG. 10A, the front substrate 110 and the optical filter 130 are provided with a gap 134 interposed therebetween; however, as shown in FIG. 11, the optical filter 130 and the front substrate 110 may be attached to each other by using an adhesive 136. As the adhesive 136, an adhesive having light-transmitting properties can be used as appropriate, and as typical examples, there are an acrylic-based adhesive, a silicone-based adhesive, a urethane-based adhesive, and the like.

In particular, when plastic is used for the light-transmitting substrate 131 and the optical filter 130 is provided over the surface of the front substrate 110 using the adhesive 136, reduction in thickness and weight of a plasma display can be achieved.

Note that the electromagnetic wave shield layer 133 and the near-infrared ray shielding layer 132 are formed using different layers here; however, one functional layer having an electromagnetic wave shield function and a near-infrared ray shielding function may be formed for the electromagnetic wave shield layer 133 and the near-infrared ray shielding layer 132. In this way, the thickness of the optical filter 130 can be reduced, and reduction in weight and thickness of the PDP can be achieved.

Figure 12:
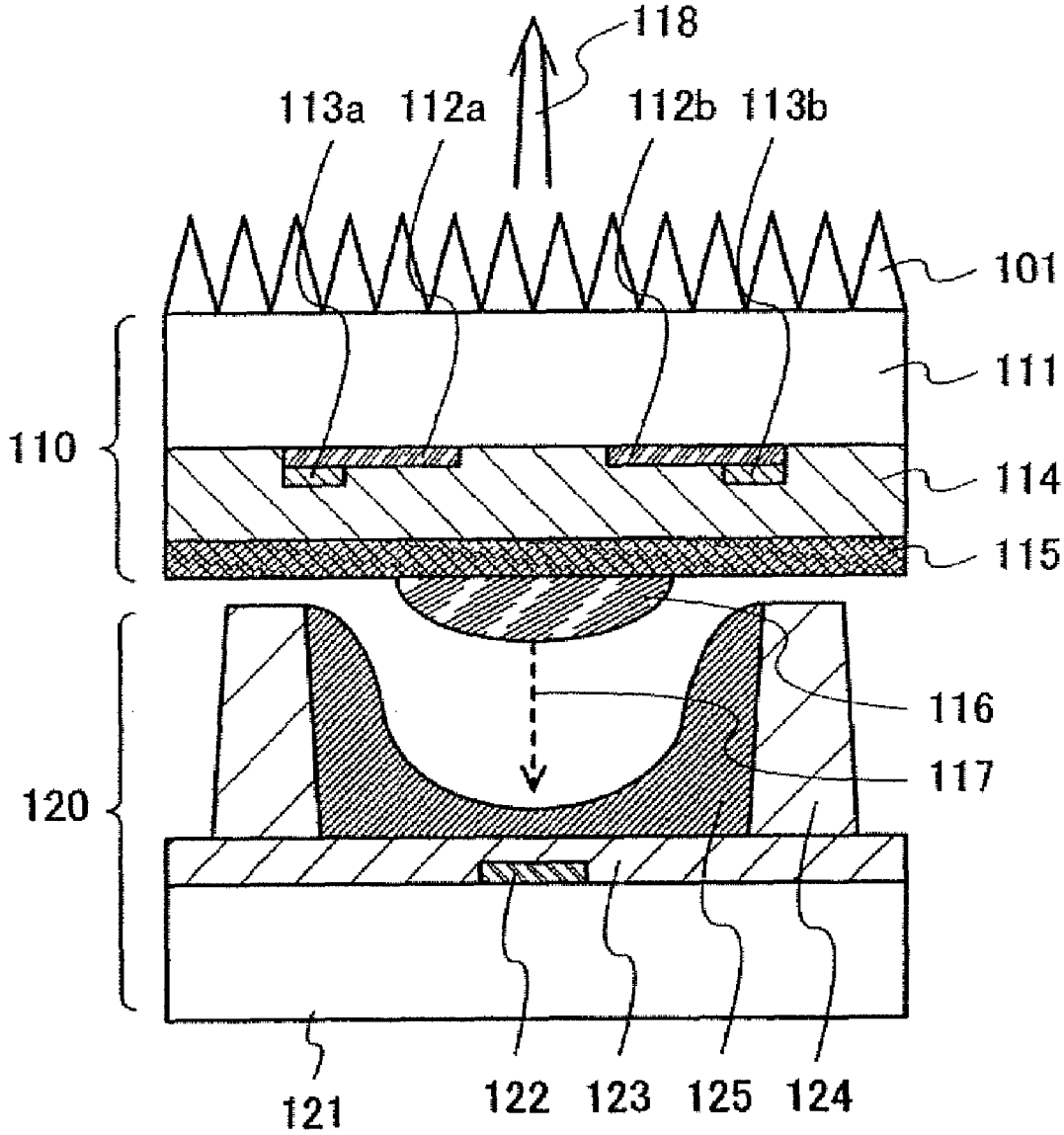
FIG. 12 is a cross-sectional view of a PDP according to the present invention.
Figure 13:
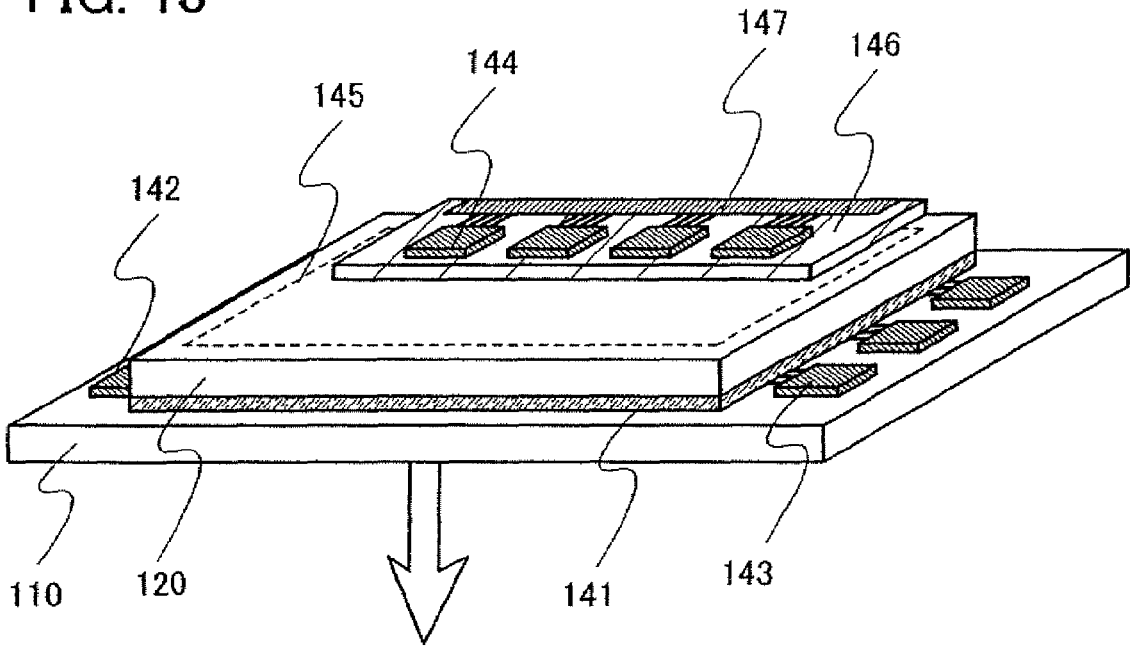
FIG. 13 is a perspective view of a PDP module according to the present invention.
Figure 14:
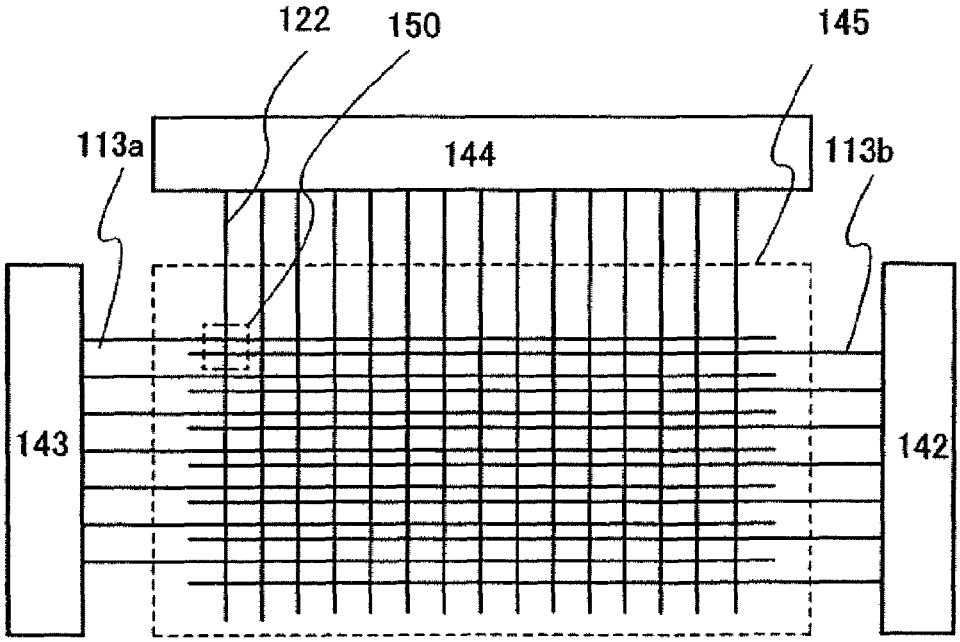
FIG. 14 shows a PDP according to the present invention.

Next, a PDP module and a driving method thereof are described with reference to FIGS. 12 to 14. FIG. 12 is a cross-sectional view of a discharge cell. FIG. 13 is a perspective view of a PDP module. FIG. 14 is a schematic diagram of a PDP module.

As shown in FIG. 13, in the PDP module, the periphery of the front substrate 110 and the back substrate 120 is sealed with glass for sealing 141. A scan electrode driver circuit 142 that drives a scan electrode and a sustain electrode driver circuit 143 that drives a sustain electrode are provided for the first light-transmitting substrate which is part of the front substrate 110 and are connected to respective electrodes.

A data electrode driver circuit 144 that drives a data electrode is provided over the second light-transmitting substrate which is part of the back substrate 120 and is connected to the data electrode. Here, the data electrode driver circuit 144 is provided over a wiring board 146 and connected to the data electrode through an FPC 147, Although not shown, a control circuit which controls the scan electrode driver circuit 142, the sustain electrode driver circuit 143, and the data electrode driver circuit 144 is provided for the first light-transmitting substrate 111 or the second light-transmitting substrate 121.

As shown in FIG. 14, a discharge cell 150 of a display portion 145 is selected by a control portion based on inputted image data, and a pulse voltage having a low voltage to generate discharged plasma or more is applied to the scan electrode 113*a* and the data electrode 122 in the discharge cell 150 and discharging of electricity is performed between the electrodes. A wall charge is accumulated on the surface of the protective layer due to the electric discharging, and a wall voltage is generated. Then, a pulse voltage is applied between display electrodes (between the scan electrode 113*a* and the sustain electrode 113*b*) to sustain the electric discharging; accordingly, plasma 116 is generated on the front substrate 110 side as shown in FIG. 12 and the electric discharging is sustained. In addition, when a surface of the phosphor layer 125 of the back substrate is irradiated with an ultraviolet ray 117 generated from a discharge gas in the plasma, a phosphor in the phosphor layer 125 is excited, the phosphor emits light, and the light is emitted to the front substrate side as light emission 118.

Note that, since the sustain electrode 113*b* does not need to scan the inside of the display portion 145, the sustain electrode 113*b* can be used as a common electrode. In addition, by setting the sustain electrode as a common electrode, the number of driver ICs can be reduced.

In this embodiment mode, the reflection type surface discharge PDP of AC type is shown as a PDP; however, the present invention is not limited to this. In a transmissive discharge PDP of AC discharge type, the anti-reflection layer 100 can be provided. Further, also in a PDP of direct current (DC) discharge type, the anti-reflection layer 100 can be provided.

The PDP described in this embodiment mode includes the anti-reflection layer on its surface. The anti-reflection layer includes a plurality of pyramid-shaped projections, and incident light from external is reflected to not a viewer side but another adjacent pyramid-shaped projection because the interface of the pyramid-shaped projection is not perpendicular to an incident direction of the light from external. Alternatively, the reflected light travels between adjacent pyramid-shaped projections. Part of incident light enters an adjacent pyramid-shaped projection having a hexagonal base, and the other part of the incident light is then incident on the other adjacent pyramid-shaped projection as reflected light. In this manner, incident light from external reflected at an interface of a pyramid-shaped projection repeats incidence on adjacent pyramid-shaped projections.

In other words, the number of entries of light from external which is incident on the pyramid-shaped projections of a PDP is increased; therefore, the amount of incident light from external entering the pyramid-shaped projections is increased. Thus, the amount of incident light from external reflected to a viewer side is reduced, and the cause of a reduction in visibility such as reflection can be prevented.

In addition, by a structure, in which a plurality of pyramid-shaped projections are arranged densely without a space therebetween, a refractive index changes due to a physical shape that is the pyramid-shaped projections protruding toward the outside (air side) from a display screen surface. In this embodiment mode, apexes of the plurality of pyramid-shaped projections are arranged at equal intervals, and each side of a base which forms a pyramid shape of a pyramid-shaped projection is arranged to be in contact with a side of a base which forms a pyramid shape of an adjacent pyramid-shaped projection. In other words, one pyramid-shaped projection is surrounded by other pyramid-shaped projections, and the base of the pyramid-shaped projection shares a side of a base with the base of the adjacent pyramid-shaped projection.

Thus, since the pyramid-shaped projections are arranged densely without a space, at equal intervals between the apexes thereof, a PDP of the present invention has an excellent anti-reflection function with which incident light from external can be efficiently scattered in many directions.

In this embodiment mode, it is preferable that each of the intervals between the apexes of the plurality of pyramid-shaped projections and the width of the base of each of the plurality of pyramid-shaped projections be 350 nm or less each and the height of each of the plurality of pyramid-shaped projections be 800 nm or more. Further, the fill rate (filling (occupying) percentage on the substrate surface to serve as a display screen) of bases of the plurality of pyramid-shaped projections per unit area on the substrate surface to serve as a display screen is preferably 80% or more, and more preferably 90% or more. The fill rate is a percentage of a formation region of a pyramid-shaped projection over the substrate surface to serve as a display screen. When the fill rate is 80% or more, the percentage of a plane portion where a pyramid-shaped projection having a hexagonal base is not formed on the substrate surface to serve as a display screen is 20% or less. In addition, it is preferable that the ratio of the height to the width of a base of a pyramid-shaped projection be 5 or more. When the above-described conditions are satisfied, the percentage of incidence of light from external which is incident on the plane portion is reduced and thus reflection to a viewer side can be prevented.

Further, the plurality of pyramid-shaped projections preferably have as many sides with different angles to the bases thereof as possible because incident light are scattered in more directions. In this embodiment mode, a pyramid-shaped projection has six sides which are in contact with a base of the pyramid-shaped projection at six different angles. In addition, since a base of a pyramid-shaped projection shares a vertex with bases of other pyramid-shaped projections and the pyramid-shaped projection is surrounded by a plurality of sides, which are provided at a plurality of angles, of the pyramid-shaped projections, incident light is more easily reflected in many directions. Therefore, the more vertices the base of a pyramid-shaped projection has, the more easily an anti-reflection function thereof can be exerted, and thus the base of the pyramid-shaped projection in this embodiment mode has six vertices. The pyramid-shaped projection having a hexagonal base of this embodiment mode is a shape by which pyramid-shaped projections can be arranged densely without a space therebetween, and is an optimal shape having the largest number of sides among such shapes and having an excellent anti-reflection function with which incident light can be scattered efficiently in many directions.

The pyramid-shaped projection can be formed of not a material with a uniform refractive index but a material of which the refractive index changes from an apical portion of the pyramid-shaped projection to a side of a substrate to serve as a display screen. For example, in each of the plurality of pyramid-shaped projections, a portion closer to the apical portion of the pyramid-shaped projection can be formed of a material having a refractive index equivalent to that of air, so that reflection of light from external which is incident on the pyramid-shaped projection from the air, at the surface of the pyramid-shaped projection can be further reduced. On the other hand, in each of the plurality of pyramid-shaped projections each having a hexagonal base, a portion closer to the substrate to serve as a display screen can be formed of a material having a refractive index more equivalent to that of the substrate, so that reflection, at an interface between the pyramid-shaped projection and the substrate, of light which travels through the pyramid-shaped projection and is incident on the substrate can be reduced. When a glass substrate is used as the substrate, since the refractive index of the air is lower than that of the glass substrate, the pyramid-shaped projection may have such a structure in which a portion closer to an apical portion of the pyramid-shaped projection is formed of a material having a lower refractive index and a portion closer to a base of the pyramid-shaped projection is formed of a material having a higher refractive index. In other words, the pyramid-shaped projection may have such a structure in which the refractive index increases from the apical portion to the base of the pyramid-shaped projection.

By being provided with an anti-reflection layer having a plurality of adjacent pyramid-shaped projections on a surface, the PDP shown in this embodiment mode has a high anti-reflection function capable of reducing reflection of incident light from external. Therefore, a PDP with high visibility can be provided. Accordingly, a PDP with higher image quality and higher performance can be manufactured.

Embodiment Mode 3

Embodiment Mode 3 will describe an FED having an anti-reflection function capable of reducing reflection of incident light from external and having excellent visibility. That is, a structure of an FED including a pair of substrates, a field emission element provided over one substrate of the pair of substrates, an electrode provided on the other substrate of the pair of substrates, a phosphor layer which is in contact with the electrode, and an anti-reflection layer provided on an outer side of the other substrate will be described in detail.

The FED is a display device in which phosphors are exited by an electron beam to emit light. The FED can be classified into a diode-type FED, a triode-type FED, and a tetrode-type FED according to the configurations of electrodes.

The diode-type FED has a structure where a rectangular cathode electrode is formed on a surface of a first substrate while a rectangular anode electrode is formed on a surface of a second substrate, and the cathode electrode and the anode electrode cross each other with a distance of several micrometers to several millimeters interposed therebetween. By setting the potential difference at an intersection in a vacuum space between the cathode electrode and the anode electrode at 10 kV or less, an electron beam is emitted between the electrodes. This electron reaches the phosphor layer which is provided for the cathode electrode to excite a phosphor, so that an image can be displayed by light emission.

The triode-type FED has a structure where a gate electrode is formed over a first substrate provided with a cathode electrode so that the gate electrode crosses the cathode electrode with an insulating film interposed therebetween. The cathode electrode and the gate electrode are arranged with a rectangular shape or in matrix, and an electron-emission element is formed at the intersection portion between the cathode electrode and the gate electrode, which includes the insulating film. By applying a voltage to the cathode electrode and the gate electrode, an electron beam can be emitted from the electron-emission element. This electron beam is pulled toward the anode electrode of the second substrate to which a voltage higher than the voltage to the gate electrode is applied, thereby exciting a phosphor in the phosphor layer provided for the anode electrode, so that an image can be displayed by light emission.

The tetrode-type FED has a structure where a plate-like or thin film converging electrode having an opening is formed in each pixel between the gate electrode and the anode electrode of the triode type-FED. By converging electron beams emitted from the electron-emission element by the converging electrode in each pixel, a phosphor in the phosphor layer provided for the anode electrode can be excited, and thus, an image can be displayed by light emission.

Figure 15A:
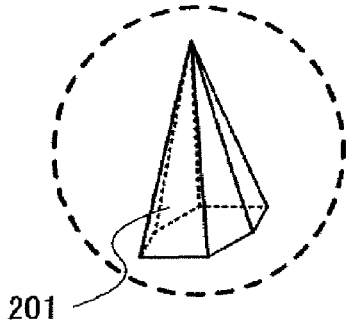
FIGS. 15 A and 15B are perspective views of an FED according to the present invention.
Figure 15B:
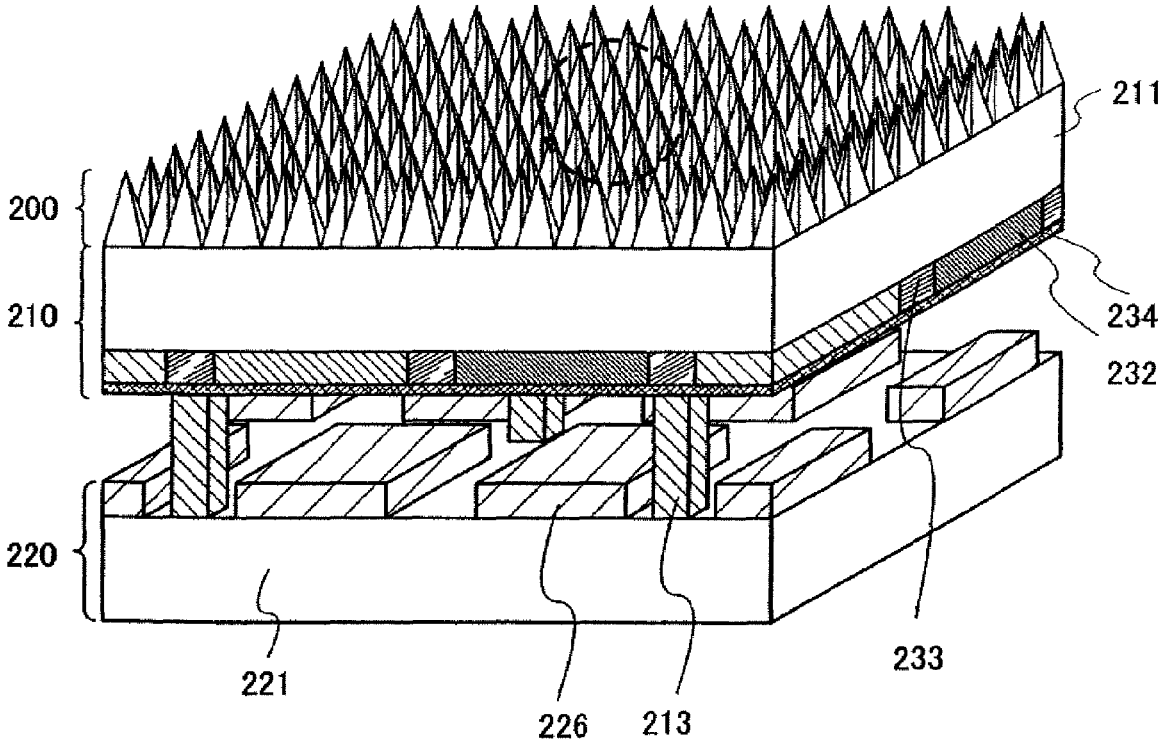

FIG. 15A shows an enlarged diagram of a pyramid-shaped projection 201. FIG. 15B is a perspective view of an FED. As shown in FIG. 15B, a front substrate 210 and a back substrate 220 face each other, and the periphery of the front substrate 210 and the back substrate 220 is sealed with a sealant (not shown). In order to keep a constant gap between the front substrate 210 and the back substrate 220, a spacer 213 is provided between the front substrate 210 and the back substrate 220. In addition, a region enclosed by the front substrate 210, the back substrate 220, and the sealant is held in a vacuum. When an electron beam moves in the enclosed region, a phosphor in a phosphor layer 232 which is provided for an anode electrode or a metal back is exited to emit light. By making a given cell emit light in this way, a display image is provided.

The discharge cells of a display portion are arranged in matrix.

In the front substrate 210, the phosphor layer 232 is formed over one surface of a first light-transmitting substrate 211. A metal back 234 is formed over the phosphor layer 232. Note that an anode electrode may be formed between the first light-transmitting substrate 211 and the phosphor layer 232. As the anode electrode, a rectangular conductive layer which extends in a first direction can be formed.

An anti-reflection layer 200 is formed over the other surface of the first light-transmitting substrate 211. The anti-reflection layer 200 includes a pyramid-shaped projection 201. As the pyramid-shaped projection 201, the pyramid-shaped projection described in Embodiment Mode 1 can be used.

In the back substrate 220, an electron-emission element 226 is formed over one surface of a second light-transmitting substrate 221. As the electron-emission element, various structures are proposed. Specifically, there are a Spindt-type electron-emission element, a surface-conduction electron-emission element, a ballistic-electron surface-emission electron-emission element, a MIM (metal-insulator-metal) element, a carbon nanotube, graphite nanofiber, diamond-like carbon (DLC), and the like.

Figure 18A:
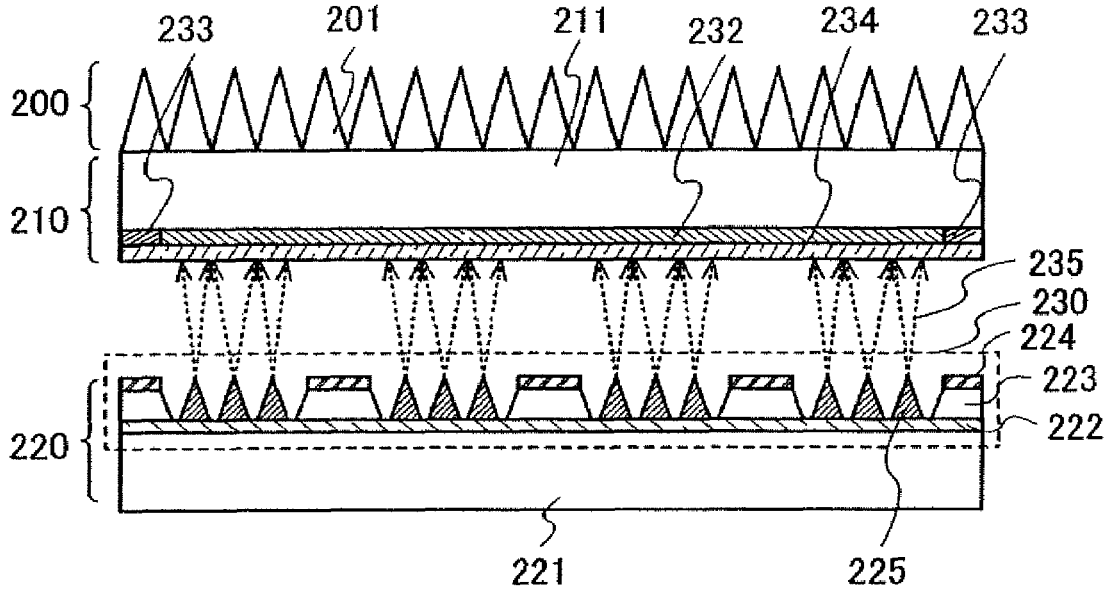
FIGS. 18A and 18B are cross-sectional views of FEDs according to the present invention.
Figure 18B:
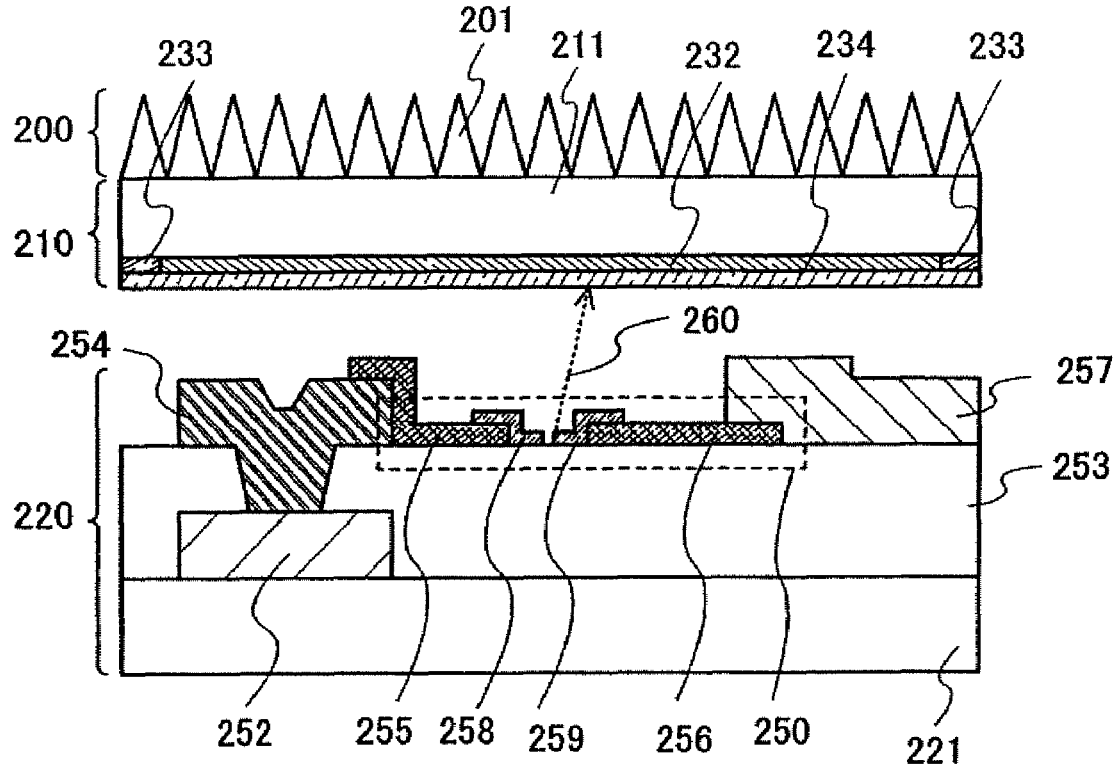

Here, a typical electron-emission element is shown with reference to FIGS. 18A and 18B.

FIG. 18A is a cross-sectional view of a cell of an FED having a Spindt-type electron-emission element.

A cathode electrode 222 and a cone-shaped electron source 225 formed over the cathode electrode 222 are included in a Spindt-type electron-emission element 230. The cone-shaped electron source 225 is formed of a metal or a semiconductor A gate electrode 224 is provided at the periphery of the cone-shaped electron source 225. Note that the gate electrode 224 and the cathode electrode 222 are insulated from each other by an interlayer insulating layer 223.

When a voltage is applied through the gate electrode 224 and the cathode electrode 222 formed in the back substrate 220, the electric field concentrates in an apical portion of the cone-shaped electron source 225 to produce an intense electric field, so that electrons are discharged into a vacuum from a metal or a semiconductor which forms the cone-shaped electron source 225 by tunneling. On the other hand, the front substrate 210 is provided with the metal back 234 (or anode electrode) and the phosphor layer 232. By applying a voltage to the metal back 234 (or anode electrode), an electron beam 235 emitted from the cone-shaped electron source 225 is guided to the phosphor layer 232, and a phosphor is exited, so that light emission can be obtained. Therefore, by arranging the cone-shaped electron sources 225 surrounded by the gate electrodes 224 in matrix and selectively applying a voltage to the cathode electrode, the metal back (or anode electrode), and the gate electrode, light emission of each cell can be controlled.

The Spindt-type electron-emission element has advantages in that electron extraction efficiency is high since an electron-emission element is provided in a central region of a gate electrode, which has the highest concentration of the electric field; in-plane uniformity of an extraction current is high since patterns having the arrangement of electron-emission elements can be accurately drawn to suitably arrange electric field distribution; and the like.

Next, a structure of a cell having the Spindt-type electron-emission element will be described. The front substrate 210 includes the first light-transmitting substrate 211, the phosphor layer 232 and a black matrix 233 formed over the first light-transmitting substrate 211, and the metal back 234 formed over the phosphor layer 232 and the black matrix 233.

As the first light-transmitting substrate 211, a substrate similar to the first light-transmitting substrate 111 described in Embodiment Mode 2 can be used.

For the phosphor layer 232, a phosphor material which is excited by the electron beam 235 can be used. Further, as the phosphor layer 232, phosphor layers of RGB can be provided in rectangular arrangement, lattice arrangement, or delta arrangement, so that color display is possible. Typically, $Y_2O_2S$:Eu (red), $Zn_2SiO_4$:Mn (green), ZnS:Ag, Al (blue), or the like can be used. Other than these, a phosphor material which is excited by a known electron beam can also be used.

The black matrix 233 is formed between the respective phosphor layers 232. By providing the black matrix, discrepancy in luminous color due to misalignment of an irradiated position of the electron beam 235 can be prevented. Further, by providing conductivity to the black matrix 233, the charge up of the phosphor layer 232 due to the electron beam 235 can be prevented. For the black matrix 233, carbon particles can be used. Alternatively, a known black matrix material for an FED can also be used.

The phosphor layer 232 and the black matrix 233 can be formed using a slurry process or a printing method. The slurry process is such a method that a composition in which the above-described phosphor material or carbon particles are mixed into a photosensitive material, a solvent, or the like is applied by spin coating and dried, and then exposed and developed.

The metal back 234 can be formed using a conductive thin film of aluminum or the like having a thickness of 10 to 200 nm, and preferably 50 to 150 nm. By providing the metal back 234, light which is emitted from the phosphor layer 232 and travels to the back substrate 220 side can be reflected toward the first light-transmitting substrate 211, so that luminance can be improved. In addition, damage to the phosphor layer 232 due to shock of ions generated by ionization of a gas which remains in a cell by the electron beam 235, can be prevented. Since the metal back 234 functions as an anode electrode with respect to the electron-emission element 230, the metal back 234 can guide the electron beam 235 to the phosphor layer 232. The metal back 234 can be formed in such a way that a conductive layer is formed by a sputtering method and then selectively etched.

The back substrate 220 includes the second light-transmitting substrate 221, the cathode electrode 222 formed over the second light-transmitting substrate 221, the cone-shaped electron sources 225 formed over the cathode electrode 222, the interlayer insulating layer 223 which separates the electron sources 225 into each cell, and the gate electrode 224 formed over the interlayer insulating layer 223.

As the second light-transmitting substrate 221, a substrate similar to the second light-transmitting substrate 121 described in Embodiment Mode 2 can be used.

The cathode electrode 222 can be formed using tungsten, molybdenum, niobium, tantalum, titanium, chromium, aluminum, copper, or ITO. As a method for forming the cathode electrode 222, an electron beam evaporation method, a thermal evaporation method, a printing method, a plating method, or the like can be used. Alternatively, the cathode electrode 222 can be formed in the following way: a conductive layer is formed by a sputtering method, a CVD method, an ion plating method, or the like over an entire surface, and then, the conductive layer is selectively etched by using a resist mask or the like. When an anode electrode is formed, the cathode electrode can be formed with a rectangular conductive layer which extends in a first direction parallel to the anode electrode.

The electron sources 225 can be formed of tungsten, a tungsten alloy, molybdenum, a molybdenum alloy, niobium, a niobium alloy, tantalum, a tantalum alloy, titanium, a titanium alloy, chromium, a chromium alloy, silicon which imparts n-type conductivity (doped with phosphorus), or the like.

The interlayer insulating layer 223 can be formed using an inorganic siloxane polymer including a Si—O—Si bond among compounds including silicon, oxygen, and hydrogen formed by using a siloxane polymer-based material as a starting material, which is typified by silica glass; or an organic siloxane polymer in which hydrogen bonded to silicon is substituted by an organic group such as methyl or phenyl, which is typified by an alkylsiloxane polymer, an alkylsilsesquioxane polymer, a silsesquioxane hydride polymer, or an alkylsilsesquioxane hydride polymer. When the interlayer insulating layer 223 is formed using the above material, a coating method, a printing method, or the like is used. Alternatively, as the interlayer insulating layer 223, a silicon oxide layer may be formed by a sputtering method, a CVD method, or the like. Note that the interlayer insulating layer 223 is provided with an opening in a region where the electron sources 225 are formed.

The gate electrode 224 can be formed using tungsten, molybdenum, niobium, tantalum, chromium, aluminum, copper, or the like. As a method for forming the gate electrode 224, the method for forming the cathode electrode 222 can be used as appropriate. The gate electrode 224 can be formed using a rectangular conductive layer which extends in a second direction that intersects with the first direction at 90°, Note that the gate electrode is provided with an opening in a region where the electron sources 225 are formed.

Note that in a space between the gate electrode 224 and the metal back 234, that is, in a space between the front substrate 210 and the back substrate 220, a converging electrode may be formed. The converging electrode is provided to converge an electron beam emitted from the electron-emission element. By providing the converging electrode, light emission luminance of a light-emission cell can be improved, reduction in contrast due to color mixture of adjacent cells can be suppressed, and so on. A more negative voltage compared with the metal back (or the anode electrode) is preferably applied to the converging electrode.

Next, a structure of a cell of an FED having a surface-conduction electron-emission element is described. FIG. 18B is a cross-sectional view of a cell of an FED having a surface-conduction electron-emission element.

A surface-conduction electron-emission element 250 includes element electrodes 255 and 256 which are opposed to each other, and conductive layers 258 and 259 which are in contact with the element electrodes 255 and 256 respectively. The conductive layers 258 and 259 have a gap portion therebetween. When a voltage is applied to the element electrodes 255 and 256, an intense electric field is generated in the gap portion, and electrons are emitted from one of the conductive layers to the other thereof, due to a tunnel effect. By applying a positive voltage to the metal back 234 (or the anode electrode) formed in the front substrate 210, the electrons emitted from one of the conductive layers to the other thereof are guided to the phosphor layer 232. Then, this electron beam 260 excites a phosphor, thereby providing light emission.

Therefore, surface-conduction electron-emission elements are arranged in matrix, and a voltage is selectively applied to the element electrodes 255 and 256 and the metal back (or the anode electrode), so that light emission of each cell can be controlled.

Because a drive voltage of the surface-conduction electron-emission element is low compared with another electron-emission element, power consumption of the FED can be lowered.

Next, a structure of a cell having a surface-conduction electron-emission element is described. The front substrate 210 includes the first light-transmitting substrate 211, the phosphor layer 232 and the black matrix 233 formed over the first light-transmitting substrate 211, and the metal back 234 formed over the phosphor layer 232 and the black matrix 233. Note that an anode electrode may be formed between the first light-transmitting substrate 211 and the phosphor layer 232. As the anode electrode, a rectangular conductive layer which extends in a first direction can be formed.

The back substrate 220 includes the second light-transmitting substrate 221, a row direction wiring 252 formed over the second light-transmitting substrate 221, an interlayer insulating layer 253 formed over the row direction wiring 252 and the second light-transmitting substrate 221, a connection wiring 254 connected to the row direction wiring 252 with the interlayer insulating layer 253 interposed therebetween, the element electrode 255 which is connected to the connection wiring 254 and formed over the interlayer insulating layer 253, the element electrode 256 formed over the interlayer insulating layer 253, a column direction wiring 257 connected to the element electrode 256, the conductive layer 258 which is in contact with the element electrode 255, and the conductive layer 259 which is in contact with the element electrode 256. Note that the electron-emission element 250 shown in FIG. 18B includes a pair of the element electrodes 255 and 256 and a pair of the conductive layers 258 and 259.

The row direction wiring 252 can be formed using a metal such as titanium, nickel, gold, silver, copper, aluminum, or platinum; or an alloy thereof. As a method for forming the row direction wiring 252, a droplet discharge method, a vacuum evaporation method, a printing method, or the like can be used. Alternatively, the row direction wiring 252 can be formed in such a way that a conductive layer formed by a sputtering method, a CVD method, or the like is selectively etched. The thickness of each of the element electrodes 255 and 256 is preferably 20 nm to 500 nm.

As the interlayer insulating layer 253, a material and a formation method similar to those of the interlayer insulating layer 223 shown in FIG. 18A can be used as appropriate. The thickness of the interlayer insulating layer 253 is preferably 500 nm to 5 μm.

As the connection wiring 254, a material and a formation method similar to those of the row direction wiring 252 can be used as appropriate.

The pair of the element electrodes 255 and 256 can be formed using a metal such as chromium, copper, iridium, molybdenum, palladium, platinum, titanium, tantalum, tungsten, or zirconium; or an alloy thereof. As a method for forming the element electrodes 255 and 256, a droplet discharge method, a vacuum evaporation method, a printing method, or the like can be used. Alternatively, the element electrodes 255 and 256 can be formed in such a way that a conductive layer formed by a sputtering method, a CVD method, or the like is selectively etched. The thickness of each of the element electrodes 255 and 256 is preferably 20 nm to 500 nm.

As the column direction wiring 257, a material and a formation method similar to those of the row direction wiring 252 can be used as appropriate.

As materials of the pair of the conductive layers 258 and 259, a metal such as palladium, platinum, chromium, titanium, copper, tantalum, or tungsten; an oxide such as palladium oxide, tin oxide, or a mixture of indium oxide and antimony oxide; silicon; carbon; or the like can be used as appropriate. Further, a stack using a plurality of the above-described materials may be used. The conductive layers 258 and 259 can be formed using particles of any of the above-described materials. Note that an oxide layer may be formed at the peripheries of the particles of any of the above-described materials. By using the particles having an oxide layer, electrons can be accelerated and easily emitted. As a method for forming the conductive layers 258 and 259, a droplet discharge method, a vacuum evaporation method, a printing method, or the like can be used. The thickness of each of the conductive layers 258 and 259 is preferably 0.1 nm to 50 nm.

A distance of the gap portion formed between the pair of the conductive layers 258 and 259 is preferably 100 mm or less, and more preferably, 50 nm or less. The gap portion can be formed by cleavage due to application of a voltage to the conductive layers 258 and 259 or cleavage using a converged ion beam. Alternatively, the gap portion can be formed by selective etching using wet etching or dry etching with the use of a resist mask.

Note that a converging electrode may be formed between the front substrate 210 and the back substrate 220. By providing the converging electrode, an electron beam emitted from the electron-emission element can be converged; accordingly, light emission luminance of a cell can be improved, reduction in contrast due to color mixture of adjacent cells can be suppressed, or the like. A negative voltage compared with the metal back 234 (or the anode electrode) is preferably applied to the converging electrode.

Next, a method for manufacturing an FED panel is described hereinafter

At the periphery of the back substrate 220, glass for sealing is printed by a printing method and then pre-baked. Next, the front substrate 210 and the back substrate 220 are aligned, provisionally fixed, and then heated. Accordingly, the glass for sealing is melted and then cooled, so that the front substrate 210 and the back substrate 220 are attached together to be made as a panel. Next, an inside of the panel is exhausted into a vacuum while the panel is heated. Next, by heating a vent pipe provided for the back substrate 220, an open end portion of the vent pipe is closed and the inside of the panel is vacuum locked. Accordingly, an FED panel can be completed.

Figure 16:
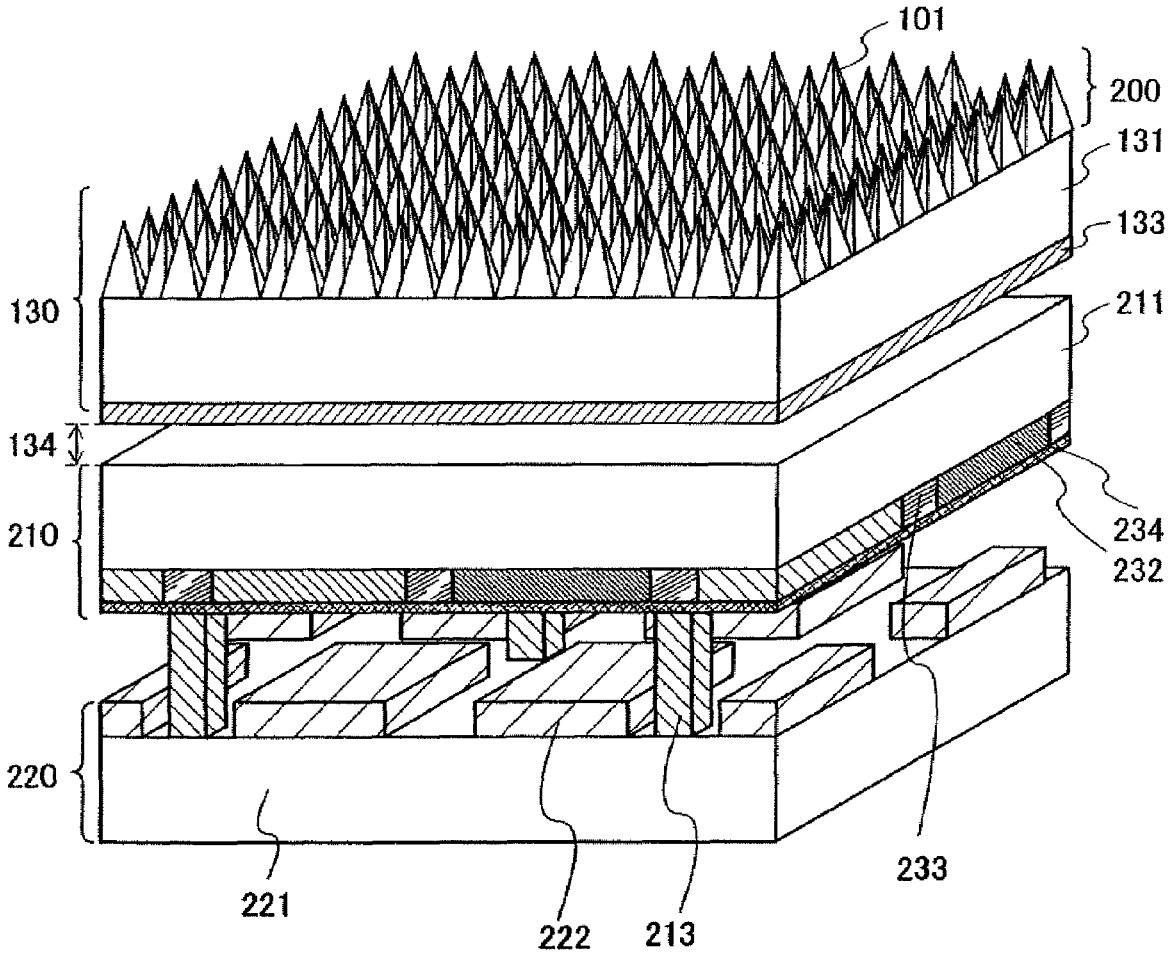
FIG. 16 is a perspective view of an FED according to the present invention.

As shown in FIG. 16, an FED may include a panel, in which the front substrate 210 and the back substrate 220 are sealed, and the optical filter 130, in which the electromagnetic wave shield layer 133 as described in Embodiment Mode 2 is formed on one side of the light-transmitting substrate 131 and the anti-reflection layer 200 as described in Embodiment Mode 1 is formed on the other side of the light-transmitting substrate 131. Note that in FIG. 16, the mode is shown in which the anti-reflection layer 200 is not formed on a surface of the first light-transmitting substrate 211 of the front substrate 210; however, an anti-reflection layer as described in Embodiment Mode 1 may also be provided on the surface of the first light-transmitting substrate 211 of the front substrate 210. With such a structure, reflectance of incident light from external can be reduced further.

Figure 17:
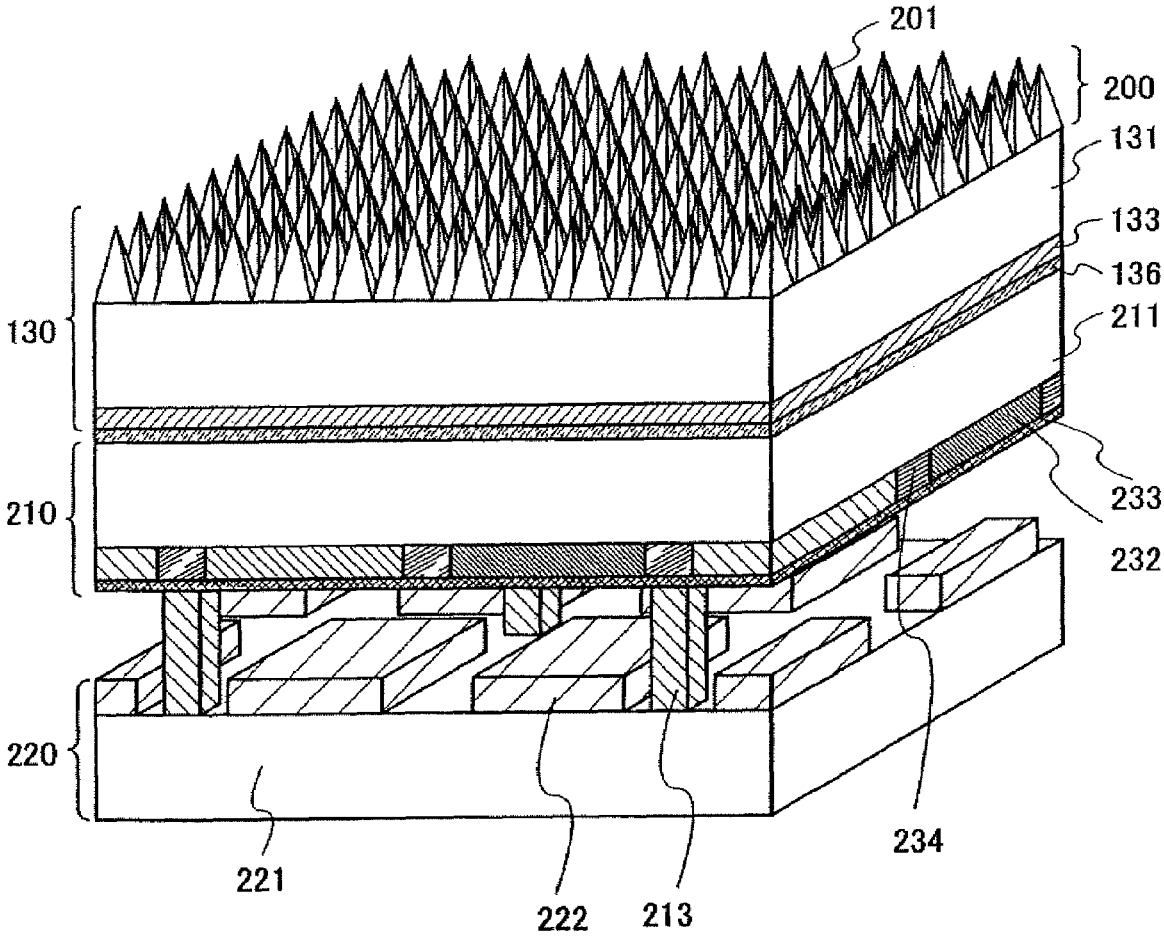
FIG. 17 is a perspective view of an FED according to the present invention.

Note that in FIG. 16, the front substrate 210 and the optical filter 130 are provided with the gap 134 interposed therebetween; however, as shown in FIG. 17, the optical filter 130 and the front substrate 210 may be attached to each other by using the adhesive 136.

In particular, by using plastic for the light-transmitting substrate 131 and providing the optical filter 130 on the surface of the front substrate 210 using the adhesive 136, reduction in thickness and weight of an FED can be achieved.

Note that here, the structure in which the optical filter 130 includes the electromagnetic wave shield layer 133 and the anti-reflection layer 200 is described; however, a near-infrared ray shielding layer may be provided together with the electromagnetic wave shield layer 133 in a similar manner to Embodiment Mode 2. Further alternatively, one layer of a functional layer having an electromagnetic wave shield function and a near-infrared light shielding function may be formed.

Figure 19:
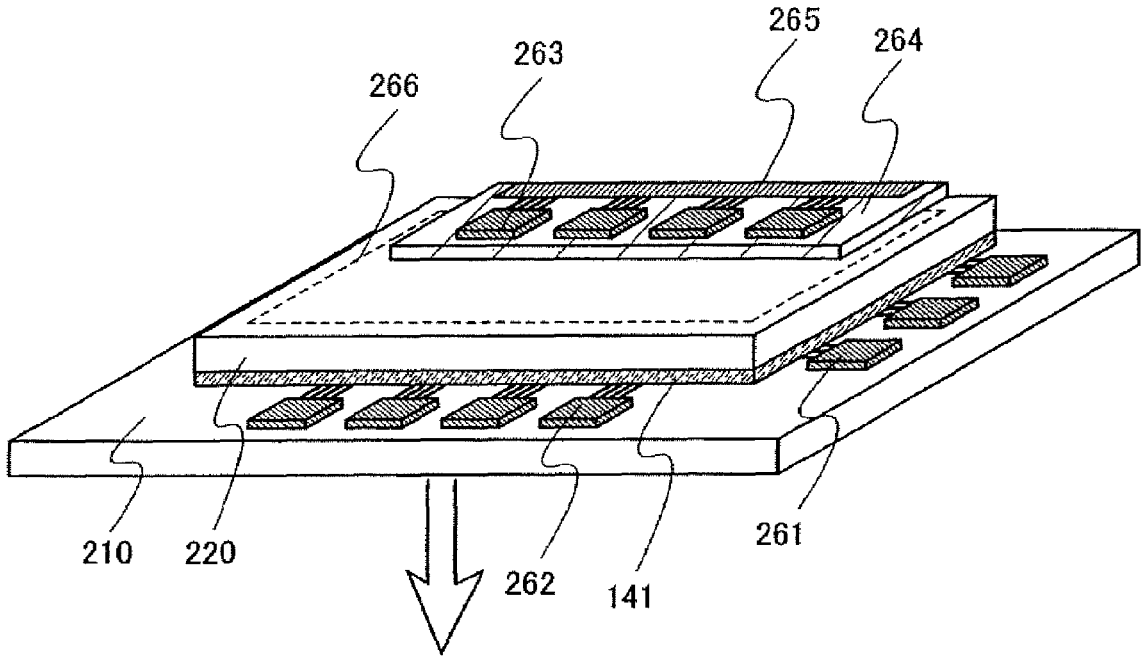
FIG. 19 is a perspective view of an FED module according to the present invention.
Figure 20:
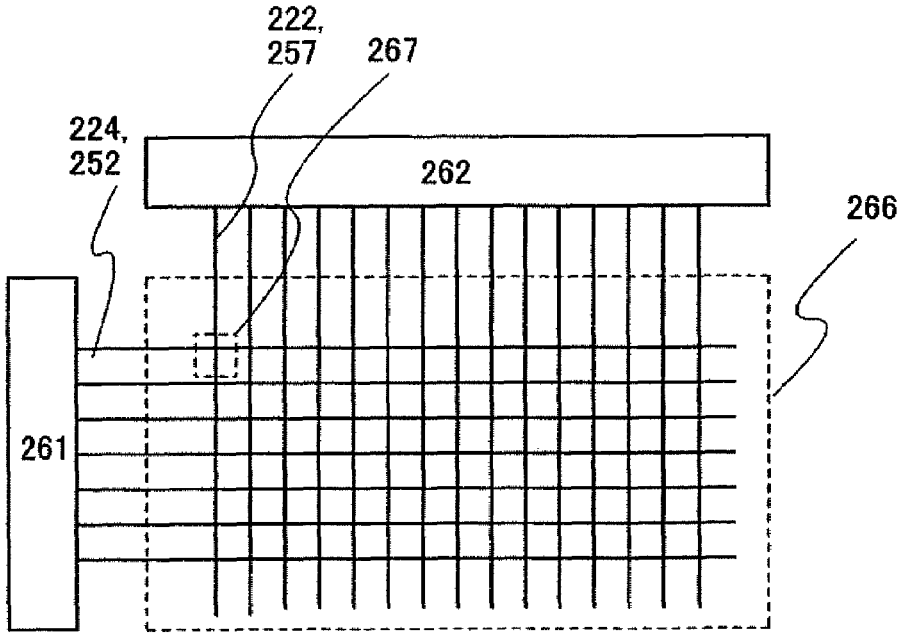
FIG. 20 shows an FED according to the present invention.

Next, an FED module having a Spindt-type electron-emission element and a driving method thereof will be described with reference to FIGS. 18A, 19, and 20. FIG. 19 is a perspective view of an FED module. FIG. 20 is a schematic diagram of an FED module.

As shown in FIG. 19, the periphery of the front substrate 210 and the back substrate 220 is sealed with the glass 141 for sealing. A driver circuit 261 that drives a row electrode and a driver circuit 262 that drives a column electrode are provided over the first light-transmitting substrate which is part of the front substrate 210 and are connected to respective electrodes.

A driver circuit 263 which applies a voltage to a metal back (or an anode electrode) is provided for the second light-transmitting substrate which is part of the back substrate 220 and is connected to the metal back (or the anode electrode). Here, the driver circuit 263 which applies a voltage to the metal back (or the anode electrode) is provided over a wiring board 264, and the driver circuit 263 and the metal back (or the anode electrode) are connected through an FPC 265. Further, although not shown, a control circuit which controls the driver circuits 261 to 263 is provided over the first light-transmitting substrate 211 or the second light-transmitting substrate 221.

As shown in FIGS. 18A and 20, a light-emission cell 267 of a display portion 266 is selected by the driver circuit 261 which drives a row electrode and the driver circuit 262 which drives a column electrode based on image data input from a control portion; a voltage is applied to the gate electrode 224 and the cathode electrode 222 in the light-emission cell 267; and an electron beam is emitted from the electron-emission element 230 of the light-emission cell 267. In addition, an anode voltage is applied to the metal back 234 (or the anode electrode) by the driver circuit which applies a voltage to the metal back 234 (or the anode electrode). The electron beam 235 emitted from the electron-emission element 230 of the light-emission cell 267 is accelerated by the anode voltage; a surface of the phosphor layer 232 of the front substrate 210 is irradiated with the electron beam 235 to excite a phosphor; and the phosphor emits light, so that the light can be emitted to the outer side of the front substrate. In addition, a given cell is selected by the above-described method, so that an image can be displayed.

Next, an FED module having a surface-conduction electron-emission element and a driving method thereof will be described with reference to FIGS. 18B, 19, and 20.

As shown in FIG. 19, the periphery of the front substrate 210 and the back substrate 220 is sealed with the glass 141 for sealing. The driver circuit 261 that drives a row electrode and the driver circuit 262 that drives a column electrode are provided over the first light-transmitting substrate which is part of the front substrate 210 and are connected to respective electrodes.

Over the second light-transmitting substrate which is part of the back substrate 220, the driver circuit 263 which applies a voltage to a metal back (or an anode electrode) is provided and connected to the metal back (or the anode electrode). Although not shown, a control circuit which controls the driver circuits 261 to 263 is provided over the first light-transmitting substrate or the second light-transmitting substrate.

As shown in FIGS. 18B and 20, the light-emission cell 267 of the display portion 266 is selected by the driver circuit 261 which drives a row electrode and the driver circuit 262 which drives a column electrode based on image data input from a control portion; a voltage is applied to the row direction wiring 252 and the column direction wiring 257 in the light-emission cell 267, so that a voltage is applied between the element electrodes 255 and 256; and the electron beam 260 is emitted from the electron-emission element 250 of the light-emission cell 267. In addition, an anode voltage is applied to the metal back (or the anode electrode) by the driver circuit which applies a voltage to the metal back 234 (or the anode electrode). The electron beam emitted from the electron-emission element 250 is accelerated by the anode voltage; the surface of the phosphor layer 232 of the front substrate 210 is irradiated with the electron beam to excite a phosphor; and the phosphor emits light, so that the light can be emitted to the outer side of the front substrate. In addition, a given cell is selected by the above-described method, so that an image can be displayed.

The FED described in this embodiment mode includes the anti-reflection layer on its surface. The anti-reflection layer includes a plurality of pyramid-shaped projections, and incident light from external is reflected to not a viewer side but another adjacent pyramid-shaped projection because the interface of the pyramid-shaped projection is not perpendicular to an incident direction of the light from external. Alternatively, reflected light travels between adjacent pyramid-shaped projections. Part of incident light enters an adjacent pyramid-shaped projection having a hexagonal base, and the other part of the incident light is then incident on the other adjacent pyramid-shaped projection as reflected light. In this manner, incident light from external reflected at an interface of a pyramid-shaped projection repeats incidence on adjacent pyramid-shaped projections.

In other words, the number of entries of light from external which is incident on the pyramid-shaped projections of an FED is increased; therefore, the amount of incident light from external entering the pyramid-shaped projections is increased. Thus, the amount of incident light from external reflected to a viewer side is reduced, and the cause of a reduction in visibility such as reflection can be prevented.

In the present invention, by a structure, in which a plurality of pyramid-shaped projections are arranged densely without a space therebetween, a refractive index changes due to a physical shape that is the pyramid-shaped projections protruding toward the outside (air side) from a display screen surface. In this embodiment mode, apexes of the plurality of pyramid-shaped projections are arranged at equal intervals, and each side of a base which forms a pyramid shape of a pyramid-shaped projection is arranged to be in contact with a side of a base which forms a pyramid shape of an adjacent pyramid-shaped projection. In other words, one pyramid-shaped projection is surrounded by other pyramid-shaped projections, and the base of the pyramid-shaped projection shares a side of a base with the base of the adjacent pyramid-shaped projection.

Thus, since the pyramid-shaped projections are arranged densely without a space, at equal intervals between the apexes thereof, an FED of the present invention has an excellent anti-reflection function with which incident light from external can be efficiently scattered in many directions.

In this embodiment mode, it is preferable that each of the intervals between the apexes of the plurality of pyramid-shaped projections and the width of the base of each of the plurality of pyramid-shaped projections be 350 nm or less each and the height of each of the plurality of pyramid-shaped projections be 800 nm or more. Further, the fill rate (filling (occupying) percentage on the substrate surface to serve as a display screen) of bases of the plurality of pyramid-shaped projections per unit area on the substrate surface to serve as a display screen is preferably 80% or more, and more preferably 90% or more. The fill rate is a percentage of a formation region of a pyramid-shaped projection over the substrate surface to serve as a display screen. When the fill rate is 80% or more, the percentage of a plane portion where a pyramid-shaped projection having a hexagonal base is not formed on the substrate surface to serve as a display screen is 20% or less. In addition, it is preferable that the ratio of the height to the width of a base of a pyramid-shaped projection be 5 or more. When the above-described conditions are satisfied, the percentage of incidence of light from external which is incident on the plane portion is reduced and thus reflection to a viewer side can be prevented.

Further, the plurality of pyramid-shaped projections preferably have as many sides with different angles to the bases thereof as possible because incident light are scattered in more directions. In this embodiment mode, a pyramid-shaped projection has six sides which are in contact with a base of the pyramid-shaped projection at six different angles. In addition, since a base of a pyramid-shaped projection shares a vertex with bases of other pyramid-shaped projections and the pyramid-shaped projection is surrounded by a plurality of sides, which are provided at a plurality of angles, of the pyramid-shaped projections, incident light is more easily reflected in many directions. Therefore, the more vertices the base of a pyramid-shaped projection has, the more easily an anti-reflection function thereof can be exerted, and thus the base of the pyramid-shaped projection in this embodiment mode has six vertices. The pyramid-shaped projection having a hexagonal base of this embodiment mode is a shape by which pyramid-shaped projections can be arranged densely without a space therebetween, and is an optimal shape having the largest number of sides among such shapes and having an excellent anti-reflection function with which incident light can be scattered efficiently in many directions.

The pyramid-shaped projection can be formed of not a material with a uniform refractive index but a material of which the refractive index changes from an apical portion of the pyramid-shaped projection to a side of a substrate to serve as a display screen. For example, in each of the plurality of pyramid-shaped projections, a portion closer to the apical portion of the pyramid-shaped projection can be formed of a material having a refractive index equivalent to that of air, so that reflection of light from external which is incident on the pyramid-shaped projection from the air, at the surface of the pyramid-shaped projection can be further reduced. On the other hand, in each of the plurality of pyramid-shaped projections each having a hexagonal base, a portion closer to the substrate to serve as a display screen can be formed of a material having a refractive index more equivalent to that of the substrate, so that reflection, at an interface between the pyramid-shaped projection and the substrate, of light which travels through the pyramid-shaped projection and is incident on the substrate can be reduced. When a glass substrate is used as the substrate, since the refractive index of the air is lower than that of the glass substrate, the pyramid-shaped projection may have such a structure in which a portion closer to an apical portion of the pyramid-shaped projection is formed of a material having a lower refractive index and a portion closer to a base of the pyramid-shaped projection is formed of a material having a higher refractive index. In other words, the pyramid-shaped projection may have such a structure in which the refractive index increases from the apical portion to the base of the pyramid-shaped projection.

By being provided with a plurality of adjacent pyramid-shaped projections on a surface, the FED shown in this embodiment mode has a high anti-reflection function capable of reducing reflection of incident light from external. Therefore, an FED with high visibility can be provided. Accordingly, an FED with higher image quality and higher performance can be manufactured.

Embodiment Mode 4

Figure 22:
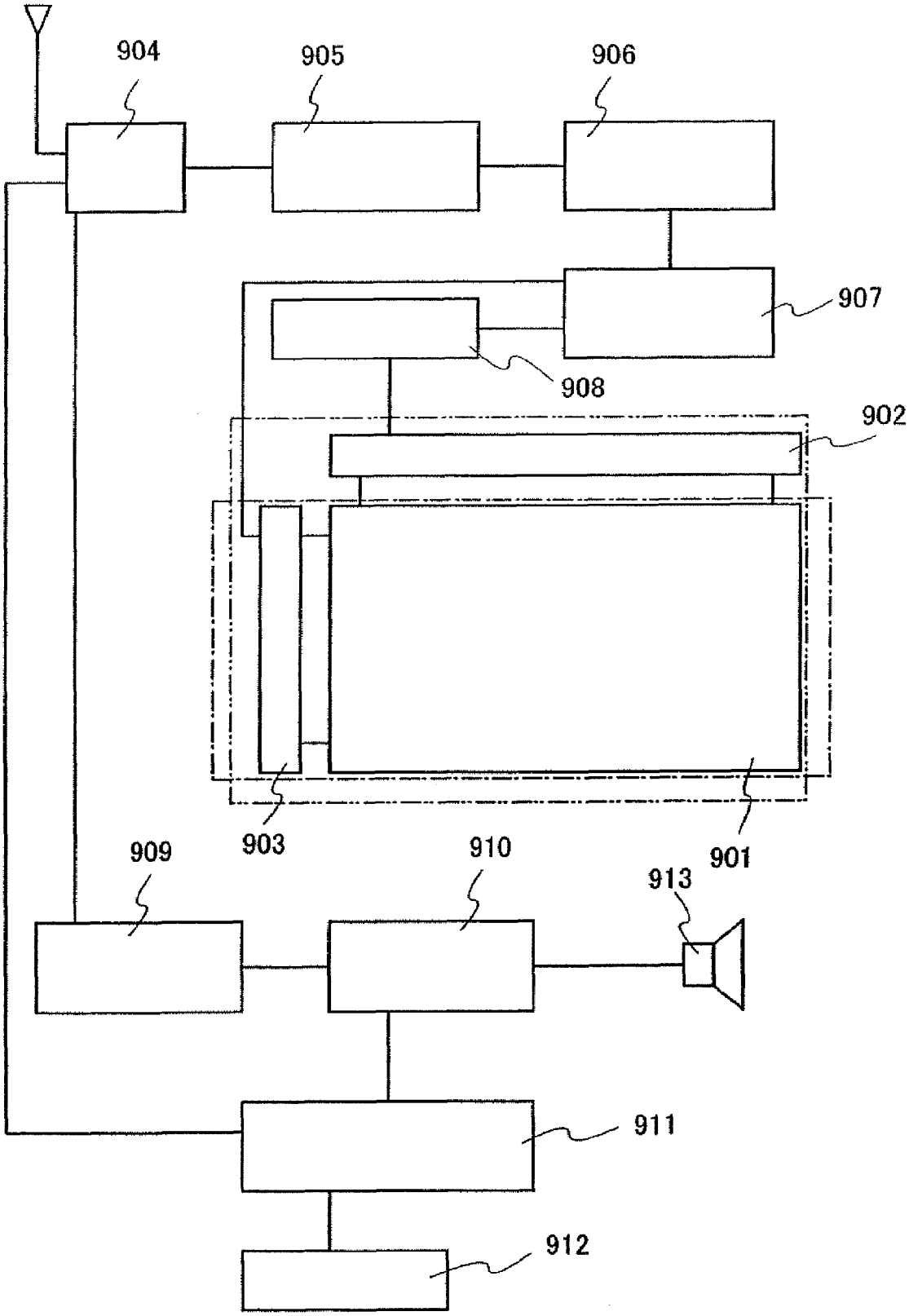
FIG. 22 is a block diagram showing a main structure of an electronic device to which the present invention is applied.

With the PDP and FED of the present invention, a television device (also simply referred to as a television or a television receiver) can be completed. FIG. 22 is a block diagram showing main components of the television device.

Figure 21A:
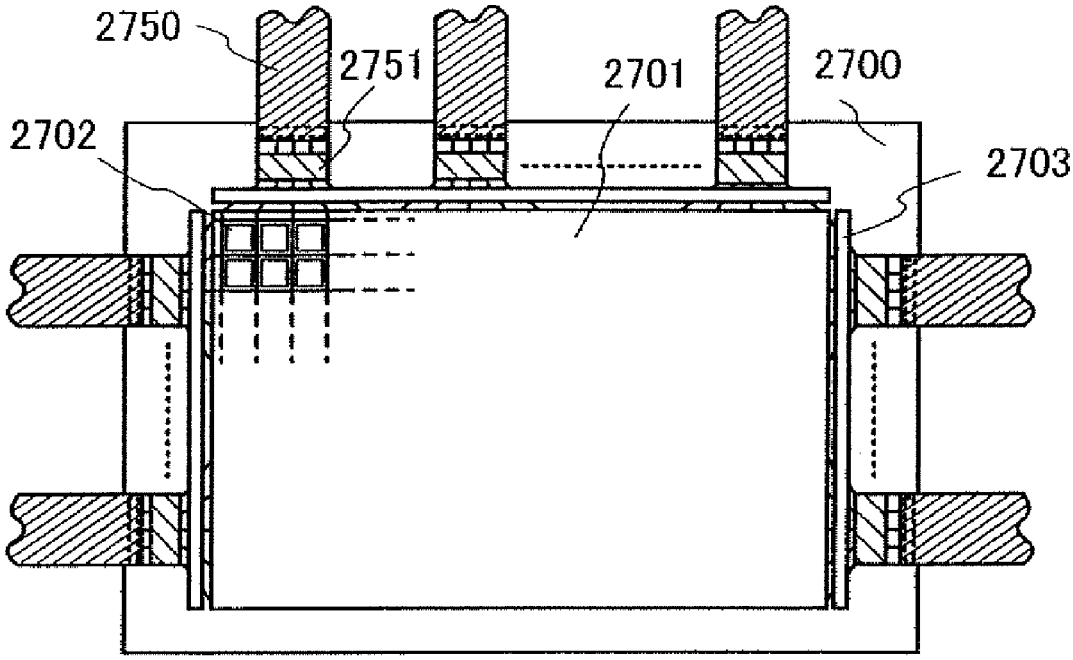
FIGS. 21A and 21B are top views of display devices according to the present invention.

FIG. 21A is a top view showing a structure of a PDP panel or an FED panel (hereinafter referred to as a display panel) of the present invention. A pixel portion 2701 in which pixels 2702 are arranged in matrix and an input terminal 2703 are formed over a substrate 2700 having an insulating surface. The number of pixels may be determined in accordance with various standards. In a case of XGA full-color display using RGB, the number of pixels may be 1024×768×3 (RGB). In a case of UXGA full-color display using RGB, the number of pixels may be 1600×1200×3 (RGB), and in a case of full-spec, high-definition, and full-color display using RGB, the number may be 1920×1080×3 (RGB).

Figure 21B:
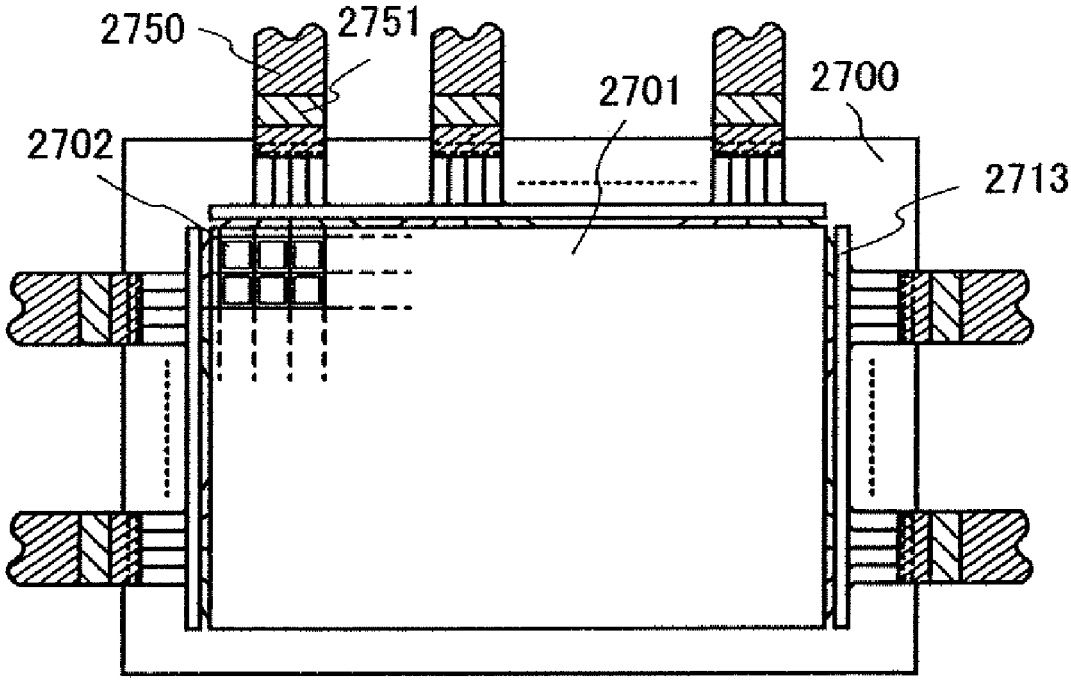

A driver IC 2751 may be mounted on the substrate 2700 by a COG (chip on glass) method as shown in FIG. 21A. As another mounting mode, a TAB (tape automated bonding) method may be used as shown in FIG. 21B. The driver IC may be formed over a single crystalline semiconductor substrate or may be formed using a TFT over a glass substrate. In each of FIGS. 21A and 21B, the driver IC 2751 is connected to an FPC (flexible printed circuit) 2750.

As a structure of other external circuits in FIG. 22, a video signal amplifier circuit 905 which amplifies a video signal among signals received by a tuner 904, a video signal processing circuit 906 which converts the signals outputted from the video signal amplifier circuit 905 into chrominance signals corresponding to respective colors of red, green, and blue, a control circuit 907 which converts the video signal into an input specification of the driver IC, and the like are provided on an input side of the video signal. The control circuit 907 outputs signals to both a scan line side and a signal line side. In the case of digital drive, a signal dividing circuit 908 may be provided on the signal line side and an input digital signal may be divided into m pieces and supplied.

An audio signal among signals received by the tuner 904 is sent to an audio signal amplifier circuit 909, and an output thereof is supplied to a speaker 913 through an audio signal processing circuit 910. A control circuit 911 receives control information of a receiving station (reception frequency) or sound volume from an input portion 912 and transmits signals to the tuner 904 and the audio signal processing circuit 910.

Figure 23A:
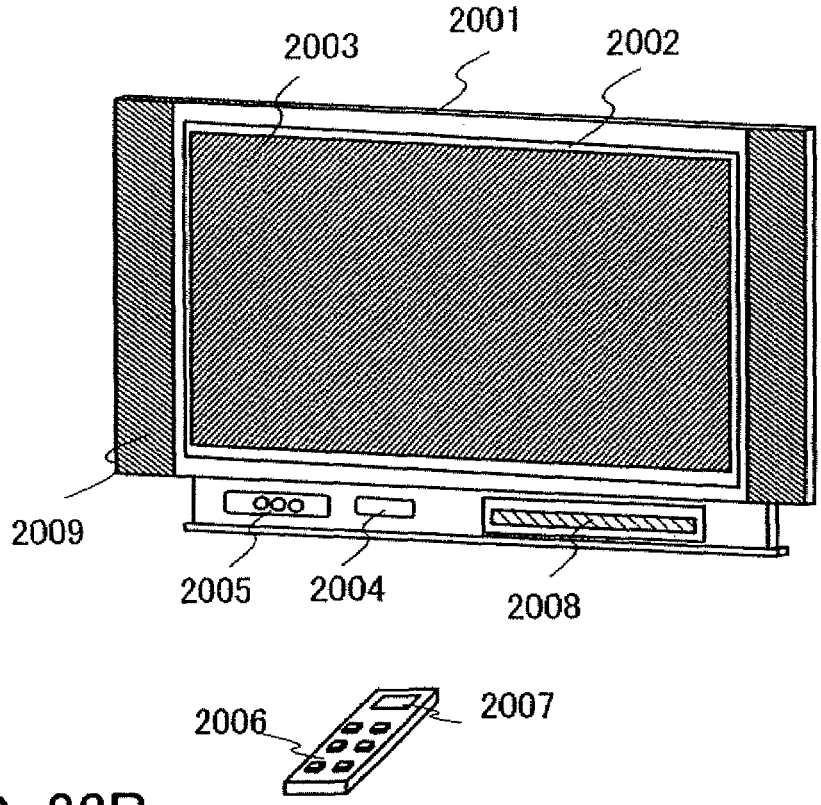
FIGS. 23A and 23B show electronic devices according to the present invention.
Figure 23B:
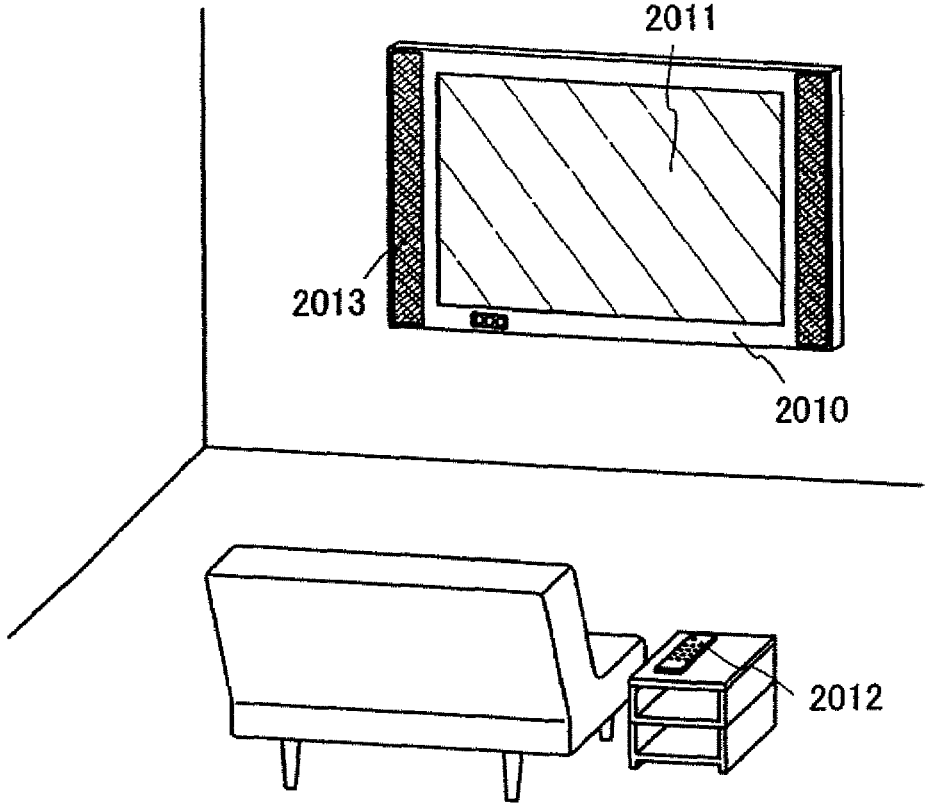

A television device can be completed by incorporating the display module into a chassis as shown in FIGS. 23A and 23B. When a PDP module is used as a display module, a PDP television device can be manufactured. When an FED module is used, an FED television device can be manufactured. In FIG. 23A, a main screen 2003 is formed by using the display module, and a speaker portion 2009, an operation switch, and the like are provided as its accessory equipment. Thus, a television device can be completed by using the present invention.

A display panel 2002 is incorporated in a chassis 2001, and general TV broadcast can be received by a receiver 2005. When the display device is connected to a communication network by wired or wireless connections via a modem 2004, one-way (from a sender to a receiver) or two-way (between a sender and a receiver or between receivers) information communication can be performed. The television device can be operated by using a switch built in the chassis 2001 or a remote control unit 2006. A display portion 2007 for displaying output information may also be provided in the remote control device 2006.

Further, the television device may include a sub screen 2008 formed using a second display panel so as to display channels, volume, or the like, in addition to the main screen 2003.

FIG. 23B shows a television device having a large-sized display portion, for example, a 20-inch to 80-inch display portion. The television device includes a chassis 2010, a display portion 2011, a remote control device 2012 that is an operation portion, a speaker portion 2013, and the like. The present invention is applied to manufacturing of the display portion 2011. Since the television device in FIG. 23B is a wall-hanging type, it does not require a large installation space.

Naturally, the present invention is not limited to the television device, and can be applied to various use applications as a large-sized display medium such as an information display board at a train station, an airport, or the like, or an advertisement display board on the street, as well as a monitor of a personal computer.

This embodiment mode can be appropriately combined with any of Embodiment Mode 1 to 3.

Embodiment Mode 5

Examples of electronic devices using a PDP and an FED in accordance with the present invention are as follows: a television device (also simply referred to as a television or a television receiver), a camera such as a digital camera or a digital video camera, a cellular telephone device (also simply referred to as a cellular phone or a cell-phone), a portable information terminal such as a PDA, a portable game machine, a computer monitor, a computer, a sound reproducing device such as a car audio system, an image reproducing device including a recording medium such as a home-use game machine, and the like. In addition, the present invention can be applied to any gaming machine having a display device, such as a pachinko machine, a slot machine, a pinball machine, or a large-sized game machine. Specific examples of them are described with reference to FIGS. 24A to 24F.

Figure 24A:
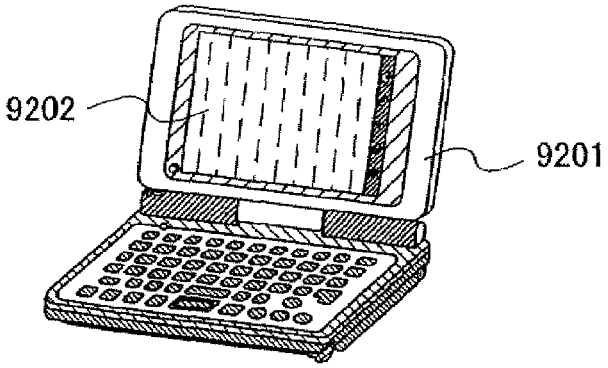
FIGS. 24A to 24F show electronic devices according to the present invention.

A portable information terminal device shown in FIG. 24A includes a main body 9201, a display portion 9202, and the like. The FED of the present invention can be applied to the display portion 9202. Accordingly, a high-performance portable information terminal device which can display a high-quality image with high visibility can be provided.

Figure 24B:
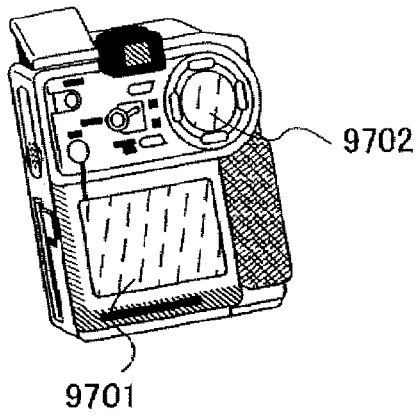

A digital video camera shown in FIG. 24B includes a display portion 9701, a display portion 9702, and the like. The FED of the present invention can be applied to the display portion 9701. Accordingly, a high-performance digital video camera which can display a high-quality image with high visibility can be provided.

Figure 24C:
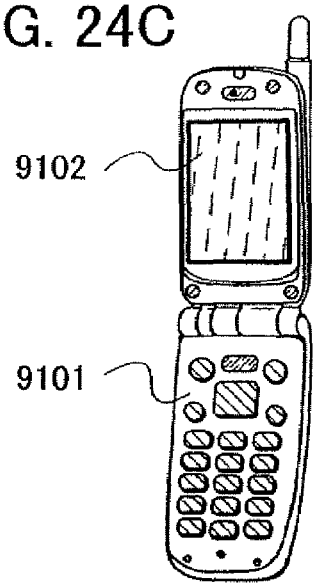

A cellular phone shown in FIG. 24C includes a main body 9101, a display portion 9102, and the like. The FED of the present invention can be applied to the display portion 9102. Accordingly, a high-performance cellular phone which can display a high-quality image with high visibility can be provided.

Figure 24D:
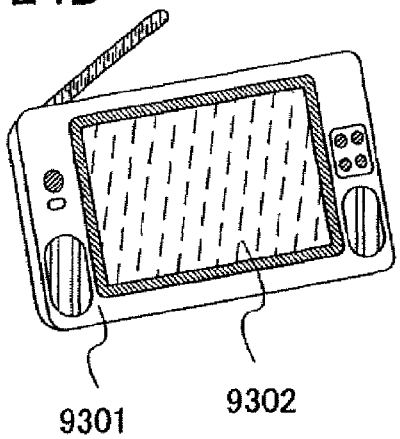

A portable television device shown in FIG. 24D includes a main body 9301, a display portion 9302, and the like. The PDP and the FED of the present invention can be applied to the display portion 9302. Accordingly, a high-performance portable television device which can display a high-quality image with high visibility can be provided. The PDP and the FED of the present invention can be applied to a wide range of television devices ranging from a small-sized television device mounted on a portable terminal such as a cellular phone, a medium-sized television device which can be carried, to a large-sized (for example, 40-inch or larger) television device.

Figure 24E:
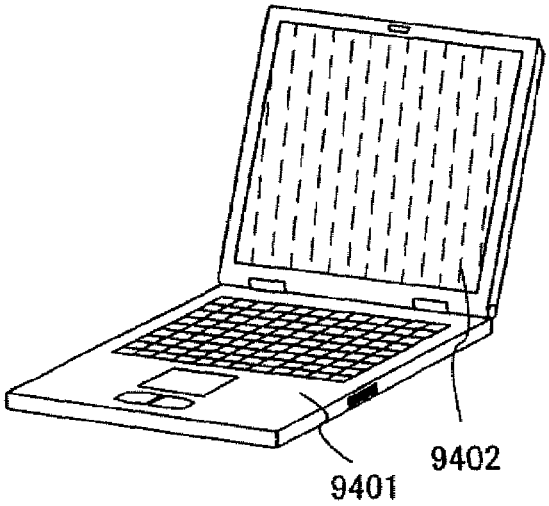

A portable computer shown in FIG. 24E includes a main body 9401, a display portion 9402, and the like. The FED of the present invention can be applied to the display portion 9402. Accordingly, a high-performance portable computer which can display a high-quality image with high visibility can be provided.

Figure 24F:
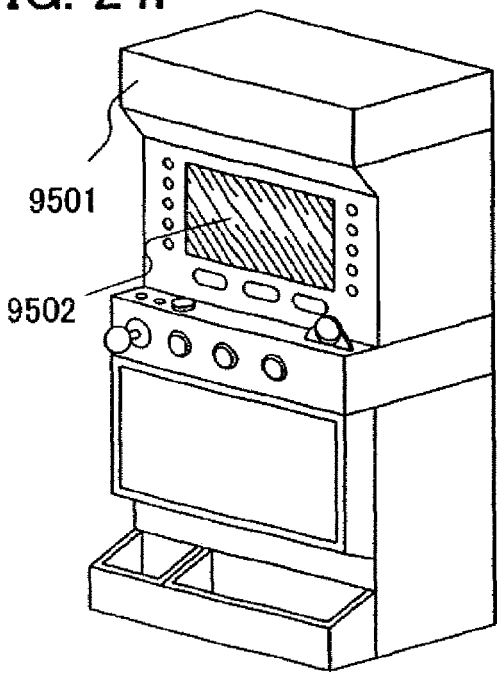

A slot machine shown in FIG. 24F includes a main body 9501, a display portion 9502, and the like. The PDP and the FED of the present invention can be applied to the display portion 9502. Accordingly, a high-performance slot machine which can display a high-quality image with high visibility can be provided.

As described above, a high-performance electronic device which can display a high-quality image with high visibility can be provided by using the display device of the present invention.

This embodiment mode can be appropriately combined with any of Embodiment Modes 1 to 4.

This application is based on Japanese Patent Application serial no. 2006-328025 filed with Japan Patent Office on Dec. 5, 2006, the entire contents of which are hereby incorporated by reference.

EXPLANATION OF REFERENCE

100: anti-reflection layer, 101: pyramid-shaped projection, 110: front substrate, 111: light-transmitting substrate, 114: light-transmitting insulating layer, 115: protective layer, 116: plasma, 117; ultraviolet ray, 118: light emission, 120: back substrate, 121: light-transmitting substrate, 122: data electrode, 123: dielectric layer, 124: partition (rib), 125: phosphor layer, 130: optical filter, 131; light-transmitting substrate, 132: near-infrared ray shielding layer, 133: electromagnetic wave shield layer, 134: gap, 135: electromagnetic wave absorber, 136: adhesive, 141: glass for scaling, 142: scan electrode driver circuit, 143: sustain electrode driver circuit, 144: data electrode driver circuit, 145: display portion, 146: wiring board, 147: FPC, 150: discharge cell, 200: anti-reflection layer, 201: pyramid-shaped projection, 210: front substrate, 211: light-transmitting substrate, 213: spacer, 220: back substrate, 221: light-transmitting substrate, 222: cathode electrode, 223: interlayer insulating layer, 224: gate electrode, 225: electron source, 226: electron-emission element, 230: electron-emission element, 232: phosphor layer, 233: black matrix, 234: metal back, 235: electron beam, 250: electron-emission element, 252: row direction wiring, 253: interlayer insulating layer, 254: connection wiring, 255: element electrode, 256: element electrode, 257: column direction wiring, 258: conductive layer, 259: conductive layer, 260: electron beam, 261: driver circuit, 262: driver circuit, 263: driver circuit, 264: wiring board, 265: FPC, 266: display portion, 267: light-emission cell, 410: substrate, 450: substrate, 451: pyramid-shaped projection, 470: substrate, 471: pyramid-shaped projection, 480: substrate, 481: pyramid-shaped projection, 486: film, 490: substrate, 491: pyramid-shaped projection, 904: tuner, 905: video signal amplifier circuit, 906: video signal processing circuit, 907: control circuit, 908: signal dividing circuit, 909: audio signal amplifier circuit, 910: audio signal processing circuit, 911: control circuit 912: input portion, 913: speaker, 112*a*: light-transmitting conductive layer, 113*a*: scan electrode, 113*b*: sustain electrode, 2001: chassis, 2002: display panel, 2003: main screen, 2004: modem, 2005: receiver, 2006: remote control unit, 2007: display portion, 2008: sub screen, 2009: speaker portion, 2010: chassis, 2011: display portion, 2012: remote control device, 2013: speaker portion, 2700: substrate, 2701: pixel portion, 2702: pixel, 2703: input terminal, 2750: PC (flexible printed circuit), 2751: driver IC, 411*a*: pyramid-shaped projection, 411*b*: pyramid-shaped projection, 411*c*: pyramid-shaped projection, 412*a*: incident light ray, 412*b*: reflected light ray, 412*c*: reflected light ray, 412*d*: reflected light ray, 413*a*: transmitted light ray, 413*b*: transmitted light ray, 413*c*: transmitted light ray, 413*d*: transmitted light ray, 5000: pyramid-shaped projection having a hexagonal base, 5100: apex, 5200: cone-shaped projection, 5230: pyramid-shaped projection having a square base, 5250: pyramid-shaped projection having a triangle base, 5300: pyramid-shaped projection having a hexagonal base, 5301: pyramid-shaped projection having a hexagonal base, 9101: main body, 9102: display portion, 9201: main body, 9202; display portion, 9301: main body, 9302: display portion, 9401: main body, 9402: display portion, 9501: main body, 9502: display portion, 9701: display portion, 9702: display portion, 5001*a*: pyramid-shaped projection, 5101*a*: apex, 5201*a*: cone-shaped projection, 5231*a*: pyramid-shaped projection, and 5251*a*: pyramid-shaped projection.

The invention claimed is:

1. A plasma display panel comprising:

a pair of substrates;

at least a pair of electrodes provided between the pair of substrates;

a phosphor layer provided between the pair of electrodes; and an anti-reflection layer provided on an outer side of one substrate of the pair of substrates, wherein the one substrate of the pair of substrates has light-transmitting properties, wherein the anti-reflection layer has a plurality of pyramid-shaped projections, wherein one of the plurality of pyramid-shaped projections is surrounded by six adjacent pyramid-shaped projections of the plurality of pyramid-shaped projections, wherein each side of a base which forms a pyramid shape of one of the plurality of pyramid-shaped projections is in contact with a side of a base which forms a pyramid shape of an adjacent pyramid-shaped projection of the plurality of pyramid-shaped projections, wherein each of the intervals between the apexes of the plurality of pyramid-shaped projections is 350 nm or less, wherein a height of each of the plurality of pyramid-shaped projections is 800 nm or more, wherein a fill rate of bases of the plurality of pyramid-shaped projections per unit area is 80% or more, wherein a ratio of the height to a width of each of the plurality of pyramid-shaped projections is 5 or more, wherein the one of the plurality of hexagonal pyramid-shaped projections has a first portion having a first refractive index and a second portion having a second refractive index different from the first refractive index, the first portion being closer to the other substrate than the second portion, and the first refractive index having a closer refractive index to a refractive index of the other of the pair of substrates than the second refractive index.

2. A plasma display panel comprising:

a pair of substrates;

at least a pair of electrodes provided between the pair of substrates;

a phosphor layer provided between the pair of electrodes; and an anti-reflection layer provided on an outer side of one substrate of the pair of substrates, wherein the one substrate of the pair of substrates has light-transmitting properties, wherein the anti-reflection layer has a plurality of pyramid-shaped projections, wherein each side of a base which forms a pyramid shape of one of the plurality of pyramid-shaped projections is in contact with a side of a base which forms a pyramid shape of an adjacent pyramid-shaped projection of the plurality of pyramid-shaped projections, and wherein the one of the plurality of hexagonal pyramid-shaped projections has a first portion having a first refractive index and a second portion having a second refractive index different from the first refractive index, the first portion being closer to the other substrate than the second portion, and the first refractive index having a closer refractive index to a refractive index of the other of the pair of substrates than the second refractive index.

3. A plasma display panel according to claim 2, wherein one of the plurality of pyramid-shaped projections is surrounded by six adjacent pyramid-shaped projections of the plurality of pyramid-shaped projections.

4. A plasma display panel according to claim 2, wherein apexes of the plurality of pyramid-shaped projections are provided at equal intervals.

5. A plasma display panel according to claim 2, wherein each of the intervals between the apexes of the plurality of pyramid-shaped projections is 350 nm or less, and wherein the height of each of the plurality of pyramid-shaped projections is 800 nm or more.

6. A plasma display panel according to claim 2, wherein a fill rate of bases of the plurality of pyramid-shaped projections per unit area is 80% or more.

7. A plasma display panel according to claim 2, wherein a ratio of the height to a width of each of the plurality of pyramid-shaped projections is 5 or more.

8. A field emission display comprising:

a pair of substrates;

an electron-emission element provided for one of the pair of substrates;

an electrode provided for the other of the pair of substrates;

a phosphor layer which is in contact with the electrode; and an anti-reflection layer provided on an outer side of the other of the pair of substrates, wherein the other substrate has light-transmitting properties, wherein the anti-reflection layer has a plurality of pyramid-shaped projections, and wherein each side of a base which forms a pyramid shape of one of the plurality of pyramid-shaped projections is in contact with a side of a base which forms a pyramid shape of an adjacent pyramid-shaped projection of the plurality of pyramid-shaped projections, and wherein the one of the plurality of hexagonal pyramid-shaped projections has a first portion having a first refractive index and a second portion having a second refractive index different from the first refractive index, the first portion being closer to the other substrate than the second portion, and the first refractive index having a closer refractive index to a refractive index of the other of the pair of substrates than the second refractive index.

9. A field emission display according to claim 8, wherein apexes of the plurality of pyramid-shaped projections are provided at equal intervals.

10. A field emission display according to claim 8, wherein one of the plurality of pyramid-shaped projections is surrounded by six adjacent pyramid-shaped projections of the plurality of pyramid-shaped projections.

11. A field emission display according to claim 8, wherein each of the intervals between the apexes of the plurality of pyramid-shaped projections is 350 nm or less, and wherein a height of each of the plurality of pyramid-shaped projections is 800 nm or more.

12. A field emission display according to claim 8, wherein a fill rate of bases of the plurality of pyramid-shaped projections per unit area is 80% or more.

13. A field emission display according to claim 8, wherein a ratio of the height to a width of each of the plurality of pyramid-shaped projections is 5 or more.

* * * * *